US011273483B2

(12) United States Patent
Zhou et al.

(10) Patent No.: US 11,273,483 B2
(45) Date of Patent: Mar. 15, 2022

(54) THREADING METHOD, ROLLING HEAD, APPARATUS, MODULE AND PRODUCTION LINE FOR PIPE THREAD, AND PRODUCTS THEREOF

(71) Applicant: Shanghai Pan-China Fastening System Co., Ltd., Shanghai (CN)

(72) Inventors: Jun Zhou, Shanghai (CN); Yongliang Zhang, Shanghai (CN); Jianming Yang, Shanghai (CN); Minjun Yang, Shanghai (CN)

(73) Assignee: Shanghai Pan-China Fastening System Co., Ltd., Shanghai (CN)

( * ) Notice: Subject to any disclaimer, the term of this patent is extended or adjusted under 35 U.S.C. 154(b) by 246 days.

(21) Appl. No.: 16/469,627

(22) PCT Filed: Dec. 13, 2017

(86) PCT No.: PCT/CN2017/115963

§ 371 (c)(1),
(2) Date: Jun. 13, 2019

(87) PCT Pub. No.: WO2018/108105

PCT Pub. Date: Jun. 21, 2018

(65) Prior Publication Data

US 2020/0086376 A1 Mar. 19, 2020

(30) Foreign Application Priority Data

Dec. 13, 2016 (CN) ..... 201611146711.5

(51) Int. Cl.
*B21H 3/04* (2006.01)
*B21B 27/02* (2006.01)

(52) U.S. Cl.
CPC ..... *B21H 3/042* (2013.01); *B21B 27/024* (2013.01)

(58) Field of Classification Search
CPC ..... B21H 3/04; B21H 3/042; B21H 3/044; B21H 3/046; B21B 27/024
See application file for complete search history.

(56) References Cited

U.S. PATENT DOCUMENTS 2,017,386 A * 10/1935 Bannister ..... B21B 19/08 72/97
3,058,196 A 10/1962 Bour
(Continued)

FOREIGN PATENT DOCUMENTS

CA 2 772 658 A1 3/2011
CN 1285248 A 2/2001
(Continued)

OTHER PUBLICATIONS

International Search Report (English and Chinese) and Written Opinion issued in PCT/CN2017/115963, dated Mar. 15, 2018, 12 pages provided.
(Continued)

*Primary Examiner* — Gregory D Swiatocha
*Assistant Examiner* — Bobby Yeonjin Kim
(74) *Attorney, Agent, or Firm* — Hamre, Schumann, Mueller & Larson, P.C.

(57) ABSTRACT

Provided is a method for performing an external pipe thread process on a hollow blank by at least twice rolling: firstly, the first rolling wheel group rolls the outer surface of the hollow blank into a threaded cylindrical surface or a threaded conical surface or a threaded cylindrical conical mixing surface, and secondly, the second rolling wheel group rolls again for the outer surface of the hollow blank which has processed in step 1, and rolling to form an external pipe thread; wherein the number of rolling wheels in a rolling wheel group, used in any two back-to-back rolling processes in a processing sequence, are different in parity. Further provided are various rolling head, module,
(Continued)

apparatuses and production line for pipe thread, achieving the above processing method and having a simple structure, portability and practicality. When preforming an external pipe thread rolling process of the hollow blank, thereby improving a processing yield; in addition, the invention also provides a threaded cylindrical surface or a threaded conical surface or threaded cylindrical conical mixing surface products by the first rolling wheel group.

18 Claims, 29 Drawing Sheets

(56) References Cited

U.S. PATENT DOCUMENTS

| | | | | |
|---|---|---|---|---|
| 3,452,567 | A | 7/1969 | Marcovitch | |
| 3,590,409 | A | 7/1971 | Bergere | |
| 4,617,816 | A | 10/1986 | Brinkman | |
| 4,785,649 | A | 11/1988 | Watanabe et al. | |
| 5,699,691 | A | 12/1997 | Maruyama | |
| 5,870,918 | A | 2/1999 | Schunk et al. | |
| 6,904,779 | B1 * | 6/2005 | Hickok | B21C 37/207 72/100 |
| 2006/0162411 | A1 | 7/2006 | Kubota et al. | |
| 2008/0010807 | A1 * | 1/2008 | Fujii | B21H 3/046 29/558 |
| 2010/0113172 | A1 * | 5/2010 | Braun | B23P 23/02 470/57 |
| 2011/0023569 | A1 * | 2/2011 | Inage | B21B 19/04 72/69 |
| 2012/0011912 | A1 | 1/2012 | Flegel et al. | |
| 2015/0258600 | A1 * | 9/2015 | Zhou | F16L 9/02 138/109 |
| 2016/0354834 | A1 * | 12/2016 | Silberkuhl | B21H 3/044 |

FOREIGN PATENT DOCUMENTS

| | | | |
|---|---|---|---|
| CN | 2555962 | Y | 6/2003 |
| CN | 2582780 | Y | 10/2003 |
| CN | 1555938 | A | 12/2004 |
| CN | 1251820 | C | 4/2006 |
| CN | 100542735 | C | 9/2009 |
| CN | 201366550 | Y | 12/2009 |
| CN | 102423789 | A | 4/2012 |
| CN | 103264128 | A | 8/2013 |
| CN | 103286245 | A | 9/2013 |
| CN | 103521666 | A | 1/2014 |
| CN | 106238635 | A | 12/2016 |
| EP | 282889 | A2 | 9/1988 |
| GB | 1150525 | A | 4/1969 |
| JP | 1-273637 | A | 11/1989 |
| JP | 9-327742 | A | 12/1997 |
| JP | 10-34270 | A | 2/1998 |
| JP | H10244340 | A | 9/1998 |
| JP | 2003126937 | A | 5/2003 |
| JP | 6039470 | B2 | 12/2016 |
| KR | 1020110000270 | A | 1/2011 |
| SU | 703197 | A1 | 12/1979 |
| SU | 1344479 | A1 | 10/1987 |
| WO | 2014056419 | A1 | 4/2014 |
| WO | 2014161447 | A1 | 10/2014 |

OTHER PUBLICATIONS

Grupp et al., "Adoptive Cellular Therapy", Current Topics in Microbiology and immunology 344, published Online Aug. 11, 2010, 24 pages provided.

Davies et al., "Combining CD19 redirection and alloanergization to generate tumor-specific human T cells for allogeneic cell therapy of B-cell malignancies", downloaded from cancerres.aacrjournals.org on Mar. 18, 2015, American Association for Cancer Research, 11 pages provided.

Examination Report received in corresponding Australia application, dated Jun. 30, 2020 (9 pages).

* cited by examiner a b c a b a b c

C a b a b a b a b a b a b a b a b

THREADING METHOD, ROLLING HEAD, APPARATUS, MODULE AND PRODUCTION LINE FOR PIPE THREAD, AND PRODUCTS THEREOF

TECHNICAL FIELD

The present invention relates to a method, a rolling head, an apparatus, a module and a production line for rolling external pipe thread on a steel pipe or a hollow blank, especially a common steel pipe, and pre-formed thread products made from said method, rolling head, apparatus, module and production line belonging to the threading, especially the external pipe threading, mechanical field.

BACKGROUND

Compared with the external pipe thread by cutting, the external pipe thread by rolling has significant advantages of good quality, good sealing performance and high mechanical connection strength, and is valued by more and more people. However, outer diameter, wall thickness and other parameters of existing general steel pipe are formulated based on the cutting process requirements. For the rolling process, the outer diameter is too large and the steep pipe has a certain degree of non-roundness. The both constitute two biggest problems for rolling an external pipe thread. In the prior art, the problem of the large outer diameter can be solved by methods such as axial punching of a conical surface or a cylindrical surface or a radial rolling to reducing diameter, or using a medium-diameter pipe conforming to the rolling requirement. The method adopted at present for solving the irregularity of non-roundness problem is a kind of axially punched perfect conical surface disclosed in patent CN1251820C or a method of firstly cutting the perfect conical surface with the tool in the external pipe thread section of the steel pipe for processing pipe and then performing the conical external pipe thread rolling processing disclosed by the patent CN2582780Y.

Axially punching has the problems of complex apparatus and damage to the steel pipe, and firstly cutting the perfect conical surface with the tool in the external pipe thread section needs high processing precision, such as high concentricity of the workpiece and the tool, which can not be easily achieved in construction site for installing the pipe network, at the same time, the zinc layer on the surface of galvanized steel pipe was destroyed. As a result, the market needs new external pipe thread processing technology and pipe external pipe thread processing apparatus which has reasonable structural design and high applicability.

SUMMARY

The purpose of the present invention is to provide a method, a module and an apparatus for rolling external pipe thread and a production line thereof with high applicability. More specifically, the present invention provides a method, module, apparatus and rolling production line that can use conventional steel pipe having a standard outer diameter and non-roundness as a blank, without applying a preparatory process that need a die stamping or cutting a conical surface with a tool, and complete the preparation process by the pre-rolling of the present invention, and then form external pipe thread by rolling. In addition, the present invention also provides a product with pre-formed thread products made from said method, rolling head, apparatus, module and production line In one aspect, the present invention provides a method for rolling an external pipe thread, characterized in that it comprises a hollow blank rolled by a first rolling wheel group and a second rolling wheel group, wherein the first rolling wheel group comprises at least three circumferentially arranged the first rolling wheels, preferably comprising at least four circumferentially arranged the first rolling wheels, the second rolling wheel group comprises at least two circumferentially arranged the second rolling wheels, preferably comprising at least three circumferentially arranged the second rolling wheels, wherein the first rolling wheels are pre-formed rolling wheels with outer surface, and outer surface of the second rolling wheels have external pipe thread forming portion, and the method includes the following steps:

step 1: the first rolling wheel group rolls the outer surface of the hollow blank into a threaded cylindrical surface, a threaded conical surface, or a threaded cylindrical conical mixing surface;

step 2: the second rolling wheel group rolls the outer surface of the hollow blank processed in the step 1 again, so as to form the external pipe thread by rolling; wherein the number of the first rolling wheels in the first rolling wheel group and the number of the second rolling wheels in the second rolling wheel group is odd-even different;

the pitch of the pre-formed thread is equal to the pitch of thread on external pipe thread forming portion, and the depth of pre-formed thread is smaller than the depth of thread on external thread forming portion. Preferably, the number of the first rolling wheels in the first rolling wheel group is greater than the number of the second rolling wheels in the second rolling wheel group;

equally preferred, the tooth profile of the pre-formed thread does not exceed the tooth profile of the external pipe thread forming portion, and further, the pre-formed thread is a sinusoidal thread, which greatly prolongs the service life of the pre-formed rolling wheels.

More preferably, after the rolling in step 1, the surface roughness Ra of the thread on the outer surface of the hollow blank is less than 0.125, the surface hardness is increased by 20% to 100%, and the non-roundness is reduced by 10% to 50%; particularly preferably, the protective coating is intact.

When the method of the present invention is used for rolling external pipe thread, there is no need to perform any processing step (including not requiring external chamfering) prior to performing the rolling process of step 1, as that thread are formed entirely by rolling, the surface of the hollow blank, especially the surface zinc layer of the galvanized pipe, is protected and strengthen, thus the material is saved, the environment is protected. And the real non-cutting processing has been realized, and the operation method is the same as that of the current process of cutting the external pipe threads.

In a preferred embodiment of a rolling method for conical or cylindrical external pipe thread, the rolling process of the first rolling wheel group is an annular rolling, and the rolling process of the second rolling wheel group is a thread rolling.

In another preferred embodiment, the hollow blank has non-roundness greater than 100 um.

In another preferred embodiment, the rolling process of the first rolling wheel group and the second rolling wheel group is selected from one of the following combinations:

a, the rolling process of the first rolling wheel group and the second rolling wheel group is axial rolling;

b, the rolling process of the first rolling wheel group is radial rolling, and the rolling process of the second rolling wheel group is axial rolling;

c, the rolling process of the first rolling wheel group is axial radial hybrid rolling, and the rolling process of the second rolling wheel group is axial rolling.

In particular, when the rolling method is used to process external pipe threads on a hollow blank having a size of 2 inches or less, both the number of the first rolling wheels in the first rolling wheel group and the number of the second rolling wheels in the second rolling wheel group is no more than 15, preferably 3,4, 5, 6, 7, 8, or 9; or when used to process an external pipe thread on a hollow blank having a size between 2 and 4 inches, both the number of the first rolling wheels in the first rolling wheel group and the second rolling wheels in the second rolling wheel group does not exceed 19, preferably 4, 5, 6, 7, 8, 9, 10, or 11; or when used to process an external pipe thread on a hollow blank having a size of 4 inches or more, both the number of the first rolling wheels in the first rolling wheel group and the number of the second rolling wheels in the second rolling wheel group is no more than 35, preferably 4, 5, 6, 7, 8, 9, 10, 11, 12, 13, 14, 15, 16, 17, 18, 19 or 20.

In a preferred embodiment of the present invention, the number of the first rolling wheels in the first rolling wheel group is different from the number of the second rolling wheels in the second rolling wheel group by 1 to 11, more preferably 1, 3, 5 or 7.

In a general embodiment of the present invention, the number of the first rolling wheels in the first rolling wheel group is 4, and the number of the second rolling wheels in the second rolling wheel group is 5 or 7 or 9 or 11; or the number of the first rolling wheels in the first rolling wheel group is 5 and the number of the second rolling wheels in the second rolling wheel group is 6 or 8 or 10 or 12. In a particularly preferred embodiment of the present invention, the number of the first rolling wheels in the first rolling wheel group is 4 and the number of the second rolling wheels in the second rolling wheel group is 3; or the number of the first rolling wheels in the first rolling wheel group is 5 and the number of the second rolling wheels in the second rolling wheel group is 4; or the number of the first rolling wheels in the first rolling wheel group is band the number of the second rolling wheels in the second rolling wheel group is 5 or 3; or the number of the first rolling wheels in the first rolling wheel group is 7, and the number of the second rolling wheels in the second rolling wheel group is 6 or 4; or the number of the first rolling wheels in the first rolling wheel group is 8, and the number of the second rolling wheels in the second rolling wheel group is 7 or 5 or 3.

On the other hand, when processing the conical external pipe thread using the method for rolling external pipe thread of the present invention, preferably the first rolling wheel group rolls the outer surface of the portion of the hollow blank to be provided with thread into a conical surface, and the taper of the conical surface is 2°-12°, preferably 3°30"-8°30".

In a particularly preferred embodiment, processing the conical external pipe thread using the method for rolling external pipe thread of the present invention, the first rolling wheels has one or more of the following features:

a) it is a cylindrical or conical rolling wheel or cylindrical conical mixing wheel with a pre-formed thread;

b) the pitch of the pre-formed thread is equal to the pitch of thread on external pipe thread forming portion, and the depth of pre-formed thread is smaller than the depth of thread on external thread forming portion; preferably, the tooth profile of the pre-formed thread does not exceed the tooth profile of the external pipe thread forming portion, and more preferably, the pre-formed thread is a sinusoidal thread, c) there is a deflection angle of not more than 9 degrees in the vertical direction between the axis of the first rolling wheels and the axis of the hollow blank to be processed;

d) there is a free movement gap between the rolling wheel and the rolling wheel seat on which it is located.

More preferably, the first rolling wheels is a conical rolling wheel with a per-formed thread, and the axis thereof has a deflection angle of not more than 9 degrees in the vertical direction with respect to the axis of the hollow blank to be processed, preferably, the deflection angle is less than 3 degrees.

The rolling wheels in the rolling wheel group is an annular rolling wheel or a thread rolling wheel, preferably, the rolling process of the first rolling wheel group is the annular rolling wheel, and the rolling process of the second rolling wheel group is the thread rolling wheel. In this way, it can make full use of the convenience of the annular rolling wheel pair teeth and the two functions of a thread rolling wheel: straightening and external pipe thread forming.

Another aspect of the present invention provides a method for rolling an external pipe thread, characterized in which is to perform external pipe thread forming rolling on the outer surface of the pre-forming rolled hollow blank, wherein the pre-formed rolling refers to the process of rolling the outer surface of the hollow blank into a threaded cylindrical or threaded conical surface or a threaded cylindrical conical mixing surface by the first rolling wheel group, and the first rolling wheel group comprises at least 3 circumferentially arranged first rolling wheels with pre-formed thread, preferably, at least 4 circumferentially arranged first rolling wheels with pre-formed thread, and the external pipe thread forming rolling is performed by the second rolling wheel group including at least 2 circumferentially arranged second rolling wheels, preferably, comprises at least 3 circumferentially arranged second rolling wheels, which having an external pipe thread forming portion, and wherein number of the first rolling wheels in the first rolling wheel group and the number of the second rolling wheels in the second rolling wheel group is odd-even different, preferably, the number of the first rolling wheels in the first rolling wheel group is greater than the number of the second rolling wheels in the second rolling wheel group; in addition, the pitch of the pre-formed thread is equal to the pitch of thread on external pipe thread forming portion, and the depth of pre-formed thread is smaller than the depth of thread on external thread forming portion; preferably, the tooth profile of the pre-formed thread does not exceed the tooth profile of the external pipe thread forming portion, and more preferably, the pre-formed thread is a sinusoidal thread. Preferably, the first rolling wheels in the first rolling wheel group is an annular rolling, and the second rolling wheels in the second rolling wheel group is a thread rolling.

More preferably, the first rolling wheels is a conical rolling wheel with a per-formed thread, and the axis thereof has a deflection angle of not more than 9 degrees in the vertical direction with respect to the axis of the hollow blank to be processed, preferably, the deflection angle is less than 3 degrees; preferably the first rolling wheel group rolls the outer surface of the portion of the hollow blank to be provided with external pipe thread into a conical surface, and the taper of the conical surface is 2°-12°, preferably 3°30"-8°30".

Another aspect of the present invention provides a rolling head comprising at least 2 circumferentially arranged rolling wheels (81 or 82), a first rolling wheel disk (60A or 70A), a second rolling wheel disc (60B or 70B) and a connecting pin (602 or 702), wherein the number of rolling wheels, preferably, at least 3, and the further character is that the first rolling wheel disc and the second rolling wheel disc are provided with radial grooves (71) corresponding to each other, workpiece working holes (704) and pin holes (701), and the rolling wheel (81 or 82) cooperates with the radial grooves (71) on the first and second rolling wheel discs via its rolling wheel axle, and mounting surfaces of the radial grooves (71) for the rolling wheel (81 or 82) is an inclined plane or a plane (703); the first rolling wheel disc and the second rolling wheel disc are connected and fixed with each other through the connecting pin shafts (601 or 701) cooperating with the pin holes (602 or 702) to form a rolling head coaxially, and the rolling wheel shafts (83) respectively have inclined planes or planes (832*a*, 832*b*) parallel to each other at two ends respectively. The rolling wheel shafts (83) are mounted on the radial groove (71) of the rolling wheel disc through the inclined planes (832*a*, 832*b*), wherein the axis of the rolling wheel forms an included angle with the inclined plane or the plane (832*a*, 832*b*).

Preferably, the included angle is less than 9 degrees, more preferably less than 3 degrees.

When the rolling wheel is a thread rolling, the inclined plane is a plane, the angle is 0.

Preferably, the first rolling wheel group is a rolling wheel with a pre-formed thread, and the rolling wheel has a cutting blade integrally formed with the rolling wheel.

Preferably, the first rolling wheel group is a conical rolling wheel with a pre-formed thread, and the taper of the conical rolling wheel is 2°-12°, preferably 3°30"-8°30".

In particular, in order to obtain a better rolling effect, When the rolling head of the present invention is used as the pre-formed rolling head, the rolling wheel is an annular rolling wheel and has an external pipe thread forming portion, or the rolling head of the present invention is used as the external pipe thread rolling wheel, the rolling wheel is a thread rolling wheel. In both cases, the annular rolling wheel meets the following conditions: there is a deflection angle of not more than 9 degrees for the axis of the annular rolling wheel and the axis of the workpiece working hole in the vertical direction, and there is also an initial part of the thread on the surface of the rolling wheel, and the initial part of the thread refers to the thread that in the thread rolling process firstly contacts with the hollow blank and meets the following conditions:

A total of N annular rolling wheels are arranged in the second rolling head. Starting from one of the annular rolling wheels Ri, the initial part of the next rolling wheel Ri+1 along the same clockwise direction is the thread obtained based on the initial partial thread of the rolling wheel Ri and extending a distance of 1/N pitch according to the original thread form and pitch in the direction of the rolling wheel Ri axis.

Particularly preferably, when the rolling head of the present invention is used as the external pipe thread rolling wheel, the rolling wheel is a thread rolling wheel, which has an external pipe thread forming portion. At this time, the axis line of the rolling wheel forms an included angle of 0 degrees with the planes (832*a*, 832*b*).

In another preferred embodiment of the rolling head, the rolling head further comprises a first adjusting disc (76A), a second adjusting disc (76B) and an adjusting disc pin shaft (763), and the first adjusting disc and the second adjusting disc are provided with positioning and installing blind holes (766), arc-shaped grooves (762), workpiece working holes (764) and pin holes (761) corresponding to each other; the first adjusting disc and the second adjusting discs are respectively and coaxially mounted on the outer sides of the first rolling wheel disc and the second rolling wheel disc through the positioning and installing blind holes (766), and are mutually connected by the adjusting disc pin shaft (763); both ends of the rolling wheel axle (83) also has an extension (833) on the outside of the inclined plane or the plane, the extension of the rolling wheel axle (833) being mounted in the arc-shaped grooves (762) in the adjusting disc, turning the adjusting disc can drive the rolling wheel shaft (83) to slide in the arc-shaped grooves (762) so as to drive the rolling wheel shaft (83) to move radially in the radial groove (71) of the rolling wheel disc (70), and the rolling wheel is a thread rolling wheel, the inclined plane is a plane.

More preferably, the rolling head further comprises a sliding piece, and the extension of the rolling wheel shaft cooperates with a shaft hole of the sliding piece and is installed in the arc-shaped slot (762) of the adjusting disk through the sliding piece 836; rotating the adjusting disc (76) can drive the sliding piece to slide in the arc-shaped groove (762) to drive the rolling wheel shaft (83) to move radially in the radial groove (71) of the rolling wheel disc (70); or equivalently more preferably, the rolling head further comprises a control adjusting rod (122) installed at the end of the rolling head on the side where rolling is completed; during the rolling process, when the hollow blank contacts the control adjusting rod (122), the control adjusting rod (122) can drive the photoelectric sensing device to work and control the rotation of the first adjusting disc and the second adjusting disc to control start and stop of the rolling process.

Or equivalently more preferably, the rolling head further comprises a control adjusting lever (121) mounted on the top or the bottom of the rolling head on the side where rolling is completed. During rolling, when the hollow blank contacts the control adjusting lever (121), the control adjusting lever (121) can drive the photoelectric sensing device to work and control the rotation of the first adjusting disc and the second adjusting disc to control the start and stop of the rolling process.

Or equivalently more preferably, relative rotational position angle detecting means (123) is provided between the first rolling wheel disc and the first adjusting disc or between the second rolling wheel disc and the second adjusting disc.

The present invention also provides an external pipe thread rolling apparatus, which comprises at least one of the above-mentioned rolling heads, show as FIGS. 21, 22, 24, 26 and FIG. 32.

The present invention further provides a module for rolling an external pipe thread, characterized in that it comprises a first rolling head and a second rolling head, wherein the first rolling head comprises at least three circumferentially arranged first rolling wheels, preferably, comprises at least four circumferentially arranged first rolling wheels, the first rolling wheel is a rolling wheel with a pre-formed thread; and the second rolling head comprises at least two circumferentially arranged second rolling wheels, preferably, comprises at least three circumferentially arranged second rolling wheels having an external pipe thread forming portion; and number of the first rolling wheels in the first rolling wheel group and the number of the second rolling wheels in the second rolling wheel group is odd-even different, preferably, the number of the first rolling wheels in the first rolling wheel group is greater than the number of the second rolling wheels in the second rolling wheel group;

and the pitch of the pre-formed thread is equal to the pitch of thread on external pipe thread forming portion, the depth of pre-formed thread is smaller than the depth of thread on external thread forming portion.

Preferably, the tooth profile of the pre-formed thread does not exceed the tooth profile of the external pipe thread forming portion, and further, the pre-formed thread is a sinusoidal thread, and more preferably, the pre-formed thread is a sinusoidal thread.

Preferably, the first rolling wheels in the first rolling wheel group is an annular rolling, and the second rolling wheels in the second rolling wheel group is a thread rolling.

Preferably, the first rolling wheel is a conical rolling wheel with a pre-formed thread, and the taper of the conical rolling wheel is 2°-12°, preferably 3°30"-8°30"; The present invention also provides a module for rolling an external pipe thread, comprising a first rolling head and a second rolling head which are combined into one body and the first rolling head and the second rolling head are arranged coaxially with the hollow blank to be processed, wherein the first rolling head is arranged on the side close to the start of the external pipe thread processed; more preferably, the first rolling head comprises a corresponding first rolling wheel disc (70A), a second rolling wheel disc (70B) and a connecting pin (763). The first rolling wheel disc (70A) and the second rolling wheel disc (70B) are provided with radial grooves (71), workpiece processing holes (704) and pin holes (701) corresponding to each other. The rolling wheel (81 or 82) cooperates with the radial grooves (71) on the first rolling wheel disc (70A) and the second rolling wheel disc (70B) via the rolling wheel shaft (83), and mounting surface of the radial groove (71) and the rolling wheel (81 or 82) is an inclined plane or a plane (703). The first rolling wheel disc (70A) and the second rolling wheel disc (70B) are fixedly connected to each other by a connecting pin shaft (763) matched with the pin hole (701), coaxially formed as the rolling head, and two ends of the rolling wheel shaft (83) is provided with inclined planes or planes (832*a*, 832*b*) parallel to each other and the rolling wheel axle (83) is mounted on a radial groove (71) of the rolling wheel disc through the inclined planes or planes (832*a*, 832*b*). The axis X of the rolling wheel forms an included angle with the inclined planes (832*a*, 832*b*), and the included angle is less than 9 degrees, preferably less than 3 degrees, when the rolling wheel is a thread rolling, the inclined plane is a plane, the angle is 0.

and the first rolling head further comprises a control adjusting rod. The control adjusting rod is installed on the top or the tail of the rolling head on the side where the rolling is finished.

And the second rolling head also comprises a corresponding first rolling wheel disk, a second rolling wheel disk and a connecting pin. The first rolling wheel disk and the second rolling wheel disk are provided with radial grooves, workpiece processing holes, and pin holes corresponding to each other. The rolling wheel cooperates with the radial grooves on the first rolling wheel disc and the second rolling wheel disc via its rolling wheel shaft. The first rolling wheel disc and the second rolling wheel disc are fixedly connected to each other by a connecting pin shaft matched with the pin hole, coaxially formed as the rolling head. The second rolling head further comprises a control adjusting rod. The control adjusting rod is installed on the top or the tail of the second rolling head on the side where the rolling is finished.

The first roller head and the second roller head are coaxially arranged together by a pin.

Particularly preferably, the first rolling head further comprises a corresponding first adjusting disc, a second adjusting disc and an adjusting disc pin. The first adjusting disc and the second adjusting disc are provided with positioning and installing blind holes, arc-shaped grooves, workpiece processing holes and pin holes corresponding to each other. The first adjusting disc and the second adjusting disc are respectively and coaxially mounted on the outer sides of the first rolling wheel disc and the second rolling wheel disc through the positioning and installing blind holes and are mutually connected by the adjusting disc pin. Both ends of the rolling wheel shaft further have an extension on the outer side of the inclined plane or the plane, and the extension part of the rolling wheel shaft is installed in the arc-shaped groove of the adjusting disc. Rotating the adjusting disc can drive the rolling wheel shaft to slide in the arc-shaped groove so as to drive the rolling wheel shaft to move radially in the radial groove of the rolling wheel disc; when the rolling wheel is a thread rolling wheel, the inclined plane is a plane.

And the second rolling head further comprises a corresponding first adjusting disc, a second adjusting disc and an adjusting disc pin. The first adjusting disc and the second adjusting disc are provided with positioning and installing blind holes, arc-shaped grooves, workpiece processing holes and pin holes corresponding to each other. The first adjusting disc and the second adjusting disc are respectively and coaxially mounted on the outer sides of the first rolling wheel disc and the second rolling wheel disc through the positioning and installing blind holes and are mutually connected by the adjusting disc pin. Both ends of the rolling wheel shaft further have an extension on the outer side of the inclined plane, and the extension part of the rolling wheel shaft is installed in the arc-shaped groove of the adjusting disc. Rotating the adjusting disc can drive the rolling wheel shaft to slide in the arc-shaped groove so as to drive the rolling wheel shaft to move radially in the radial groove of the rolling wheel disc.

In another module for rolling external pipe thread according to another embodiment of the present invention, it is further characterized by the module for rolling external pipe thread further comprises a first rolling head seat, a second rolling head seat, a transmission device and a power motor. The first rolling head seat is fixedly mounted with the first rolling head, and the second rolling head seat is fixedly mounted with the second rolling head. An input main shaft of the transmission device is mechanically matched with the output main shaft of the power motor, and the output shaft of the transmission device forms a mechanical cooperation with the first rolling head seat and the second rolling head seat. The power motor may drive the first rolling wheel seat and the second rolling wheel seat to rotate through the transmission device, so as to rotate the first rolling wheel head and the second rolling wheel head. Preferably, the mechanical cooperation between the output shaft of the transmission device and the first rolling head seat and the second rolling head seat is a cooperation of a worm and a worm gear. One end of the worm is mechanically matched with the output shaft of the transmission device, and the other end of the worm is matched with a first worm gear and a second worm gear, and the centers of the first worm gear and the second worm gear are respectively provided with the first rolling head seat and the second rolling head seat. More preferably, it further comprises at least one third worm gear and a processing tool head seat mounted on the third worm gear. The processing tool head seat is matched with one of a taper cutting tool, a correction tool for the inner hole of blank, an end surface processing tool and a thread surface processing tool through cooperation of key and groove.

In the another module for rolling external pipe thread as described above, preferably, the end of any one or more of the first rolling head or the second rolling head is provided with a photo sensing device for controlling the operation of the power motor.

The present invention also provides an apparatus for rolling external pipe thread, which comprises at least one of the above-mentioned rolling modules, and also includes the base, power motors, clamping device, a power motor control device and a transmission device, the base is provided with the power motor, a power motor control device, the clamping device and the rolling module, the power motor is connected with the clamping device through the transmission device, and under the control of the power motor control device, the power motor promotes the rotation of the hollow blank clamped by the clamping device through the transmission device, thereby generating relative rolling rotational motion with the rolling module.

In another embodiment of an external pipe thread rolling apparatus according to the present invention, the an external pipe thread rolling apparatus comprises at least one of the rolling modules mentioned above, it also includes a base, power motors, clamping device, a power motor control device and a transmission device, the base is provided with the power motor, a power motor control device the clamping device and the rolling module, the power motor is connected with the rolling module through the transmission device; under the control of the power motor control device, the power motor promotes the rotation of the first rolling wheel and or the second rolling wheel in the rolling module through the transmission device, thereby generating relative rolling rotational motion with the hollow blank clamped by the clamping device.

Further, the clamping device may include a power device, a first clamping die seat, a first clamping die, a second clamping die, and a clamping frame; the power device is cooperatively connected with the first clamping die seat; the first clamping die is installed and fixed on the first clamping die seat; the power device, the first clamping die seat and the first clamping die are installed on one side of the clamping frame; the second clamping die is installed on the other side of the clamping frame; and the first clamping die and the second clamping die are respectively provided with a first semi-cylindrical inner cavity and a second semi-cylindrical inner cavity at opposite positions, preferably, the inner surfaces of the first and second semi-cylindrical lumens each have at least two convex circular arcuate bodies, and the arc of the circular arcuate bodies substantially coincides with the arc of the pre-clamped hollow blank; under the action of the power device, the first clamping die seat can drive the first clamping die to move and make it close to the second clamping die, thereby clamping the hollow blank.

The invention further provides a hollow blank clamping device, which comprises a power device, a first clamping die seat, a first clamping die, a second clamping die and a clamping frame. The power device is cooperatively connected with the first clamping die seat; the first clamping die is installed and fixed on the first clamping die seat; the power device, the first clamping die seat and the first clamping die are installed on one side of the clamping frame; the second clamping die is installed on the other side of the clamping frame; and the first clamping die and the second clamping die are respectively provided with a first semi-cylindrical inner cavity and a second semi-cylindrical inner cavity at opposite positions, preferably, the inner surfaces of the first and second semi-cylindrical lumens each have at least two convex circular arcuate bodies, and the arc of the circular arcuate bodies substantially coincides with the arc of the hollow blank to be clamped; under the action of the power device, the first clamping die seat can drive the first clamping die to move and make it close to the second clamping die, thereby clamping the hollow blank.

Preferably, the second clamping die is fixedly engaged with the clamping frame or is provided with a moving engagement with the first clamping die to form a radial movement of the second clamping die and the first clamping die.

Further, the power device is a hydraulic device, and the first clamping die and the second clamping die are molding materials.

The present invention also provides a production line for pipe external thread which comprises at least one of the above-mentioned rolling modules, the first rolling head and the second rolling head are respectively mounted on independent rolling devices thereof. The first rolling head and the second rolling head are used to roll the hollow blank sequentially.

Japanese Patent JP6039470 discloses a rolling pre-preparation process which rolls a double conical surface on a hollow cylindrical blank and at the same time cut the workpiece. Chinese patent CN102423789A discloses a rolling pre-preparation process of a radial rolling diameter reduction. However, the problems to be solved by the above two patents are merely the formation of the conical surface of the hollow blank or the diameter reduction of the hollow blank, which does not solve the problem of non-roundness, which is crucial for the subsequent rolling.

According to a large number of failure experiences, and based on this analysis and research, it was found that due to the outer diameter of the pipe, out of roundness, wall thickness and uniformity, material, weld quality and residual stress of steel and other effects, in practice, radial rolling (double) conical surface or reducing diameter after radial rolling, its non-roundness will be increased by 30% to 100%, especially for the steel pipe having a non-roundness conforming with the non-circular national standards but more than 100 um is more. When the pipe external thread rolling continues, its non-roundness will further increase, it always leads to the failure of external pipe thread rolling. So it is difficult to directly roll out the pipe external thread on the existing general steel pipe (especially a seam welded pipe), in particular it is difficult to roll out the conical external pipe thread, especially for welded pipes and thin-walled pipes.

After more than 10 years of experiment and summary, analysis and research. The present invention discloses the successive causalities between the port outer diameter, the taper and the length of the hollow blank formed by pre-rolling, and the depth of thread, the thread profile as well as the subsequent thread profile, the length precision and the depth of thread of the pre-formed thread, which explained the dialectical relationship of the cause and the effect between these two processes, and creatively adopts the concept of pre-formed thread, it provides that the pitch of the pre-formed thread is equal to the pitch of thread on external pipe thread forming portion, preferably, the tooth profile of the pre-formed thread does not exceed the tooth profile of the external pipe thread forming portion, and more preferably, the pre-formed thread is a sinusoidal thread, and the relationship between the profile of the pre-formed thread and the life of the rolling wheel. Combined with the unique idea that the number of the rolling wheels in the two rolling processes is odd-even different, especial preferably, the unique idea that the number of pre-forming rolling wheels is greater than the number of pipe thread rolling wheels.

On one hand, by using the difference in the depth of thread and the profile of pre-formed thread and external pipe thread purposefully before and after rolling, which in order to controlling the depth of thread and the profile of the pre-formed thread, and when the rolling wheel to contact the hollow blank gradually during the process of pre-forming rolling, some residual stress of hollow blank is also released gradually and the original residual curvature of hollow blank is reduced gradually making the section of the rolling part of the hollow blank is formed by rolling from the original random polygons into the controllable, regular and elliptical cylindrical or conical or cylindrical conical mixing, the regular hollow blank conforms to the subsequent thread rolling requirements. It is found that the roundness of the original blank is reduced by 10%~35% in the pre-rolling process; on the other hand, creatively using the innovative technical solution that the number of pipe thread forming rolling wheel and the number of pre-forming rolling wheel matches with each other in odd-even, which releasing the residual stress of hollow blank gradually and further reducing the original residual curvature of hollow blank, during the rolling process of external pipe thread; finally, by using the two major functions of thread rolling wheel: straightening and external pipe thread forming, making the elliptical, cylindrical conical or cylindrical conical mixing conforms the standard of external pipe thread, to solve the technical bottlenecks that in the pipe thread rolling, especially welded pipe and thin-walled pipe, in initial rolling, it is easy to increase the degree of non-roundness and deformation and resulting in external pipe thread rolling failure, and greatly relax the hollow blank rough applicability. It is not only applied to the existing hollow blank with seams and seamless, thick and thin walled, but also to a variety of relatively soft wall thickness of copper or aluminum alloy pipes and other types of metal hollow blank. Through the scientific calculation of the outer diameter tolerance, the yield strength, the elastic modulus and the elastic-plastic deformation force of the external thread of the hollow blank, the radial position and taper of the pre-forming rolling wheel, rolling number and time, the number of rolling wheel and the length of the spiral line, the residual stress of the blank and the elastic deformation and the required rolling pressure, are reasonably controlled, together with the idea that the same pitch and the different teeth height in thread before and after rolling, and combined with the matching of number and form of external pipe thread forming rolling wheel, and rolling mode, so as to simplify the rolling apparatus, and the final rolling external pipe thread products has more than 99% pass rate, greatly enhancing the practicality of rolling pipe thread technology.

The invention has the beneficial effects of relaxing the requirement of non-roundness of the ordinary steel pipe (hollow cylindrical blank) accounting for 95% of the market by the rolling pipe external thread process, omitting the process in stamping cone and the process in external chamfer cutting, so that the material is saved, and it also protected and strengthened the protective layer on the surface of the blank, simplifying the rolling apparatus, and not only realizing the advantages of being compatible with the current pipe external thread processing threading machine used 100% the same processing steps, but also realizing the stable and the real non-cutting rolling processing. At the same time, compared with the existing rolling pipe thread products, the process is more environmentally friendly, and the product stress distribution is more reasonable and better quality. The foregoing objects, technical solutions and beneficial effects of the present invention will be described in detail below with reference to the accompanying drawings and specific embodiments.

DESCRIPTION OF FIGURES

FIG. 1*a* is a process diagram showing stamping perfect conical surface based on the existing rolling external pipe thread technology.

FIG. 1*b* is a process diagram showing based on the existing rolling pipe thread technology to cut the perfect conical surface.

FIG. 1*c* is a process diagram showing the process of axial rolling external pipe thread after stamping or cutting the conical surface in FIGS. 1*a* and 1*b*.

FIG. 2*a* is a schematic view of the pre-formed rolling process for pre-forming the threaded cylindrical surface.

FIG. 2*b* is a schematic view of the pre-formed rolling process for pre-forming the threaded conical surface.

FIG. 3*a* is a schematic view of the pre-formed rolling process for pre-forming the threaded cylindrical surface.

FIG. 3*b* is a schematic view of the pre-formed rolling process for pre-forming the threaded conical surface.

FIG. 3*c* is a schematic view of the pre-formed rolling process for pre-forming the threaded cylindrical and conical mixing surface.

FIG. 4*a* is a schematic view of a pre-forming rolling process for rolling a threaded cylindrical surface.

FIG. 4*b* is a schematic view of a pre-forming rolling process for rolling and forming a threaded conical surface.

FIG. 4*c* is a schematic view of a pre-forming rolling process for rolling and forming a threaded cylindrical conical mixing surface.

FIG. 5*a* is a schematic view of the process for preparing to form a standard pipe thread on the hollow blank being rolled a threaded cylindrical surface after the pre-formed rolling.

FIG. 5*b* is a schematic view of the process for preparing to roll to form a standard pipe thread on the hollow blank being rolled a threaded conical surface after the pre-formed rolling.

FIG. 5*c* is a schematic view of a process for preparing to roll to form a standard pipe thread on the hollow blank being rolled a threaded cylindrical conical mixing surface after the pre-formed rolling.

FIG. 5*d* is a schematic view, which shows performing the rolling pipe thread on the hollow blank in FIGS. 5*a*, 5*b* and 5*c*.

FIG. 6*a* is a schematic view of the distribution of the five rolling wheels of the pre-forming rolling head.

FIG. 6*b* is a schematic structural view of a rolling head with a rolling wheel disc only which is mounted with a pre-formed thread of the pre-forming rolling wheel.

FIG. 7*a* is a structure view of the conical pre-forming rolling wheel according to the present invention.

FIG. 7*b* is a schematic structure view of an integral cylindrical pre-formed rolling wheel according to the present invention.

FIG. 7*c* is a structural schematic view of a pre-forming rolling wheel and a cutting blade separately formed according to the present invention.

FIG. 7*d* is a schematic structural view of a pre-forming rolling wheel and a cutting blade formed with one body according to the present invention.

FIG. 8*a* is a schematic view of the distribution of the four rolling wheels of the rolling head for performing pipe thread.

FIG. 8*b* is a schematic structural view of a rolling head mounted with a rolling wheel for performing pipe thread and with an adjusting disc and a rolling wheel disc according to one embodiment.

FIG. 11*a* is a front view of the rolling wheel disc.

FIG. 11*b* is a side view of the FIG. 11*a*.

FIG. 12*a* is a front view of the rolling wheel shaft.

FIG. 12*b* is a top view of the FIG. 12*a*.

FIG. 12*c* is a side view of the FIG. 12*a*.

FIG. 12*d* is a schematic view of FIG. 12*a*, which shows that the rolling wheel shaft and axis of the hollow cylindrical blank is provided to form an angle δ in the vertical direction.

FIG. 12*e* is a front view of another rolling wheel shaft.

FIG. 12*f* is a top view of the FIG. 12*e*.

FIG. 12*g* is a side view of the FIG. 12*e*.

FIG. 12*h* is a schematic view of FIG. 12*e*, which shows that the rolling wheel shaft and axis of the hollow cylindrical blank is provided to form an angle δ in the vertical direction.

FIG. 14*a* is a front view of the rolling wheel.

FIG. 14*b* is a side view of the FIG. 14*a*.

FIG. 15*a* is a front view of the adjusting disc.

FIG. 15*b* is a side view of FIG. 15*a*.

FIG. 16*a* is a front view of the rolling wheel shaft.

FIG. 16*b* is a top view of the FIG. 16*a*.

FIG. 16*c* is a side view of the FIG. 16*a*.

FIG. 16*d* is a schematic view of FIG. 16*e*, which shows that the rolling wheel shaft and axis of the hollow cylindrical blank is provided to form an angle δ in the vertical direction.

FIG. 17*a* is a schematic view of the rolling wheel structure and its cooperation with the needle bearing of the present invention.

FIG. 17*b* is a schematic view showing cooperation of the rolling wheel, the needle bearing and the rolling wheel shaft according to the present invention.

FIG. 17*c* is a cross-sectional view of a rolling wheel seat (slider) mated to a rolling wheel shaft.

FIG. 23*a* is a front view of the rolling processing module.

FIG. 23*b* is a top view of the FIG. 23*a*.

FIG. 25*a* is a front view of the rolling processing module.

FIG. 25*b* is a top view of the rolling processing module.

FIG. 26*a* is a front view of the rolling apparatus.

FIG. 26*b* is a top view of the FIG. 26*a*.

FIG. 27*a* is a front view of the rolling processing module.

FIG. 27*b* is a top view of FIG. 27*a*.

FIG. 30*a* is a front view of the rolling processing module.

FIG. 30*b* is a top view of the FIG. 30*a*.

FIG. 32*a* is a front view of the rolling processing module according to the present invention.

FIG. 32*b* is a top view of FIG. 32*a*.

FIG. 33*a* is a schematic structure view, which shows the structure schematic diagram of the rotated rolling head through the worm gear to transmitting the rotating power in accordance with the present invention.

FIG. 33*b* is a schematic structure view of FIG. 33*a* with the worm in further.

FIG. 33*c* is a schematic structure view of FIG. 33*b* with the adjusting disc in further.

FIG. 35*a* is a cylindrical pre-formed pipe thread product.

FIG. 35*b* is a conical pre-formed pipe thread product.

FIG. 35*c* is a cylindrical and conical mixing pre-formed pipe thread product.

Figure 1:
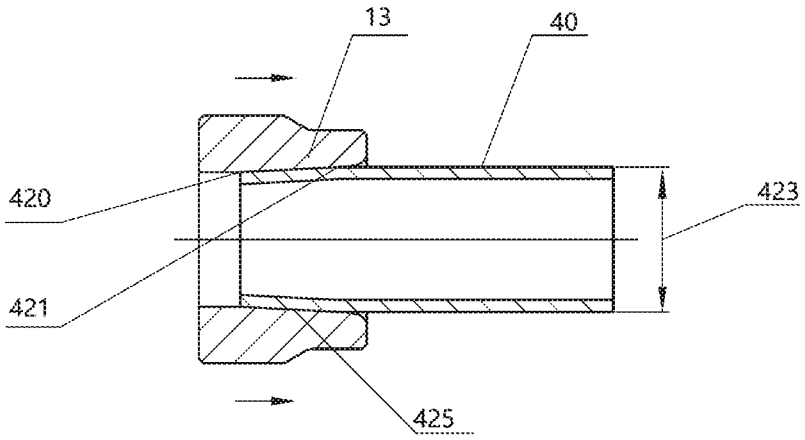
FIG. 1 shows a prior art for rolling external pipe thread.
Figure 1:
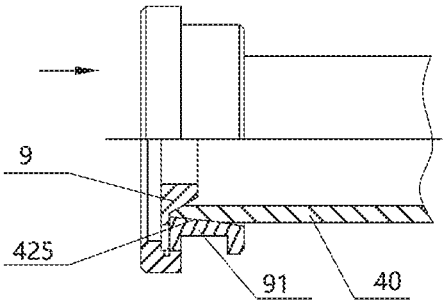
Figure 1:
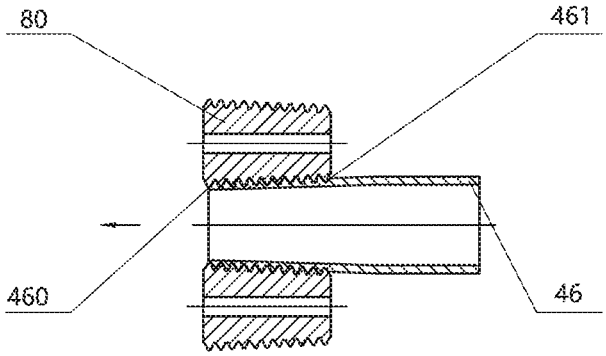

List of reference numbers: 1 Seat and seat frame; 2 Power motor and transmission device, 20 Power motor control device, 21 Transmission device, 22 Power motor, 23 Hollow spindle; 3 Clamping device, 31 Clamping frame, 32 Second clamping die, 33 First clamping die, 34 First clamping die seat, 35 Power motors, 36 First semi-cylindrical inner cavity, 36B Second semi-cylindrical inner cavity, 361 Convex circular arcuate bodies;

4 Hollow blank and pipe thread products, 40 Original hollow blank, 400 Processing starting end, 401 Processing end, 403 Original hollow cylindrical outer diameter, 42 Hollow blank after pre-preparation process, 420 Processing start end, 421 Processing ending end, 423 Cylindrical blank outer diameter, 424 Cylindrical surface of the cylindrical blank, 425 Conical surface of the cylindrical blank, 46 Pipe thread product using rolling technology, 460 Threaded head, 461 Threaded tail, 48 Pipe thread product of the present invention, 480 Thread head, 481 Thread tail; 5 Rolling cutting device, 51 Rolling blade, 6 First pre-forming rolling head, 60 Rolling head, 60 Pre-forming rolling head, 60A A first (front) pre-forming rolling wheel disc or upper rolling head seat, 60A1 Upper rolling head seat pushrod, 60A2 Upper rolling head seat disc, 60B Second (rear) pre-forming rolling wheel disc or Upper rolling head seat, 60B2 Rolling down rolling wheel seat disc, 601 Pin hole, 602 pin, 604 Workpiece work hole, 611 Guiding column, 631 Worm, 6311 Pre-forming rolling head worm, 6312 Rolling head worm for pipe thread, 636 Worm gear, 65 Controlling rod, 66 Pre-forming adjusting disc, 66A First (front) pre-forming adjusting disc, 66B Second (rear) pre-forming adjusting disc, 661 pin, 67 key pin, 68 Rolling head frame, 69 Torque amplification gear group, 691 Rotary handle, 696 Screw nut, 7 Rolling head for forming pipe thread, 7A First rolling head group, 7B Second rolling head group, 70 Rolling wheel disc for forming pipe thread, 70A First (external pipe thread) rolling wheel disc, 70B Second (external pipe thread) rolling wheel disk, 701 Pin hole, 702 Pin, 703 Inclined plane, 704 Working hole, 71 Rolling wheel radial groove, 731 Worm, 736 Worm gear, 75 Rolling head seat, 76 External pipe thread adjusting disc, 76A First (front) adjusting disc, 76B Rear adjusting disc, 761 Pin hole, 762 Arc-shaped slot, 763 Pin, 764 Working hole, 766 Mounting blind hole, 77 Key pin; 8 Rolling wheel, 80 Rolling wheel in existing rolling pipe thread technology, 81 Pre-forming rolling wheel of the present invention, 82 Rolling wheel for forming pipe thread of the present invention, 821 First rolling wheel thread starting portion of four annular rolling wheel, 822 Second rolling wheel thread starting portion of four annular rolling wheels, 823 Third rolling wheel thread starting portion of four annular rolling wheels, 824 Fourth rolling annular rolling wheel thread starting portion of four annular rolling wheels, 83 Rolling wheel axis of the present invention, 831 Needle bearing of the rolling wheel shaft, 832 Inclined plane on end of rolling wheel shaft, 832*a* Narrow inclined plane on end of rolling wheel shaft, 832*b* Large inclined plane on end of rolling wheel shaft, 833 Cylindrical end on end of rolling wheel shaft, 836 Sliding piece on end of rolling wheel shaft, 86 Rolling wheel seat of the present invention, 891 Axial clearance, 892 Radial clearance;

δ Deflection angle of rolling wheel shaft and work piece in vertical direction,

X Center line of shaft axis,

X' Center line of hollow blanket;

9 Chamfering device (or processing tool of end surface), 91 Cutting blade, 936 Worm gear, 95 Rolling head seat;

10 Sliding seat, 101 Crank of sliding seat, 102 Main sliding seat (right and left sliding seat), 103 Sub-sliding seat (front and rear sliding seat);

11 (Two) axial guiding posts or plane guiding rails, 111 Horizontal left and right plan guiding rails, 112 Horizontal front and rear plan guiding rails;

12 Photoelectric sensing devices, 121 (Photoelectric sensing) control adjusting contacting rod 1, 122 (Photoelectric sensing) control adjusting contacting rod 2, 13 Taper punching die, 14 Inner bore working tool, 1436 Worm gear, 145 Inner bore working tool seat h Depth of thread, P Thread pitch.

DETAILED DESCRIPTION OF EMBODIMENTS

The following is the detailed description of the invention in combination of preferred embodiments. It should be noted that despite of the fact that all terms used are selected from those known to the public according to description thereafter, some terms are selected by the applicant at its discretion, of which implications are to be interpreted according to the principle as revealed by the invention. Orientation terms such as "upper", "lower", "left" and "right" as used herein is only for description other than limitation on orientation of various devices and parts used.

Term Description

Term "odd-even different" refers to in any two rolling wheel groups that are connected one after another in the processing order, when the number of rolling wheels contained in one rolling wheel group is an odd number, the number of rolling wheels contained in the other rolling wheel group is an even number Non-roundness: there is a phenomenon that the outer diameters are not equal in the cross-section of the circular steel pipe, that is, the maximum outer diameter and the minimum outer diameter which are not mutually perpendicular to each other, that is, the absolute value of the difference between the maximum outer diameter and the minimum outer diameter is not-roundness. Due to the presence of non-roundness, the steel pipe (hollow blank) is of actually an irregular polygon.

The term "inclined plane" refers to a plane that has an included angle (spiral rising angle) with the reference horizontal plane from the axis of the rolling wheel.

The two lines (assumed to be a-line and b-line) of the present invention have angles in the "vertical direction". It can be understood that in the XYZ three-dimensional coordinate system, the plane parallel to the a-line and the b-line is defined as XY plane, then the angle between the two lines (the a-line and the —line) formed when the a-line and the b-line are projected along the Z axis in the XY plane is the angle at which the a-line and the b-line exist in the "vertical direction". For example, the axis of the rolling wheel and the axis of the hollow workpiece to be machined have a deflection angle of not more than 9 degrees in the vertical direction. It can be understood that in the XYZ three-dimensional coordinate system, the plane parallel to the axis of the rolling wheel and the axis of the hollow blank to be processed is defined as the XY plane. The angle formed by the two lines of the axis of the rolling wheel and the axis of the hollow blank to be processed being projected along the Z axis on the XY plane is not greater than 9 degrees in the XYZ three-dimensional coordinate system.

Thread length accuracy: make the standard ring gauge and pipe threads to be tested tightly engaged, and examine the parallelism of the thread port and the first, second or third step plane of the ring gauge, wherein being parallel with the second step it is standard thread length accuracy, parallel with the first step it is upper limit of the standard thread length accuracy, and parallel with the third step it is the lower limit of the standard thread length accuracy.

Hollow blanks according to the present invention are hollow blanks that can be cold formed, including not only metal pipes such as steel pipes, aluminum pipes and copper pipes, but also metal workpieces having a hollow tubular portion structure such as the pipe joint, tee, and it is also possible to include other plastic pipes or workpieces of similar shape that can be cold formed.

The external pipe thread according to the present invention refers to an existing national standard or an international standard or an enterprise standard or an external pipe thread with practical use function. The pre-formed pipe thread of the present invention refers to whose thread pitch same as that of the external pipe thread to be processed, and its depth of thread smaller than that of the external pipe thread. The external pipe thread forming portion refers to the section whose threads are corresponding to the external pipe thread to be processed, and the shape, pitch, depth of thread and tooth profile of the thread are all consistent with the external pipe thread to be processed, and the external pipe thread can be formed on the blank by the rolling wheel having the external pipe thread forming portion, as will be easily understood by the prior art person.

The pre-formed rolling according to the present invention refers to the process of rolling a cylindrical surface or conical surface or a cylindrical conical mixing surface with a pipe thread which is rolled on the hollow blank by the rolling wheel with pre-formed pipe thread on its surface, whether an annular rolling wheel or a thread rolling wheel. It should be noted that the cylindrical surface with pipe threads or the conical surface with pipe threads or the cylindrical conical mixing surface with pipe threads are not surfaces in the strict sense, but a surface with special pipe 20% cylindrical surface or a conical surface or a cylindrical conical mixing surface, and the shape of the surface threads matches the pipe threads on the pre-formed rolling wheel; only when the depth of thread of the pre-formed thread is zero, the cylindrical surface having a pipe thread or a conical surface having a pipe thread or a cylindrical conical mixing surface having a pipe thread is a smooth surface. In particular, the pre-formed pipe thread is a rolled non-standard pipe thread, its profile should not only be based on the external thread profile of the subsequent pipe, but also according to the wall thickness, caliber, material, non-roundness and service life of the rolling wheel of the hollow blank, it is different from the traditional pipe thread used for transmission or sealing or fastening purposes, and it is not designed to solve the problems of sticking, slipping, leaking or tensile failure. It is different from common pipe thread, metric pipe thread, pipe thread 55°, pipe thread 60°, API pipe thread and improved pipe thread based on API pipe thread in current standard, but it is a kind of thread similar to ball screw slideway, and is only a kind of non-standard rolling pipe thread designed for subsequent external pipe thread rolling products without deformation.

The depth of thread of the outer surface thread of the pre-formed pipe thread is smaller than the depth of thread of the external pipe thread forming portion, further, the tooth profile of the pre-formed thread does not exceed the tooth profile of the external pipe thread forming portion, and further, the pre-formed thread is a sinusoidal thread.

The pipe threads or threads pre-formed by the present invention, the surface roughness Ra of the thread on the outer surface is less than 0.125, the surface hardness is increased by 20% to 100%, and the non-roundness is reduced by 10% to 50%; particularly for the galvanized pipe, the surface zinc layer is intact after pre-formed rolling.

The "cylindrical conical mixing surface" according to the present invention refers to the outer surface of the hollow blank comprising both the cylindrical surface and the conical surface, or it can be understood as the outer surface composed of one or more cylindrical surfaces and one or more conical surfaces.

The external pipe thread rolling of the present invention refers to the process of rolling out the cylindrical or conical or cylindrical conical mixing surface on the hollow blank by the rolling wheel.

In the present invention, for the convenience of description in some cases, the rolling process by the "first rolling wheel group" or the "first rolling head" is also referred to as "pre-forming rolling" or the "first rolling wheel group" is referred to as a "pre-forming rolling wheel group" and a "first rolling head" is referred to as a "pre-forming rolling head", and the rolling process by the "second rolling wheel group" or "second rolling head" is referred to as "pipe thread forming rolling", or "second rolling wheel group" is referred to as "pipe thread forming rolling wheel group" and "second rolling head" is referred to as "pipe thread forming rolling head". However, this description is not intended to limit the function of the "first rolling wheel group" or the "first rolling head" to merely correcting or pre-forming, and does not mean that only "second rolling wheel group" or "second rolling head" can achieve or obtain the technical effects described in the present invention.

The structure of the pre-forming rolling head of the present invention may be the same as or similar to the structure of the pipe rolling head of the present invention.

The concept that the rolling head of the present invention rotates while the hollow blank does not rotate or the rolling head of the present invention does not rotate but the hollow blank rotate is relative to each other and is also switchable or both rotate with each other.

The rolling wheel group according to the present invention refers to a combination of a plurality of rolling wheels used in the same rolling process. The specific setting methods of these rolling wheels in the rolling process can be set by techniques well known to those skilled in the art (for example "Thread Processing", edited by Wang Xiangkui, Mechanical Industry Press, 2008). Therefore, the method of the present invention is not limited to certain specific rolling apparatus.

The rolling head according to the invention refers to a device for rolling on a hollow blank to form intermediate blank and pipe thread products suitable for further processing of the external pipe thread. Main body of the device comprises several rolling wheels and rolling wheel seat for supporting or fixing the rolling wheel. The rolling wheel cooperates with the rolling wheel seat through a rolling wheel axle and is distributed in a radial direction about the hollow blank. In a specific case, a plurality of rolling wheel seats is integrally formed in the same wheel structure to form a rolling wheel disc.

The rolling process module of the present invention refers to a combination of a plurality of rolling heads or a combination of a plurality of rolling heads and other processing tools. Each rolling head may be completely independent or may be disposed in an integral structure. Said other processing tools include taper cutting tool, the correction tool for the inner chamber of blank, the chamfering cutting tools inside and outside end mouth, and thread surface processing tools.

In the present invention, the term "rolling along axial radial mixed direction" or "axially radially mixed rolling" means that the relative movement between the rolling wheel and the blank during the rolling process includes the axial and radial directions movement at the same time, and the relative movement is the relative axial movement of the rolling wheel and the hollow cylindrical blank caused by the axial component, which is generated by the spiral rising angle of the rolling wheel on the hollow blank or the deviation angle in vertical deflection between the axis line of the rolling wheel and the axis line of the hollow cylindrical blank when the rolling wheel is engaged with and rotated relative the hollow cylindrical blank, while the rolling wheel is radial fed according to certain process requirements to complete the rolling process. When the relative movement speed in the radial direction is zero, i.e. it is the "rolling in the axial direction" or the "axially rolling" described. When the relative movement speed in the axial direction is zero, i.e. it is the "rolling in radial direction" or "radial rolling" described. Therefore, the axial rolling and radial rolling are special cases of axial radial mixing rolling. Actual methods for implementing axial rolling and radial rolling can be various and are described in detail below with reference to the accompanying drawings. It should be noted that the following description is not intended to limit the scope of the present invention.

The "inner side of the hollow blank" and the "end of the hollow blank" described in the present invention can be understood as the position corresponding to the thread tail and the thread head in the portion to be processed with external pipe thread. Completing the axial rolling from the inner side of the hollow blank to the end of the hollow blank can be understood as completing the axial rolling from the corresponding position of the thread tail to the corresponding position of the thread head. Pre-rolling in the axial radial mixing direction using this method may be referenced to the method of the external pipe thread shown in the patent WO2014/161,447A1.

The following is detailed description with reference to the accompanying drawings:

1. Prior Art

FIG. 1 shows an existing rolling process schematic view. As shown in FIG. 1*a*, the hollow blank 40 is first axially punched into a conical surface 425 by a taper punching die 13 before performing the thread rolling. Alternatively, as shown in FIG. 1*b*, the cutting tool 91 in the axial cutting device 9 cuts the entire conical surface 425, and then shown as FIG. 1*c* using the rolling wheel 80 to perform thread rolling process of the hollow blank 46 containing the conical surface 425;

Process in FIG. 1*a* requires using taper mold machinery (or hydraulic) to axially move and punch workpiece. Firstly, it is processed to form a conical surface, and then the conical pipe thread is formed in the conical surface through rolling, otherwise, the pipe thread tooth is incomplete, and the body of the pipe is easy to crack.

There are at least the following two problems for the present external pipe thread process in FIG. 1:

1. As comparing with the current set of threading or machining of the pipe thread, there is one more working procedure for processing the conical surface that requires huge apparatus, which is not only time-consuming, but also operation for pipe network site processing pipe external thread is very inconvenient, and thus cannot be acceptable.

2. Due to the huge axial instant stamping pressure, when the conical surface is formed, the pipe material, especially the weld pipe material, is easily damaged hidingly or obviously, which may cause the safety hazard of the pipe external thread product.

It is clearly that FIG. 1*b* has a defect in the cutting process, so we will not repeat here.

2. The Rolling Process for Forming External Pipe Thread of the Present Invention In a specific embodiment, the external pipe thread forming rolling process of the present invention comprises two basic steps of pre-forming rolling and pipe thread forming rolling, that is, the pre-forming thread rolling is performed on a hollow blank by using a pre-forming rolling wheel, and then use the external pipe thread forming rolling wheel to perform further thread forming rolling process of the hollow blank that its non-roundness, the outer diameter of the port, the taper, depth of thread, depth of thread and the axial length both conforms with rolling requirements, and during the process, the number of pre-forming rolling wheels and the number of external pipe thread forming rolling wheels must be odd-even different.

Figure 2:
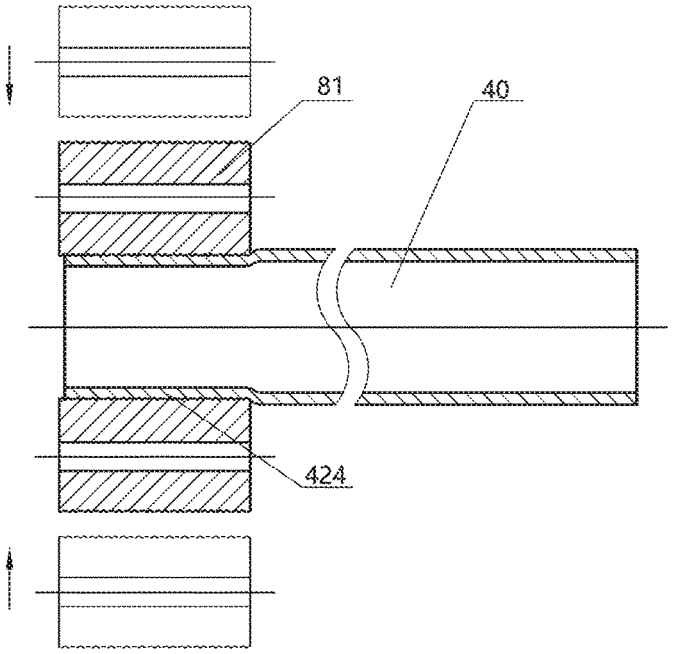
FIG. 2 is an embodiment of a radial pre-forming rolling process according to the present invention.
Figure 2:
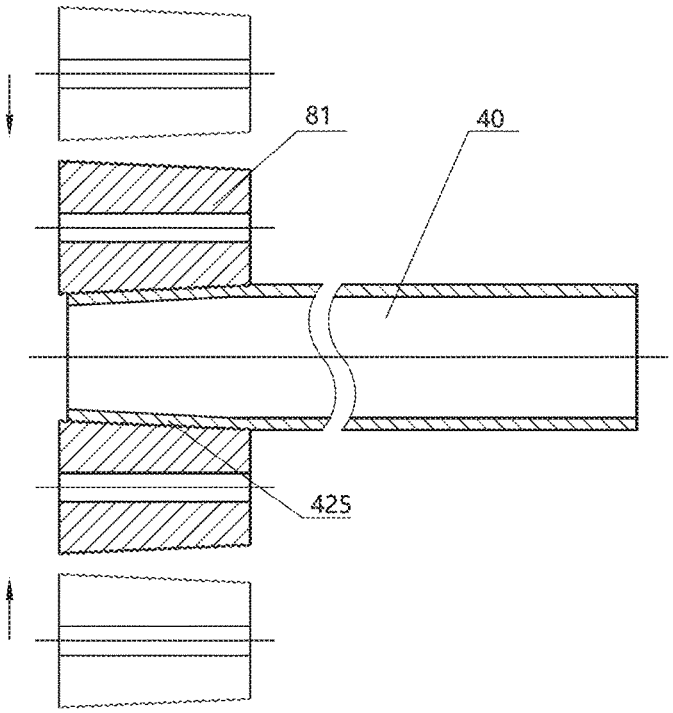
Figure 3:
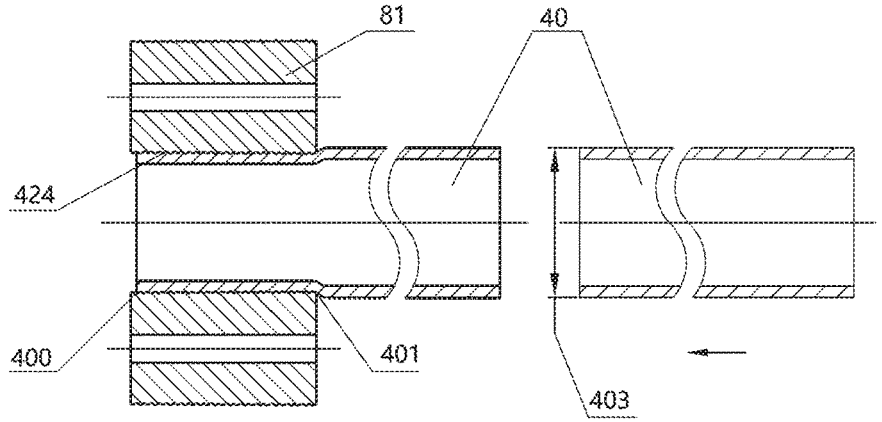
FIG. 3 is a schematic view of the rolling process for an axial pre-forming according to the present invention.
Figure 3:
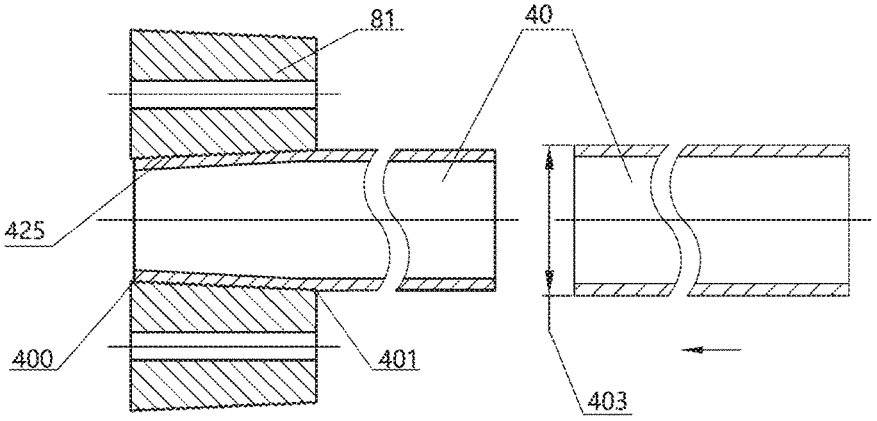
Figure 3:
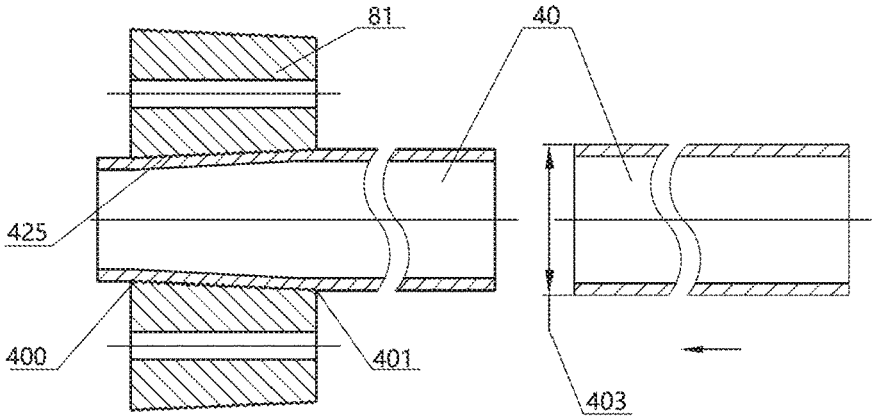
Figure 4:
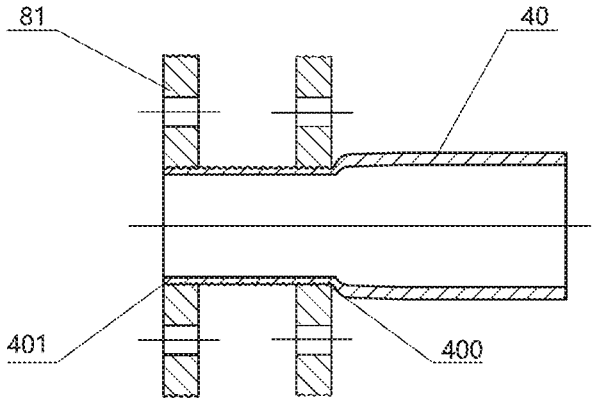
FIG. 4 is a schematic view of a pre-forming rolling process in an axially and radial mixing direction according to the present invention.
Figure 4:
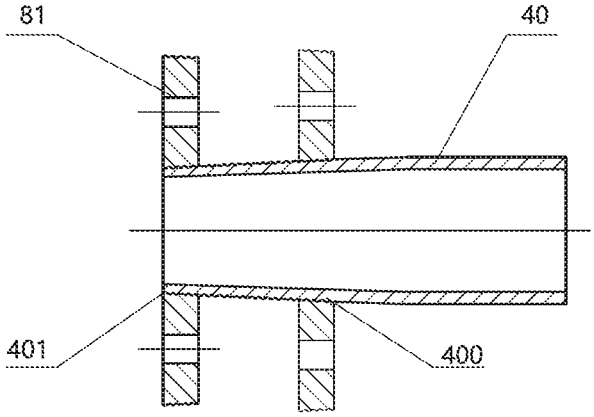
Figure 4:
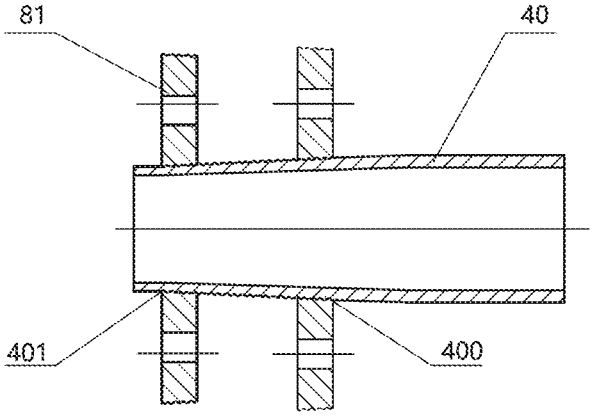

FIGS. 2 to 4 respectively show three pre-forming rolling process embodiments of the present invention.

FIG. 2 shows an embodiment of a radial pre-forming rolling process according to the invention. As the hollow blank 40 is rotated, the rolling wheel 81 completes the pre-forming rolling of the cylindrical surface 424 (FIG. 2*a*) and the conical surface 425 (FIG. 2*b*) by gradually increasing the rolling pressure with radial feed. When the rolling wheel is designed as a conical cylinder mixture, the pre-formed hollow blank is also a conical cylinder mixture. Because of its rolling method and the existing radial rolling thread process is similar, which are not repeated here. After pre-rolling the outer surface of the hollow blank has a pre-formed thread.

In order to reduce the radial rolling force of the apparatus, the pre-forming process of the present invention preferably adopts an axial pre-forming rolling process.

FIG. 3 shows an embodiment of the axial pre-forming rolling process of the present invention. As shown in FIG. 3*a*, the pre-forming rolling wheel 81 is a pre-forming threaded cylindrical rolling wheel, and a radial offset angle is provided between the rolling wheel 81 and the hollow blank. During the pre-forming rolling process, at least three cylindrical rolling wheels perform cylindrical surface rolling on the outer surface of the hollow blank, preferably, including at least four cylindrical rolling wheels perform cylindrical surface rolling on the outer surface of the hollow blank. The rolling of the cylindrical surface means that the outer surface of the rolled hollow blank is a cylindrical surface 424. As shown in FIG. 3*b*, when the pre-forming rolling wheel 81 is a conical pre-forming threaded rolling wheel, at least three conical rolling wheels perform conical surface rolling on the outer surface of the hollow blank, preferably, including at least four conical rolling wheels perform conical surface rolling on the outer surface of the hollow blank, and the conical rolling means the outer surface of the hollow blank is a conical surface 425. As shown in FIG. 3*c*, when the port of the hollow blank axially exceeds the conical rolling wheel 81, the exceeded portion is a cylindrical portion, and a hollow blank which have been rolled through a pre-forming rolling has a cylindrical conical mixing surface, after pre-rolling the outer surface of the hollow blank has a pre-formed thread.

It should be noted that during the axially pre-forming rolling process of the present invention, when the pre-forming rolling wheel having pre-forming thread its depth of thread is zero, the pre-forming rolling wheel is the smooth pre-forming rolling wheel. By setting the radial offset angle δ (as shown in FIGS. 12*d* and 16*d*) between the smooth rolling wheel and the hollow blank, the smooth rolling wheel is changed into an annular rolling wheel with a certain pitch; the size of the pitch depends in part on value of the radial offset angle δ. The radial offset angle δ causes the hollow blank to rotate in contact with the rolling wheel at 400, resulting in an axial relative movement between the two, completing the axial pre-forming rolling at 401, which changes a technical bias that the smooth rolling wheel only can be used for radial feed rolling. The smaller the depth of thread is, the smaller the pressure deformation force of the hollow blank on the steel pipe is, when the hollow bland is fed in the axial direction by progressive automatic feeding. Due to the zero depth of thread, the pressure deformation force on the steel pipe is minimized when the hollow bland is fed in the axial direction by progressive automatic feeding. The pitch of the pre-formed thread must be consistent with the pitch of the external pipe thread. When the pre-formed rolling adopts a smooth rolling wheel, the pitch of the pre-formed thread is a special pitch, which can also be considered to be consistent with the pitch of the external pipe thread.

In order to further reduce the radial rolling force of the apparatus and the subversion torque of the apparatus, an axial radial pre-forming rolling process is preferably employed.

FIG. 4 shows an embodiment of an axial radial mixing pre-forming rolling process according to the present invention, in which the pre-forming rolling wheel 81 is a pre-forming threaded cylindrical rolling wheel (FIG. 4*a*) or a pre-forming threaded conical rolling wheel (FIG. 4*b*), and the effective length of the rolling wheel is less than the thread length of the pipe external thread product to be processed. A radial offset angle is provided between the rolling wheel 81 and the hollow blank. The rolling wheel 81 moves axially from the inner side 400 of the hollow blank to the end 401 of the hollow blank, while the rolling wheel 81 is radially fed to a certain process position to remain unchanged or to be synchronized with the radial feed to a certain process position to remain unchanged, so that outer surface of part of the hollow blank to be provided with thread were processed into a threaded cylindrical surface (FIG. 4*a*) or conical threaded surface (FIG. 4*b*) or threaded cylindrical conical mixing surface (FIG. 4*c*).

The threaded cylindrical or threaded conical or threaded cylindrical conical mixing surfaces described in FIGS. 2, 3 and 4, the pitch of the pre-formed thread is equal to the pitch of thread on external pipe thread forming portion, the pitch of the pre-formed thread on the preformed rolling wheel forming the various surfaces described above is equal to the pitch of thread on the external pipe thread to be rolled subsequently, but the depth of thread of the pre-formed thread is smaller than the depth of thread of the external pipe thread to be rolled subsequently, and in particular the pre-formed thread can be provided as follows:

Depth of thread: when used for rolling the cylindrical external pipe thread, the depth of thread of the pre-formed blank is 5% to 70% the depth of thread of the cylindrical pipe thread to be processed, preferably 5% to 40%.

When used for rolling conical external pipe thread, the depth of thread of the pre-formed blank is equal to 5%-60% the depth of thread of the tapered pipe thread to be processed, preferably 10% to 40%.

Better preferably, the tooth profile of the pre-formed thread does not exceed the tooth profile of the external pipe thread forming portion.

Tooth profile: preferably, the pre-formed thread profile is a sinusoidal thread profile.

Taper: for rolling the external pipe thread on the cylindrical surface, the taper of the pre-forming thread is zero; for rolling the external pipe thread on the conical surface the taper of the pre-forming thread is generally from 2° to 12°, preferably from 3°30" to 8°30".

Axial length: it is to be noted that the length after being pre-formed rolling, the threaded cylindrical or the threaded conical surface or the threaded cylindrical conical mixing surface should be greater than or equal to the length of the subsequent thread product, preferably 1 to 3 pitch, particularly preferably by 2 pitch.

After the pre-forming rolling of the invention, the pre-formed thread has formed on the blank section that is to be provided with the thread, the stress is partially released, and the non-roundness of the blank reaches the requirement of subsequent rolling pipe thread, and the port diameter, taper and length (or height) of the cylindrical and conical surface is more suitable for subsequent pipe thread forming rolling, which is essential for the next step of the pipe thread forming rolling.

The shape of the pre-forming rolling wheel of the present invention is not limited to three types of cylindrical rolling wheel, conical rolling wheel and conical cylindrical mixing wheel. The cylindrical rolling wheel and the conical rolling wheel may not only be the rolling wheel with thread outside surface, but also rolling wheel with smooth outer surface when the thread depth of thread is zero, and can be mixed rolling wheel with threads on the outer surface and smooth surface.

The shapes and combination of the rolling wheel may also be provided by referring to patent WO2014056419A1; the pre-forming rolling wheel can be an annular rolling wheel and can also be a spiral rolling wheel. In an embodiment employing an annular rolling wheel, in order to be able to automatically feed the hollow blank in the pre-forming rolling step, the axis of the pre-forming rolling wheel has a certain deflection angle in vertical deviation from the axis of the hollow blank. The deflection angle is equal to spiral rising angle of the pre-formed pipe thread.

In a special embodiment, the pre-formed rolling wheel of the present invention utilizes a conical rolling wheel with a smooth surface, and in order to be able to automatically feed the hollow blank in the pre-forming rolling step, the axis of the pre-forming rolling wheel has a certain deflection angle in vertical deviation from the axis of the hollow blank. The larger the radial deflection angle is, the faster the axial feed rate of the hollow fiber blank is, and the radial deflection angle is generally no more than 9 degrees, preferably, less than 3 degrees. When the pre-forming rolling wheel is rotated relative to the hollow blank or the hollow blank is rotated relative to the per-forming rolling head or both are rotated relative to each other, the axial feed for the pre-forming rolling is accomplished by an axial force incurred by the deflection angle.

In practice, when the pre-formed rolling with smooth surface is used to roll the blank in axial preform, the phenomenon of difficulty in feeding the blank and the failure in operation may occur, which will affect the processability of the device. In order to enhance the stability of the process, it can be added the cutting outside chamfering process, but the steel pipe blank with 1.5 pitch or so at the port is thinned and the zinc player on the surface is destroyed. In order to realize the whole process of nun-cutting rolling, avoid damaging the steel pipes indicating galvanized coating, the preformed rolling is preferably use a surface having a pre-formed thread with the depth of thread that is not zero, the depth of thread of the outer surface thread is smaller than the depth of thread of the external pipe thread forming portion, and more preferably, the tooth profile of the pre-formed thread does not exceed the tooth profile of the external pipe thread forming portion, and more preferably, the pre-formed thread is a sinusoidal thread.

The pre-forming rolling process of the invention can only use a group of pre-forming rolling wheels to perform pre-forming rolling, and can also use a plurality of groups of pre-forming rolling wheels to repeatedly perform pre-forming rolling of the blank. After repeated pre-rolling, the hollow blank is processed with thread rolling in accordance with the spirit of the present invention, so as to form the external pipe thread.

Through the hollow blank processed by any pre-rolling process as shown in FIG. 2 to FIG. 4, in combination with the matching of the odd and even numbers of the rolling head and the total number of rolling wheels disclosed and structural formed in this patent, and matching with the existing pipe thread processing technology to perform thread rolling, you can roll out the standard pipe thread products. The design and arrangement of the corresponding thread rolling wheel, as well as the design and arrangement of the thread rolling head, can take the method described in the patent WO2014056419A1.

Figure 5:
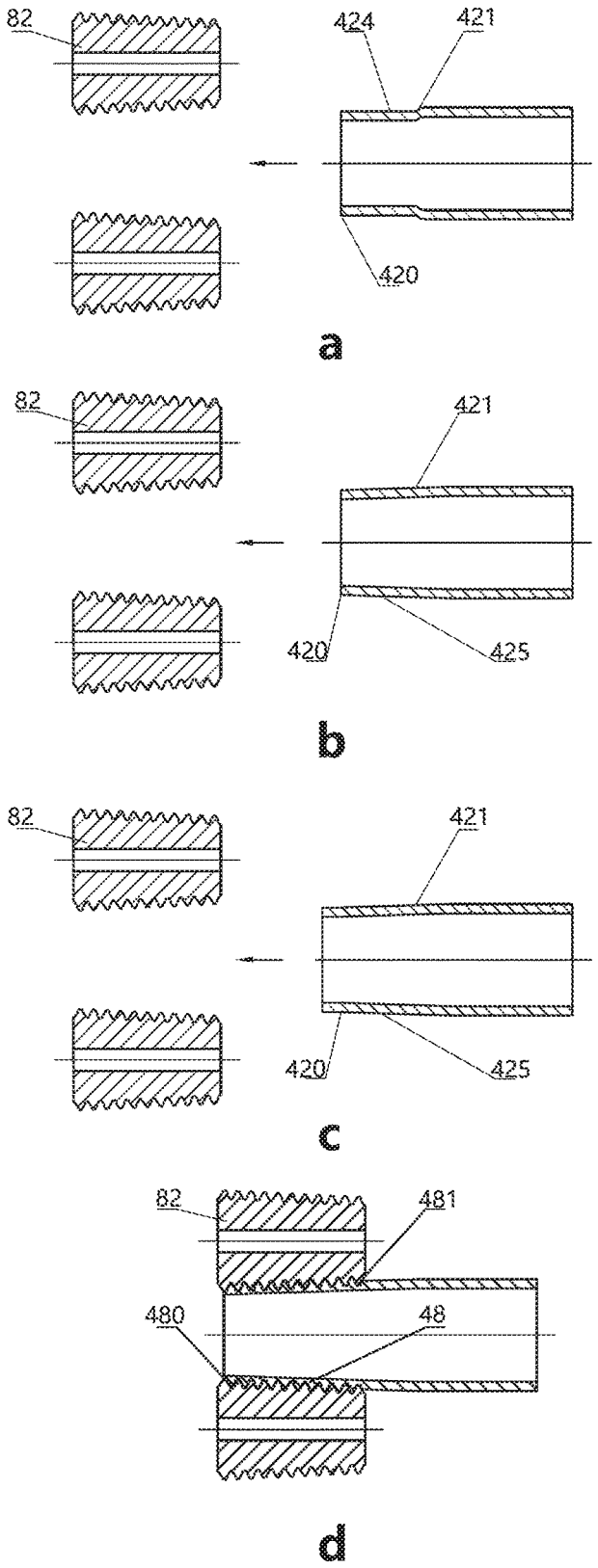
FIG. 5 is a schematic view of a process for forming an external pipe thread by axial rolling on the hollow blank after being pre-rolled in FIGS. 2, 3 and 4.

FIG. 5 is a schematic view of the process of the present invention for further axial rolling to form a pipe external thread on a pre-rolled hollow blank.

As shown in the figures, the pipe thread forming rolling wheel of the present invention comprises an external pipe thread forming portion through which a desired external pipe thread can be formed on a pre-rolled hollow blank.

In principle, the external pipe thread rolling process of the present invention can be understood as according to the outer diameter, the wall thickness, non-roundness and the material of the hollow blank, the subsequent pipe thread profile and the thread length accuracy, the pre-forming rolling of the portion of the hollow blank to be processed with the pipe thread is firstly performed either in the axial or axial radial direction, as that the same thread pitch and the different depth of thread between the front and rear pre-formed rolling thread and the external pipe thread, controlling the depth of thread of the pre-form pipe thread purposefully, in one embodiment, the depth of thread of the external pipe thread of the national standard 55° DN20 is 1.162 mm, and the depth of thread of the pre-form thread is taken to be 0.4 mm, but the thread pitch is the same, which is actually a special spiral line. The depth of thread of the outer surface thread is smaller than the depth of thread of the external pipe thread forming portion, further, the tooth profile of the pre-formed thread does not exceed the tooth profile of the external pipe thread forming portion, and more preferably, the pre-formed thread is a sinusoidal thread.

As the rolling wheel contacts the hollow blank step by step in the pre-formed rolling process, the original residual curvature range of the hollow blank (steel pipe) is gradually reduced and partial residual stress of the hollow blank is gradually released, so that the cross-section of the rolled portion of the hollow blank is formed by rolling from the original random polygons into a cylindrical or conical or cylindrical conical mixture that still has a certain ellipticity and can be controlled, the regular blank conforms to the subsequent thread rolling requirements, and it is found that according to the non-roundness of different original blanks, the non-roundness of original blanks can be reduced by about 10% to 35% after pre-formed rolling. In order to reduce the radial force of the apparatus during pre-forming rolling, it is preferable to use an axial rolling or axial radial mixing rolling; further to reduce the subversion torque of the apparatus during pre-forming rolling, an axial radial mixing rolling is preferably used. On this basis, it is further motivated to make use of the principle of the number of pipe thread forming rolling wheels matching with the even and odd numbers different in number of the pre-formed rolling wheel, wherein a plurality of spiral lines of controlled length are formed and the residual stress of the hollow blank is released to correct the non-roundness of the blank. Finally, because that spiral rolling wheel has two functions of straighten and the external pipe thread forming, this cylindrical or conical or cylindrical conical mixing with a certain ellipticity is rolled into a standard external pipe thread. Through the scientific calculation of the outer diameter tolerance, the yield strength, the elastic modulus of the different hollow blanks and the elastic deformation force of the external pipe thread rolling, the reasonable selection and control of the pre-formed rolling wheel depth of thread and radial position, taper and length, rolling times and time, number of rolling wheels, structure and distribution, residual stress and elastic deformation of the blank, and the required rolling pressure simplifies the rolling device, so that the qualified rate of the final external pipe thread rolling is achieved, more than 99%, greatly enhance the practicality of the rolling pipe thread technology.

3. Arrangement of the Pre-Forming Rolling Wheel and Pipe Thread Forming Rolling Wheel in the Process of the Present Invention According to the spirit of the present invention, the number of rolling wheels in two adjacent rolling steps must be different; that is, in the embodiment with two different process steps of pre-forming rolling and pipe thread forming rolling, the number of rolling wheels for pre-forming rolling and the number of rolling wheels for pipe thread forming rolling must be odd-even different. When the number of rolling wheels for the pre-forming rolling process is an odd number, the number of rolling wheels in the adjacent pipe thread forming rolling process must be an even number; and when the number of the rolling wheels for the pre-forming rolling process is even, the number of rolling wheels in the adjacent pipe thread forming rolling process must be an odd number. In the case of even and odd numbers matching, it can significantly improve the yield of pipe thread forming rolling products by effectively controlling the depth of thread of the pre-formed thread and the thread profile, the pre-formed blank port outer diameter, taper and axial length.

In addition to the odd-even different setting of the rolling wheels number, the number of the pre-rolling wheels for correction of the present invention is at least three, and the number of pipe thread forming rolling wheels for pipe thread forming rolling is also at least two, particularly preferably, the number of the pre-rolling wheels for correction is greater than or equal to 4, the number of the pipe thread forming rolling wheels is greater than or equal to 3, and the number of the pre-forming rolling wheels is greater than that of the pipe thread forming rolling wheels. The length of the pre-forming rolling wheel must be greater than or equal to that of the pipe thread product, preferably a pitch of 1 to 3 teeth larger. Thus, even if the hollow cylindrical blank has a certain degree of non-roundness, for example, when the hollow cylindrical blank has non-roundness of more than 100 μm, the desired external pipe thread can be well rolled with a yield of more than 99%.

It should be noted that the pre-rolling process in the pipe thread forming rolling process according to the present invention may be implemented by one pre-rolling or may be achieved by multiple rolling operations, for example, performing firstly, secondly, thirdly correcting pre-rolling, and then performing the pipe thread forming rolling, but the number of rolling wheels at two adjacent rolling steps must be different.

Figure 6:
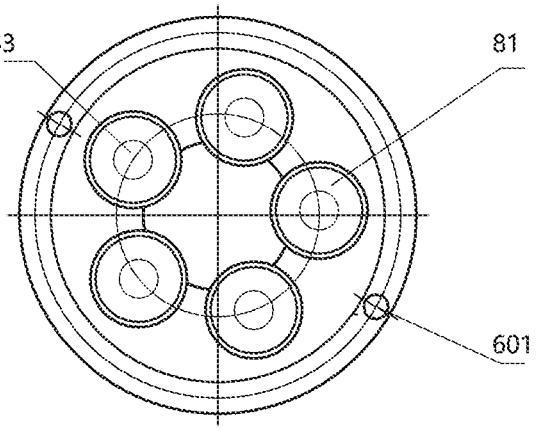
FIG. 6 is an embodiment of a pre-forming rolling head with five rolling wheels according to the present invention.
Figure 6:
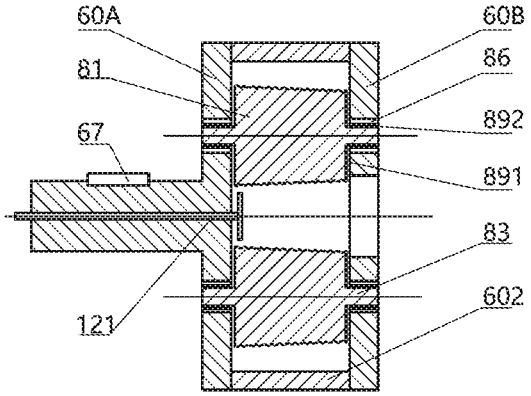

FIG. 6 shows a schematic view of a pre-forming rolling head with only one rolling wheel disc 60 according to the present invention. In this embodiment, the number of pre-forming rolling wheels 81 is five, and the five pre-forming rolling wheels are equally distributed around the processing axils of the hollow blank. The rolling head is rotated by the power motor via the pin shaft 67, to form a structure of the rolling wheel 81 around the rolling wheel axle 83.

Figure 7:
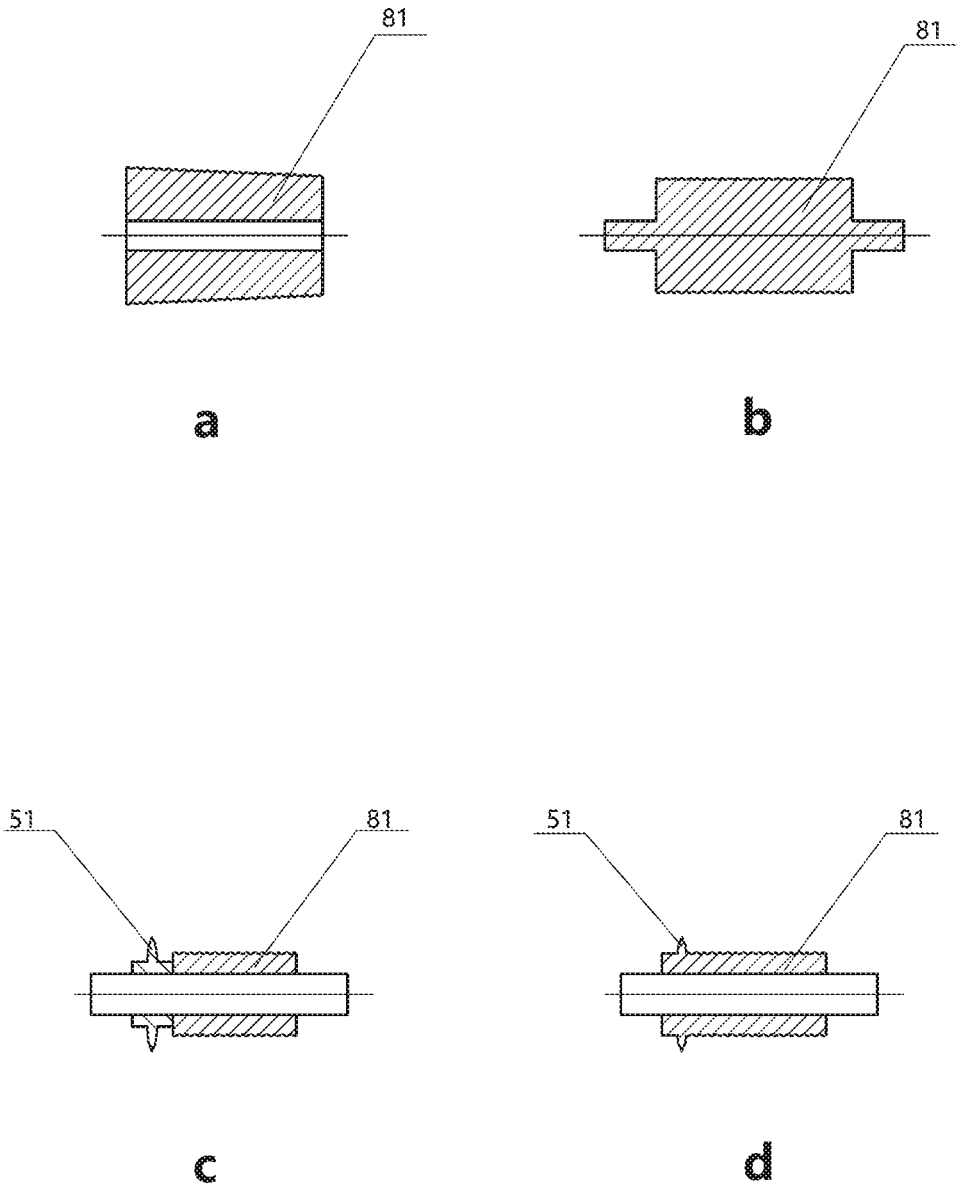
FIG. 7 is a schematic structure view of four kinds of pre-forming rolling wheel according to the present invention.

FIG. 7 shows an embodiment of a plurality of pre-forming rolling wheels of the present invention. The pre-forming rolling wheel of the present invention may be a threaded conical rolling wheel (7*a*), a cylindrical rolling wheel (7*b*) with a smooth annular rolling wheel and a rolling wheel shaft formed together, a cylindrical rolling wheel (7*c*) in combination with cutting tools and a cylindrical rolling wheel (7*d*) which are integrally provided with the cutting tools, and so on. Using the rolling wheels with cutting tools, the hollow blank can be formed with the desired threaded cylindrical or threaded conical surface or threaded cylindrical conical mixing surface at the same time to complete the hollow blank cutting, greatly improving the external pipe thread processing effectiveness.

Figure 8:
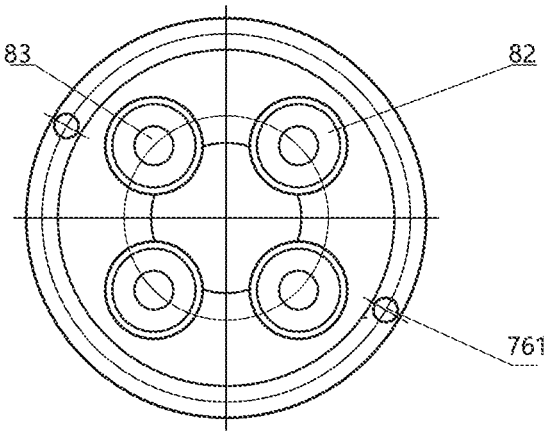
FIG. 8 is an embodiment of the rolling head for forming external pipe thread equipped with four rolling wheels and with a rolling wheel and an adjusting disc according to the present invention, which is matched with FIG. 6.
Figure 8:
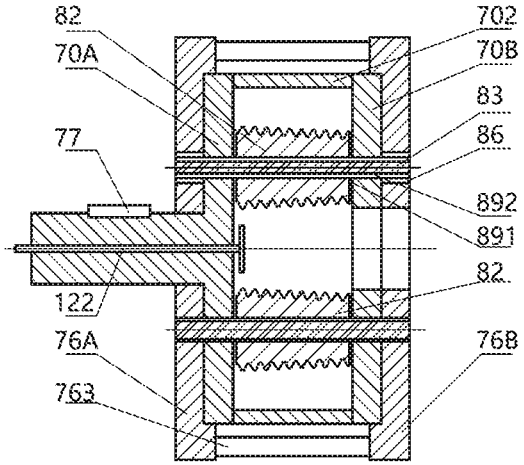

FIG. 8 shows a schematic view of a rolling head for forming pipe thread of the present invention, which includes a radial adjustment disc 76 and a rolling wheel 70 and corresponds to FIG. 6, comprising four pipe thread forming rolling wheels 82. The four pipe thread forming rolling wheels are equally distributed in the hollow blank around the processing axis. The rolling head is rotated by the power motor via the pin shaft 67 to form a structure of the rolling wheel 81 around the rolling wheel axle 83.

In still another embodiment, the number of pre-forming rolling wheels is four, and the number of pipe thread forming rolling wheels is three.

In another embodiment, the number of pre-forming rolling wheels is six, and the number of pipe thread forming rolling wheels is three or five.

In still another embodiment, the number of pre-forming rolling wheels is seven, and the number of pipe thread forming rolling wheels is four or six.

In still another embodiment, the number of pre-forming rolling wheels is eight, and the number of pipe thread forming rolling wheels is five or seven.

In still another embodiment, the number of pre-forming rolling wheels is nine, and the number of pipe thread forming rolling wheels is four, six or eight.

In practice, for hollow blanks below 2 inches, the number of pre-forming rolling wheels and the number of pipe thread forming rolling wheels do not generally exceed 15, preferably 4, 5, 6, 7, 8 or 9;

In practice, for hollow blanks of 2 to 4 inches (including 2 inches and 4 inches), the number of pre-forming rolling wheels and the number of pipe thread forming rolling wheels do not generally exceed 19, preferably 4, 5, 6, 7, 8, 9, 10 or 11;

For hollow blanks above 4 inches, the number of pre-forming rolling wheels and the number of pipe thread forming rolling wheels do not exceed 35, preferably 4, 5, 6, 7, 8, 9, 10, 11, 12, 13, 14, 15, 16, 17, 18, 19 or 20.

The number of pre-forming rolling wheels and the number of pipe thread forming rolling wheels vary from 1 to 11, preferably 1, 3, 5 or 7. The different numbers may be the number that the number of the pre-forming rolling wheels is more or less than the number of the pipe thread forming rolling wheels. It is preferable that the number of the pre-forming rolling wheels is more, so as to reduce the number of pipe thread forming rolling wheels and thereby reduce the difficulty of teeth alignment during pipe thread rolling.

It should be noted that the number, the taper and the length of the pre-forming rolling wheels, and the number of pipe thread forming rolling wheels, the length accuracy of the pipe thread products can be increased, decreased or matched according to the outer diameter, the wall thickness and the material, non-roundness of the hollow blank, rolling wheel diameter size, rolling wheel form, thread profile and rolling thread length accuracy requirements, and so on.

The form of the pre-forming rolling wheels and the pipe thread forming rolling wheels is preferably a structure in which the rolling wheel and the rolling wheel shaft are integrated. In this way, the number of rolling wheels can be effectively increased, which is beneficial to reducing the times of rolling in stages and prolonging the life of the rolling wheel.

In an embodiment of a preferable pre-forming rolling and pipe thread forming rolling head, there is an axially free movable space 891 (FIGS. 6*b* and 8*b*) between the rolling wheel and the rolling wheel seat, of course there is a certain radial movable space 892 (FIGS. 6*b* and 8*b*). The movable space means that there is a space for the rolling wheel to move freely in the space. The axial movable space refers to the movable space of the rolling wheel in the axial direction of the rolling wheel axle. The axial distance of the axial movable space refers to the maximum distance at which the rolling wheel is freely movable in the axial direction of the rolling wheel shaft. The radial movable space refers to the movable space of the rolling wheel movable in the vertical direction of the processing axils along the hollow blank, and the radial distance of the radial movable space refers to the maximum distance of the pipe thread forming portion of the rolling wheel free movable in the vertical direction of the processing axis of the hollow blank relative to the hollow blank to be processed.

Implementation of the movable space can be referenced to the patent WO2014056419A1. In a preferred embodiment, the rolling wheel and the rolling wheel seat or the rolling wheel axle and the rolling wheel seat may be a shaft hole free movable cooperation. FIGS. 6*b* and 8*b* shows this type of cooperation, wherein FIG. 6*b* is a schematic structural view showing a pipe thread forming rolling head which only comprises a rolling wheel disc, wherein the rolling wheel and the rolling wheel shaft are integrated; FIG. 8*b* shows a schematic structural view of a pre-forming rolling head including a rolling wheel disc and a adjusting disc. The rolling wheel and the rolling wheel shaft are capable of freely cooperating with each other and show the free cooperation schematic view of the rolling wheel and the rolling wheel seat.

It is noteworthy that the pre-forming rolling wheel or the forming rolling wheel for forming pipe thread of the present invention may be an annular rolling wheel or a thread rolling wheel, and preferably an annular rolling wheel, the external thread forming rolling wheel adopts a thread rolling wheel.

When the rolling wheel adopts an annular rolling wheel, the axis of rolling wheel and the axis of the workpiece processing working hole have a deflection angle of not more than 9 degrees in the vertical direction; meanwhile, in order to make each annular rolling wheel in the floating space to achieve automatic teeth alignment in the most economical way, reduce injury of non-roundness by the rolling pressure on the hollow blank, the rolling wheel for forming pipe thread and its rolling wheel seat or rolling wheel shaft for forming pipe thread and the rolling wheel seat can be a shaft hole cooperation with clearance for free movement; and each annual rolling wheel has surface provided with initial part of the thread. The initial part of the thread refers to thread that firstly contacts the hollow blank when the annual rolling wheel performs the thread rolling process, preferably the initial part of the thread with an equal extension or bisecting indent design, and the specific design idea is as follows:

It is assumed that the rolling head for forming pipe thread comprises a total of N annular rolling wheels, starting from one of the annular rolling wheels Ri and the initial part of the thread of the next rolling wheel Ri+1 in the same clockwise direction is: a thread obtained based on the initial part of the thread of the rolling wheel Ri to extend a distance of 1/N pitch in accordance with the original thread form and the pitch in the direction of the axis of the rolling wheel Ri.

It should be pointed out that the thread obtained by extension is a hypothetical concept and is described in detail below in conjunction with an embodiment of the present invention.

Figure 9:
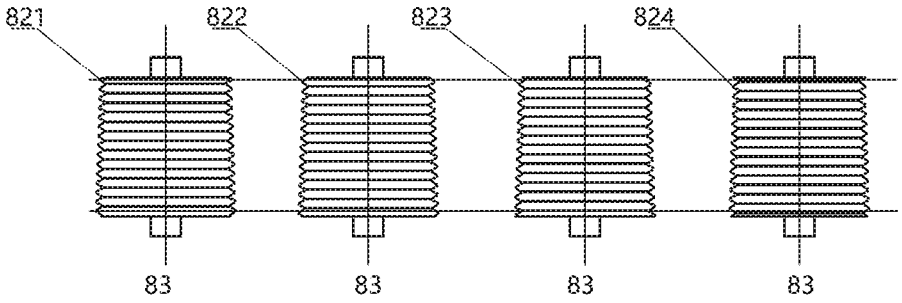
FIG. 9 is a schematic view showing the position distribution of the initial portion threads 821, 822, 823 and 824 of each annular rolling wheel in the embodiment of the rolling head for forming pipe thread of the present invention including four annular rolling wheels.

FIG. 9 shows the position distribution of the initial part threads 821, 822, 823 and 824 of the respective annular rolling wheels in the rolling head for forming pipe thread including four annual rolling wheels according to the present invention.

In the figures, each annular rolling wheel is arranged in a row from left to right according to the order of clockwise arranged in the rolling head for forming pipe thread. The initial part thread 821 of the annular rolling wheel $R_1$ is shown as a complete annual threads starting from the bottom of the tooth; the initial portion thread 822 of the rolling wheel R2 is a thread obtained by extending the initial portion thread 821 of the rolling wheel R1 by a distance of ¼ pitch in the axial direction of the rolling wheel R1; the initial portion thread 823 of the rolling wheel R3 is a thread obtained by extending the initial portion thread 822 of the rolling wheel R2 by a distance of ¼ pitch in the axial direction of the rolling wheel R2; the starting portion thread 824 of the rolling wheel R4 is a thread obtained by extending the initial portion thread 823 of the rolling wheel R3 by a distance of ¼ pitch in the axial direction of the rolling wheel R3; a starting portion thread 821 of the rolling wheel R1 is a thread obtained by extending the initial portion thread 824 of the rolling wheel R4 by a distance of ¼ pitch in the axial direction of the rolling wheel R4.

The arrangement structure of the thread rolling wheel group according to the present invention can be set without reference to the details known to those skilled in the art.

4. The Structure of the Rolling Head

The pre-forming rolling head and the rolling head for forming pipe thread according to the present invention may adopt the same or similar structural design. In a specific embodiment, both the pre-forming rolling head and the rolling head for forming pipe thread can adopt a structural design with a rolling wheel disc and an adjusting disc or a structural design with only a rolling wheel disc. FIGS. 10 to 16 describe in detail an embodiment of a universal rolling head structure of the present invention.

Figure 10:
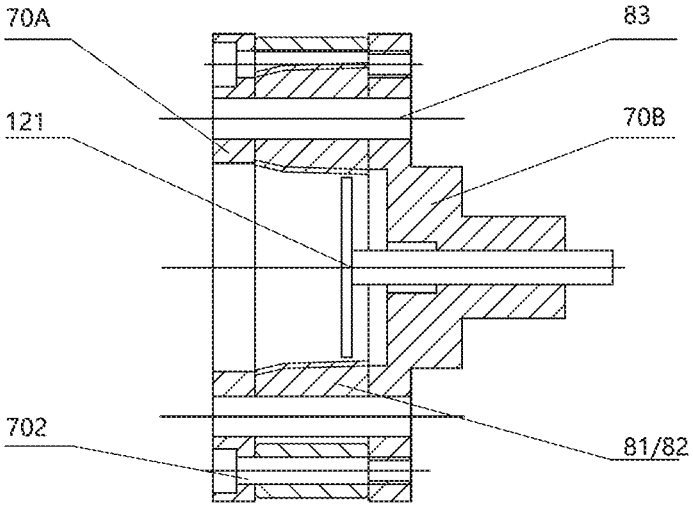
FIG. 10 shows an embodiment of an axially rolling head with only a rolling wheel equipped with a photo-induced mechanical device according to the present invention.
Figure 11:
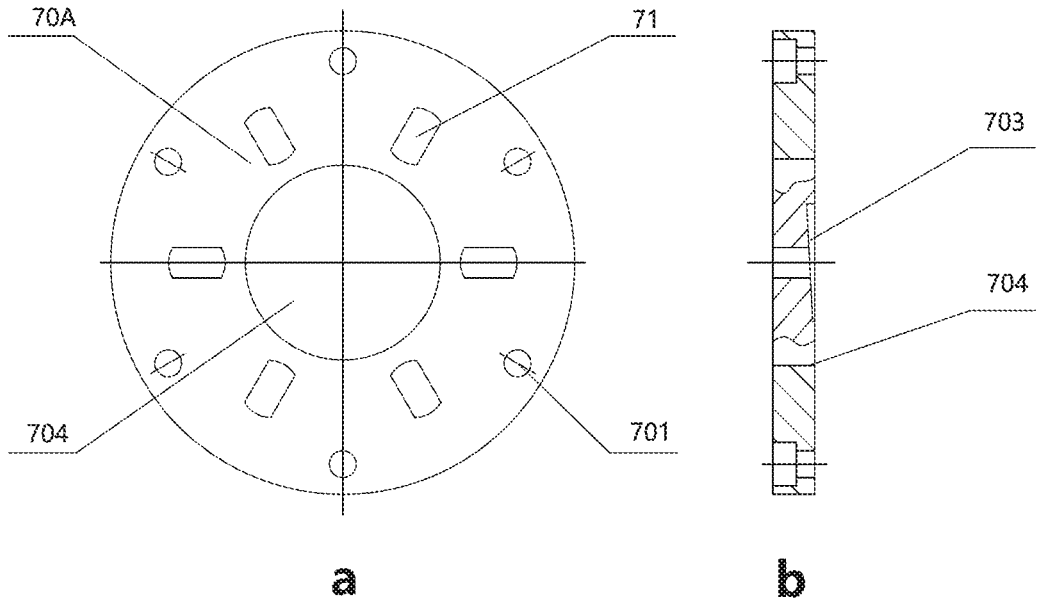
FIG. 11 is a schematic structure view of a rolling wheel disc with six rolling wheels in the rolling head of FIG. 10.

FIG. 10 is a schematic structural view of an embodiment of an axially rolling head according to the present invention. FIG. 11 is a schematic view of the structure of a rolling wheel with six rolling wheels in the rolling head of FIG. 10. In which FIG. 11*a* is a front view of the rolling wheel disc, and FIG. 11*b* is a side view of the rolling wheel disc. As shown in FIGS. 10-11, the rolling head comprises front and rear rolling wheel discs (70A, 70B), a rolling wheel shaft 83 matched with the radial groove 71 on the rolling wheel disc and rolling wheel 8 thereof, and a connecting pin shaft 702 matched with the pin hole 701 on the rolling wheel disc; a workpiece processing hole 704 at the center of the rolling wheel disc, and the mounting surface of the radial groove 71 of the rolling wheel disc to the rolling wheel is an inclined plane 703; the rolling wheel shaft 83 is mounted on the radial groove 71 of rolling wheel by two end inclined planes 832*a* and 832*b* matched with the radial grooves 71 on the rolling wheel disc, and the shape and size of the groove 71 allows the rolling wheel axle 83 to be axially mounted. The two rolling wheel discs 70A and 70B are connected and fixed with each other through the connecting pin shaft 702 of the rolling wheel to form the rolling head coaxially. In addition, a rolling time and position control adjustment rod 121 is provided at the end of the rolling head for controlling the pre-forming rolling time and the rolling axial length.

Figure 12:
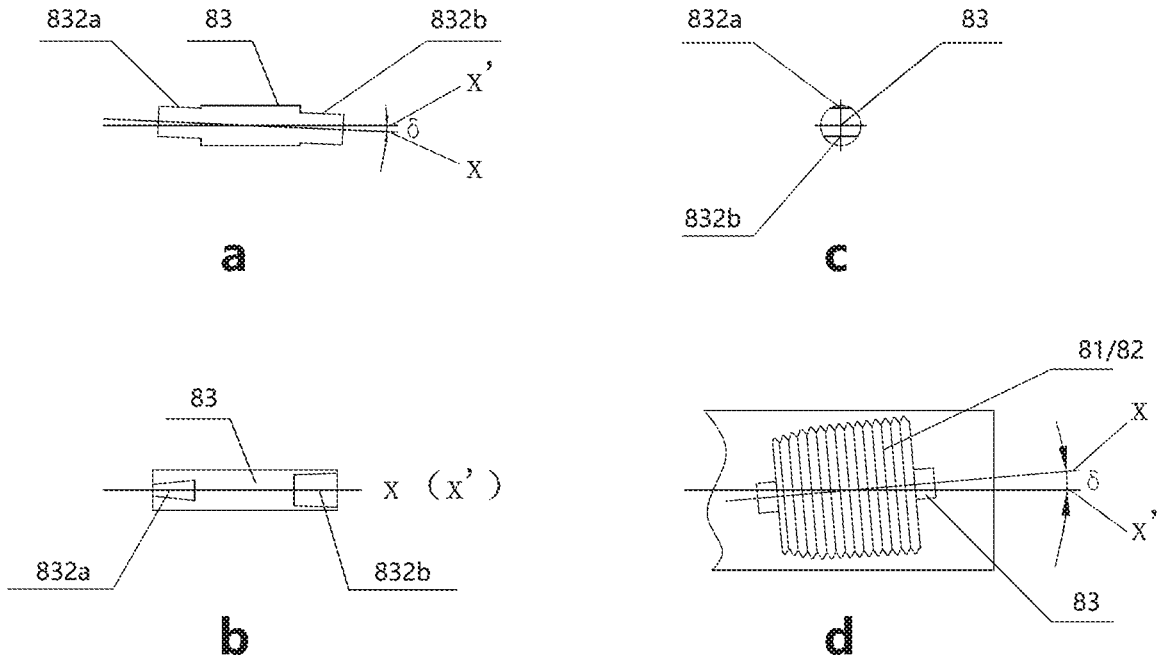
FIG. 12 is a schematic structure and installation view of the rolling wheel shaft in the rolling head of FIG. 10.
Figure 12:
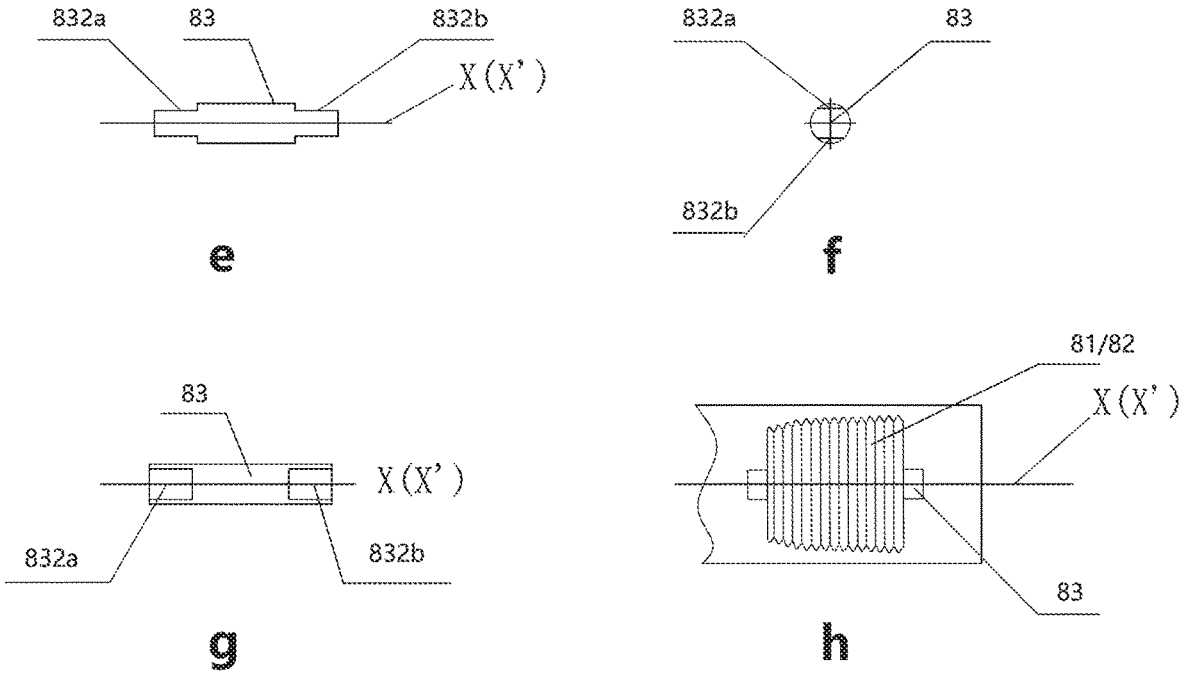

FIG. 12 is a three-dimensional view of the structure of the rolling wheel axle in the rolling head of FIG. 10 and a schematic view of the radial offset angle δ in the vertical direction of the rolling wheel axle and the hollow cylindrical blank body shaft. In which FIG. 12*a* is a front view of the rolling wheel shaft, and FIG. 12*b* is a top view of the rolling wheel shaft, and FIG. 12*c* is a side view of the rolling axle.

The two ends of the rolling wheel shaft 83 each have upper and lower inclined planes 832*a* and 832*b* parallel to each other. The axis x' of the inclined plane and the axial center line x of the rolling wheel shaft form a radial setting angle δ. The axis of the machining center is parallel to x' and the angle between x and the plane formed by the machining center axis and x' is equal to the radial setting angle δ.

FIG. 12*d* clearly shows that when the rolling wheel is coaxially mounted on the center of the rolling wheel shaft, the rolling wheel axle line forms a radial set angle δ with the inclined planes 832*a*, 832*b*.

Due to the inclined plane of the rolling axles 832*a* and 832*b*, the shaft of the rolling wheel which installed and the axial of the hollow blank forms a spiral rising angle δ, and when the hollow blank and the rolling wheel make mutual contact with each other, the hollow blank can be moved axially. The larger the spiral rising angle δ is, generally no more than 9 degrees, the faster the hollow blank moves axially. The radial setting angle δ is preferably less than 5 degrees for steel pipes below 2 inches; and the radial setting angle δ is preferably less than 3 degrees for 2 to 6 inches.

When the rolling wheel is a thread rolling wheel, the radial setting angle is 0. FIGS. 12*e*, 12*f*, 12*g* and 12*h* are schematic views of the structure of the rolling wheel shaft of the rolling head of FIG. 10 and the radial offset angle δ=0 of the rolling wheel shaft and the hollow cylindrical blank axis in the vertical direction. FIG. 12*e* is a front view of the rolling wheel axle, FIG. 12*f* is a plan view of the rolling wheel axle, and FIG. 12*g* is a side view of the rolling wheel axle. FIG. 12*h* clearly shows that when the rolling is mounted concentrically in the center of the rolling axle, the rolling axle line and the planes 832*a*, 832*b* form a radial set angle of 0. Others are similar to those of FIGS. 12*a*, 12*b*, 12*c* and 12*d*, and will not be described again.

Figure 13:
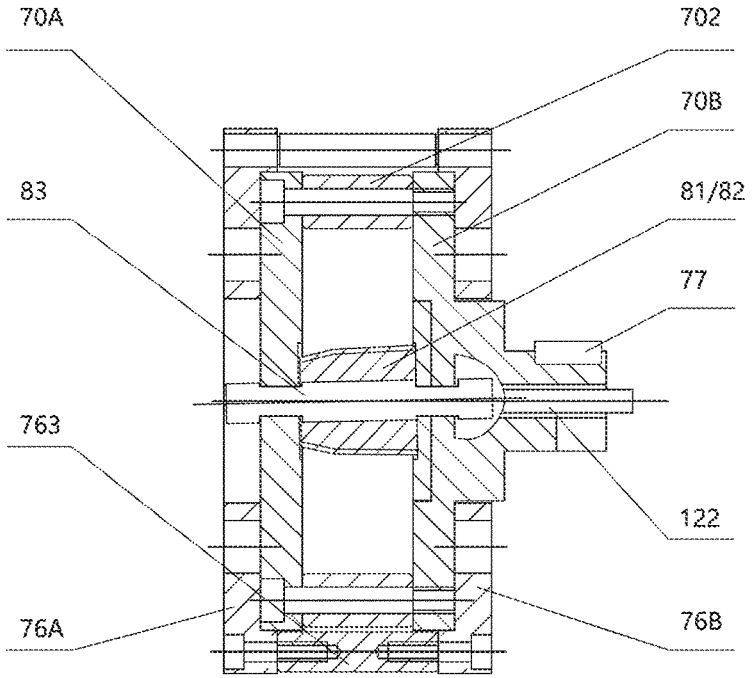
FIG. 13 is a schematic structure view of an embodiment of a rolling head further comprising an axial rolling of an adjusting disk on the basis of FIG. 10 according to the present invention.

FIG. 13 is a rolling head embodiment further comprising an axial rolling of the adjusting disk on the basis of FIG. 10 according to the present invention.

Figure 14:
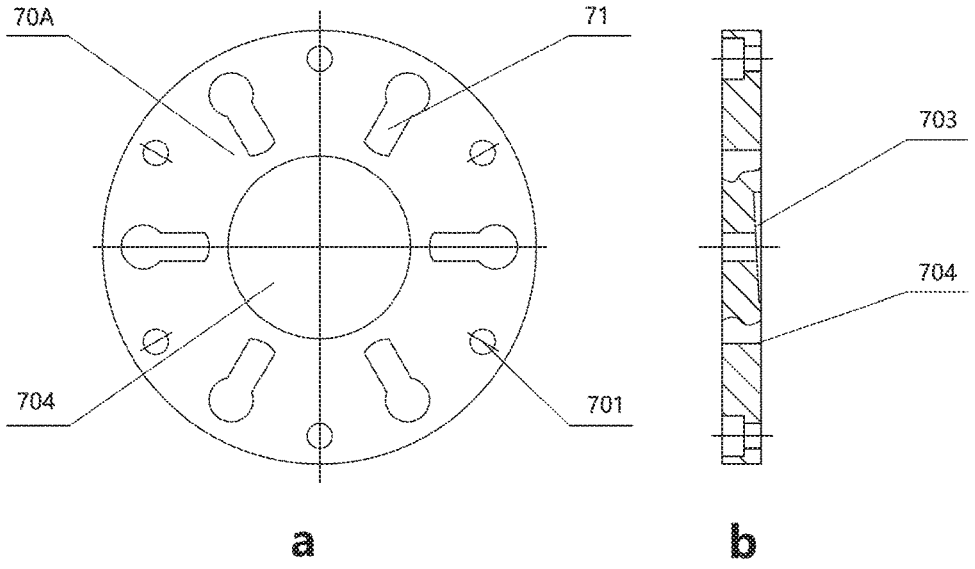
FIG. 14 is a schematic structure view of the rolling wheel disc with six rolling wheels in the rolling head of FIG. 13.

FIG. 14 is a structural diagram of the rolling wheel in FIG. 13. FIG. 14*a* is a front view of the rolling wheel disc, and FIG. 14*b* is a side view of the rolling wheel disc. The rolling wheel of FIG. 14 is basically similar in structure to the rolling wheel of FIG. 11, except that the shape of the radial groove 71 is the same. The radial groove 71 of the rolling wheel in FIG. 14 is a combination of a cylinder and a cuboid. The cylinder exists for the purpose of mounting the rolling wheel shaft with a cylindrical end. The radial groove 71 of the rolling wheel in FIG. 11 is an approximately rectangular structure, cooperating with the rolling wheel shaft with an approximating rectangular end. Other structures are the same, which will not be repeated here.

Figure 15:
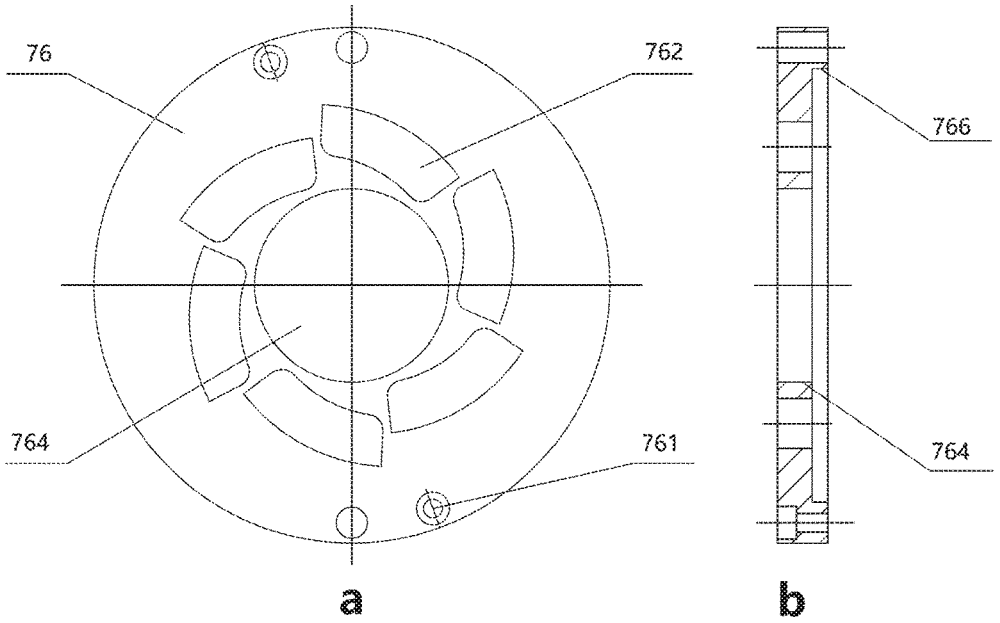
FIG. 15 is a schematic view of the adjusting disk in the rolling head of FIG. 13.
Figure 17:
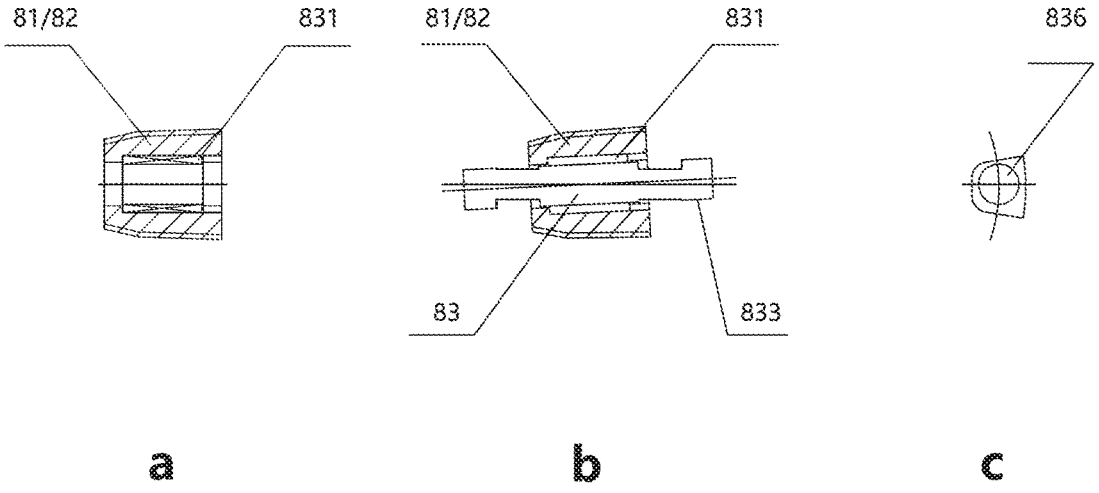
FIG. 17 is a schematic view showing structure of the rolling wheel and cooperation of the rolling wheel, the rolling wheel shaft and the rolling wheel shaft seat (sliding piece).

FIG. 15 is a schematic structural view of the adjusting disc in the rolling head of FIG. 13. FIG. 15*a* is a front view of the adjusting disc structure, and FIG. 15*b* is a side view of the adjusting disc structure. The radial adjusting device comprises a front and back adjusting disc 76A and 76B and a fixed connecting pin 763 matched with the pin hole 761 on the adjusting disc. The center of the adjusting disc is provided with a workpiece processing working hole 764 matched with the rolling wheel disc and a positioning hole 766 for positioning the adjusting disc which is matched with the rolling wheel disc; the adjusting disc 76 is coaxially mounted front and rear respectively on the outside of the rolling wheel disc through the positioning blind hole 766 of the adjusting disc and are connected to each other by the adjusting disc pin 763 and to form a shaft hole with the adjusting disc pin; As shown in FIG. 17*c*, by rotating the adjusting disc 76, a sliding block 836 is mounted on the two ends 836 of the rolling wheel axel and slides in the arc-shape groove 762 of the adjusting disc, so that the rolling wheel axle 83 moves radially in the radial groove 71 of the rolling wheel 70 to form a rolling head whose radial position is adjustable with respect to the rolling wheel. In addition, a rolling position photo-sensing control adjustment rod 122 is provided on the side where the rolling head is finished rolling for controlling the rolling time and the rolling length. It should be noted that when the pre-forming rolling head adopts the structure as shown in FIG. 10 and the pipe thread forming rolling head adopts the structure as shown in FIG. 13, the pre-forming rolling time controlled by the photo induction control adjusting rod 121 in FIG. 10 and the thread rolling time controlled by the control adjusting rod 122 in FIG. 13 must be matched reasonably in order to roll out the qualified pipe external thread product. The power motor is rotated by the rolling head driven by the pin 77 so that the rolling wheel 8 surrounds the rolling wheel shaft 83.

Figure 16:
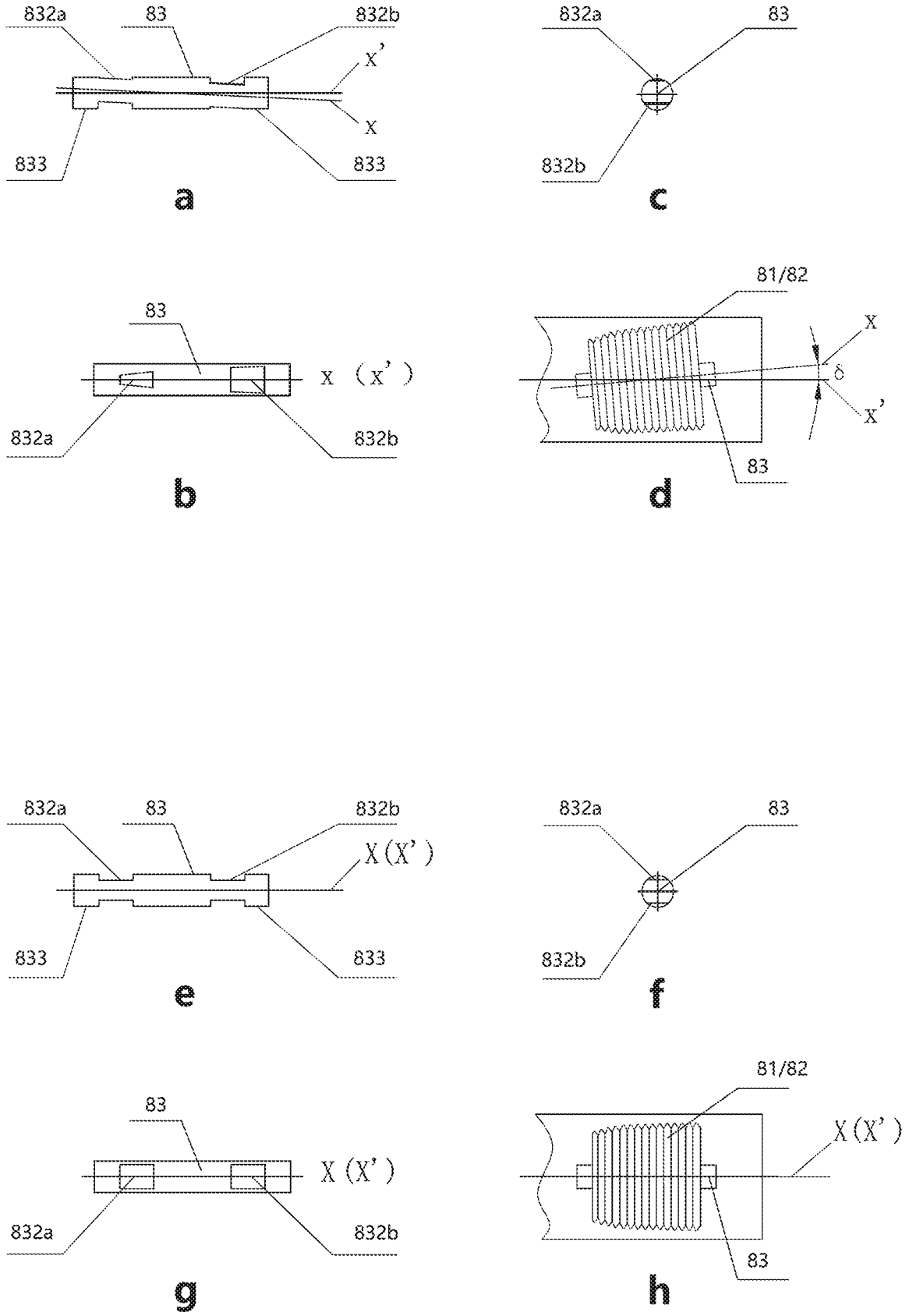
FIG. 16 is a structure and installation view of the rolling wheel shaft in the rolling head of FIG. 13.

FIG. 16 is a plan view of the structure of the rolling wheel shaft and its radial offset angle according to the present invention. FIG. 16*a* is a front view of the rolling wheel shaft, FIG. 16*b* is a top view of the rolling wheel shaft, and FIG. 16*c* is a side view of the rolling wheel shaft, and FIG. 16*d* is a schematic view showing the angle δ provided in the vertical direction between the rolling wheel axis and the hollow cylindrical blank axis. When the rolling wheel is a thread rolling wheel, the radial setting angle is 0. FIGS. 16*e*, 16*f*, 16*g* and 16*h* are schematic views of the structure of the rolling wheel shaft in the rolling head of the present invention and the radial offset angle δ=0 of the rolling wheel shaft and the hollow cylindrical blank axis in the vertical direction. FIG. 16*e* is a front view of the rolling wheel axle, FIG. 16*f* is a plan view of the rolling wheel axle, and FIG. 16*g* is a side view of the rolling wheel axle. FIG. 16*h* clearly shows that when the roller is mounted concentrically in the center of the rolling axle, the roller axle line and the planes 832*a*, 832*b* form a radial set angle of 0. Others are similar to those of FIGS. 16*a*, 16*b*, 16*c* and 16*d*, and will not be described again.

FIG. 17*a* is a schematic view of the structure of a rolling wheel according to the present invention. The rolling wheel includes a guiding-in portion and a rolling portion. The taper of the pre-forming rolling portion on the rolling wheel is 2° to 12°. The taper size of the pre-forming rolling portion is determined according to the essence of the present invention, preferably 3°30"~8°30". The angle of the guiding-in can be generally 13°; the rolling portion for pipe thread has a pipe thread taper of 1:16.

FIG. 17*b* is a schematic view of the rolling wheel, a needle bearing cooperating with a rolling wheel shaft according to the present invention. The cooperation of the rolling wheel 8 and the needle bearing 831 mainly reduces the rotational friction force of the rolling wheel. The rolling wheel 8 is freely mounted on the rolling wheel shaft 83 through needle bearings 831. The rolling wheel shaft 83 and the rolling wheel 8 can also be matched with each other by balls, aligning or other bearings;

FIG. 17*c* is a cross-sectional view of a sliding block that mates with a rolling wheel shaft.

As shown in FIG. 17*c*, the two cylindrical ends 833 of the rolling wheel shaft 83 are mounted (position adjusting) in the holes of the sliding block 836 to form a shaft hole fitting; the sliding block 836 is installed in the arc-shaped slot 762 of the adjusting disc, forming a cylinder and circular arc cooperation. In addition, a rolling position control adjustment rod 122 is provided at the end of the rolling head for controlling the rolling time and the rolling length. The rolling wheel is movably fixed on the apparatus rack (not shown) by a rolling head frame 68 (as shown in FIG. 18).

The adjusting disc is rotated with respect to the rolling wheel disc. A cam device is provided on the adjusting disc (not shown in the FIG.). The cam curve controls the radial distance adjustment of the rolling wheel and the radial opening of the rolling head. When necessary, a detecting device 123 (also not shown in the FIG.) can also be arranged between the rolling wheel disc and the adjusting disc for numerical control purpose.

Figure 18:
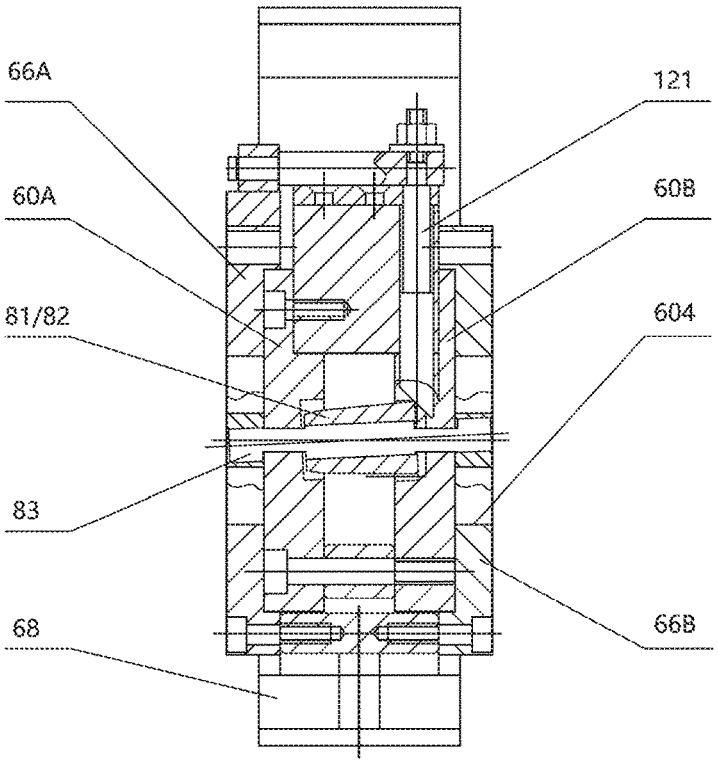
FIG. 18 is another embodiment of a rolling head for axial rolling which includes a photo-induced control-adjusting lever device according to the present invention.

FIG. 18 is a rolling head embodiment that can be passed through by the improved hollow blank on the basis of FIG. 13 rolling in the axial direction.

At the end of the rolling head is mounted with a rolling position control adjusting rod 121 for controlling the rolling time to achieve the control of the length of the rolling thread. Pipe thread rolling time control and pre-forming rolling time and rolling wheel radial position must be a reasonable match. In general, the length of the pre-forming conical or cylindrical surface or the axial radial mixing surface should be greater than or equal to the length of the pipe thread to be rolled, preferably 1 to 3 teeth, more preferably 2 teeth pitch.

The setting of the radial position determines the outer diameter of the pre-forming hollow blank end port.

The frame structure 68 of the rolling head of FIG. 18 has holes (not shown) and pins (not shown) on the side end thereof. The frame structure 68 or the side ends of the rolling head are sleeved on the hole of the rolling device sliding frame, forming a floating connection, so as to achieve self-centering of the rolling module seat and the hollow blank. The rolling disc 60 and the adjusting disc 66 in FIG. 18 are similar to those of FIGS. 11, 14, and 15, the mounting and setting of the rolling wheel shaft and the rolling wheel are exactly the same as those of 12 and 16, and will not be described again. The difference between FIG. 18 and FIGS. 6, 8, 10 and 13 is that the center of the front rolling disc and the front adjusting disc are not provided with other auxiliary or transmission means, so that the hollow blank can be axially rolled through the rolling head.

Figure 19:
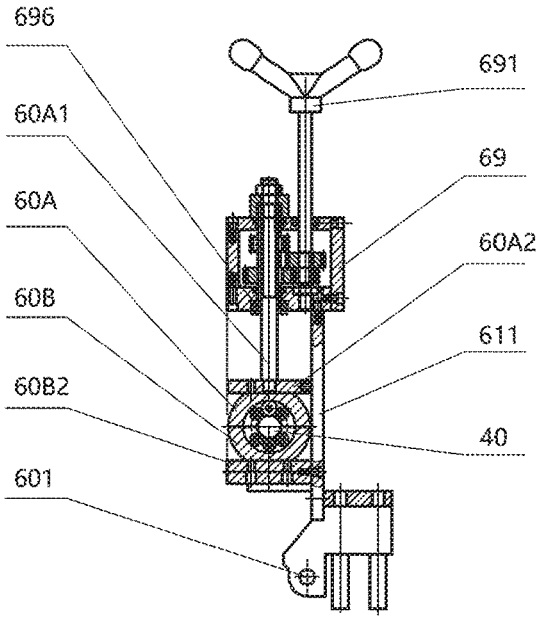
FIG. 19 is an embodiment of a rolling head for a manual axial radial hybrid rolling according to the present invention.

FIG. 19 shows a schematic structural view of an embodiment of a manual axial radial pre-forming rolling head of the present invention. The rolling head comprises: an upper rolling wheel base disc 60A2, a threaded upper rolling wheel base pushing rod 60A1, a torque amplifying gear group 69, a lead screw nut 696, a rotating handle 691. The upper rolling wheel base disc 60A2 and the rolling wheel seat 60A is fixedly connected and sleeved on the guiding column 611 to form shaft-hole cooperation. One end of the upper rolling wheel seat pushing rod 60A1 is against and fixedly to the upper rolling seat disc 60A2, and the other end cooperates with the lead screw nut 696, and cooperates with the output gear bore bearing in the torque amplification gear group coaxially. The input shaft of the torque amplifying gear group 69 is fixedly connected with the rotation handle 691. The lower rolling wheel base disc 60B2 and the lower rolling wheel seat 60B are fixedly connected and sleeved and fixed on the guide column 611. When the rotation handle 691 drives the gear input shaft to rotate, the upper rolling wheel seat post 60A1 is driven to move up and down through the torque amplifying gear group 69 and the screw nut 696. When the hollow cylindrical blank 40 is engaged and rotated by the rolling wheel 81, the radial rolling of the rolling wheel is completed. When the rolling wheel 81 is arranged so that its axial direction and the hollow blank have a deflection angle δ in the vertical direction (radial direction), the radial rolling becomes an axial radial mixing rolling. When the rolling wheel is a pre-forming rolling wheel with a cutting tool, the rolling head can also complete the cutting process of the hollow cylindrical blank.

The rolling head of FIG. 19 has a hole 601 and a number of pins (not shown) on the side end of the frame structure. The side end of the rolling head is connected to the hole on the roller carriage by the pins to form a floating connection, thereby achieving self-centering of the rolling module seat and the hollow blank, the pre-formed rolling wheel, preferably, adopts to a pre-formed thread structure.

Figure 20:
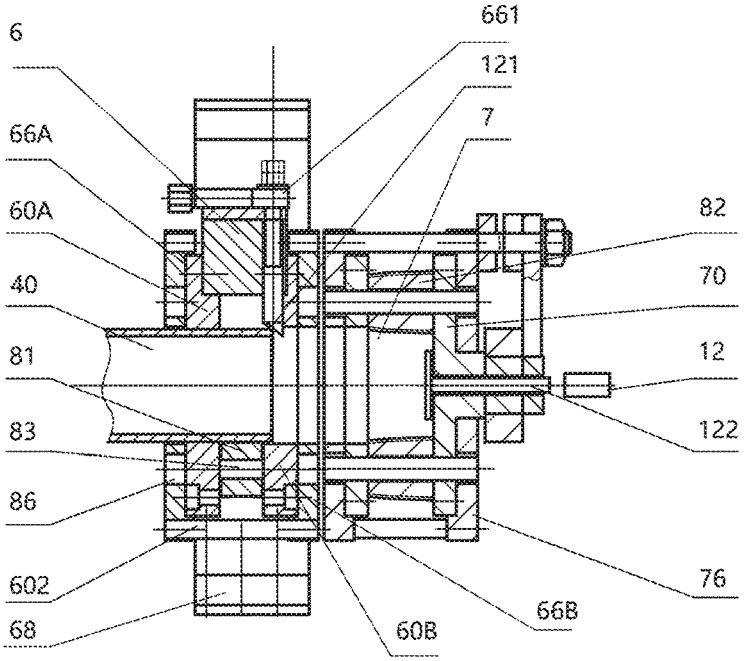
FIG. 20 is a schematic view of a rolling processing module incorporating a pre-forming rolling head and a pipe-thread forming rolling head of FIGS. 13 and 18 according to the present invention.

The self-centering design of the rolling head and the hollow blank of FIGS. 18, 19 and 20 by the floating connection of the shaft hole clearance between the rolling head and the shaft hole of the base actually solves the problem that the manufacturing and assembling precision of the apparatus and the hollow blank and the concentricity of the actual mounting of the blank, which is also crucial to the rolling. The size of the shaft hole clearance depends on the design and manufacturing precision of the device, preferably no more than +/−1 mm.

FIG. 33*a* is a schematic view showing the structure of the rolling head for rotating the rolling head by the worm wheel transfer power, FIG. 33*b* is a schematic view showing the structure of the worm with FIG. 33*a*, and FIG. 33*c* and FIG. 33*b* are further schematic structural views of the adjusting disc.

The structure of the rolling head in FIG. 33*a* is similar to that of FIG. 18, with first and second rolling plates, connecting pins, and the like. The structure of the rolling plate is similar to that of FIG. 11, and the mounting manners of the rolling wheel and the rolling wheel shaft are completely the same as those in FIG. 12 and will not be described again. The difference is that the center of the front rolling plate is not provided with other auxiliary or transmission means, so that the hollow blank can be axially rolled through the rolling head.

FIG. 33*b* is a perspective view of the rolling head of FIG. 33*a* including a worm or a gear 731, a power motor control device 21 and a power motor (not shown), one end of which is mechanically coupled to the output shaft of the power motor control device 21, and the other end in mechanical cooperation with the worm wheel or the gear 736, the power motor drives the worm or the gear 731 to rotate by the transmission device 21, and the pulsator or gear 736 drives the rolling wheel 70 to rotate.

FIG. 33*c* is a view of an embodiment of a rolling head further including the axial rolling of the adjusting disc according to FIG. 33*b*. The structure of the adjusting disc is similar to that of FIGS. 14 and 15, and the rolling wheel and the rolling wheel axle are mounted. It is exactly the same as FIG. 16 and will not be described again. The difference is that the center of the front adjustment disc is not provided with other auxiliary or transmission means, and the hollow blank can be axially rolled through the rolling head.

Figure 34:
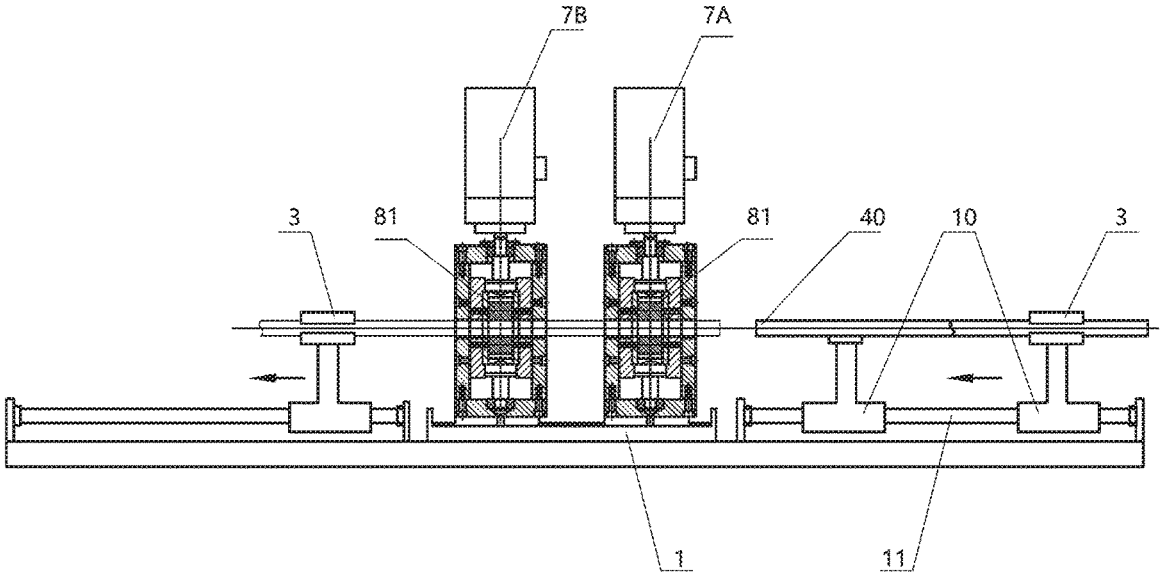
FIG. 34 is a schematic structure view of an embodiment of rolling head further comprising the axial rolling of the adjusting disc on the basis of FIG. 33 according to the present invention.

FIG. 34 is a block diagram showing an embodiment of a rolling head further including the axial rolling of the adjusting disc on the basis of FIG. 7 in accordance with the present invention.

While the invention has been described by the preferred embodiments, it will be apparent for one of the ordinary skills in the art that modifications to the described embodiment may be made without departing from the spirit or scope of the invention. Accordingly, it will be appreciated by those skilled in the art that various changes in form and details may be made therein without departing from the spirit of the invention. For example, the structure of the rolling head can also be properly arranged and modified according to the corresponding rolling head device involved in the following patents listed as follows: U.S. Pat. Nos. 5,699,691A, 3,058,196A, EP282889A2, U.S. Pat. Nos. 3,452,567A, 3,058,196A, US20060162411A1, JP10034270A, JP10244340A, JP2003126937A, JP9327742A, CN100542735C, CN2555962Y, CN103264128A, CN103286245A, SU1344479A1, US20120011912A1, U.S. Pat. Nos. 4,617,816A, 4,785,649A, 5,870,918A, GB1150525A, JP1273637A, SU703197A1.

5. One-Piece Rolling Processing Module for Forming Pipe Thread and the Corresponding Rolling Apparatus The pre-forming rolling head and the rolling head for forming pipe thread according to the present invention may be separate or combined into one body. When the two are combined into one, the process can be effectively saved, and the external pipe thread to be processed is formed by rolling sequentially. The overall design is more compact and convenient for transportation and installation.

FIG. 20 shows a schematic view of the structure of a rolling process module in which a pre-forming rolling head 6 and a rolling head 7 for forming pipe thread are combined into one body according to the present invention. On the left is a pre-forming rolling head 6 with five rolling wheels 81 and on the right-hand a rolling head for forming pipe thread 7 with four rolling wheels 82. Structure of the pre-forming rolling head 6 is similar to that of FIG. 18, and the pipe thread forming rolling head 7 adopts a rolling head structure similar to that in FIG. 13. Specifically, the radial grooves (71) in the rolling heads and the mounting surface of the rolling wheel (8) May be an inclined plane (703) or a conventional plane (as shown in FIG. 6 or FIG. 8). The specific structural design is not limited to the rolling head structure disclosed in the present invention. In addition, a relative rotational position angle detecting device 123 is provided between the rolling wheel and the adjusting disc of the pre-forming rolling head 6 and the pipe thread forming rolling head 7, and can be determined according to the variation of the blank diameter, the wall thickness and the materials and actual requirements of the pipe thread products. When the pipe thread product is required to reach the first step, the radial position of the rolling wheel of the pre-forming rolling head should be reduced to no more than 0.5 mm. When the pipe thread product is required to reach the third step, the radial position of the rolling wheel of the pre-forming rolling head should be enlarged by no more than 0.5 mm. The length of the pre-forming rolling surface controlled by the rolling time is equal to or greater than that of the pipe thread product, preferably greater by the pitch length of 1 to 3 teeth, more preferably the pitch length of 2 teeth. The pre-forming rolling head 6 and the pipe thread forming rolling head 7 are connected with each other by a pin to ensure that the pre-forming rolling head 6 and the pipe thread forming rolling head 7 are disposed coaxially with the hollow blank to be processed. The workpiece passes through the pre-forming rolling head, directly into the pipe thread rolling.

The hollow blank 40 enters the rolling head from the left and number reference 121 and 122 are used to mark the control adjusting rod of the photo-sensing device which controls the pre-forming rolling time and sequence. When the hollow blank 40 completes the pre-forming rolling, its head touches the control adjusting rod 121, the control adjusting rod 121 drives the photoelectric sensing device to work, and the adjusting disc 66 is started to turn in the reverse direction to disengage the hollow cylindrical blank from rolling wheel 81, to complete the pre-forming rolling and come into the right pipe thread forming rolling process. When its head contact the control adjusting rod 122, the photoelectric sensor device operate and start the adjusting disc 76 to rotate in opposite direction to open, so that the hollow cylindrical blank is disengaged from the rolling wheel 81, to complete the pipe thread rolling, and the process is similar to the foregoing, which are not repeated here.

Figure 21:
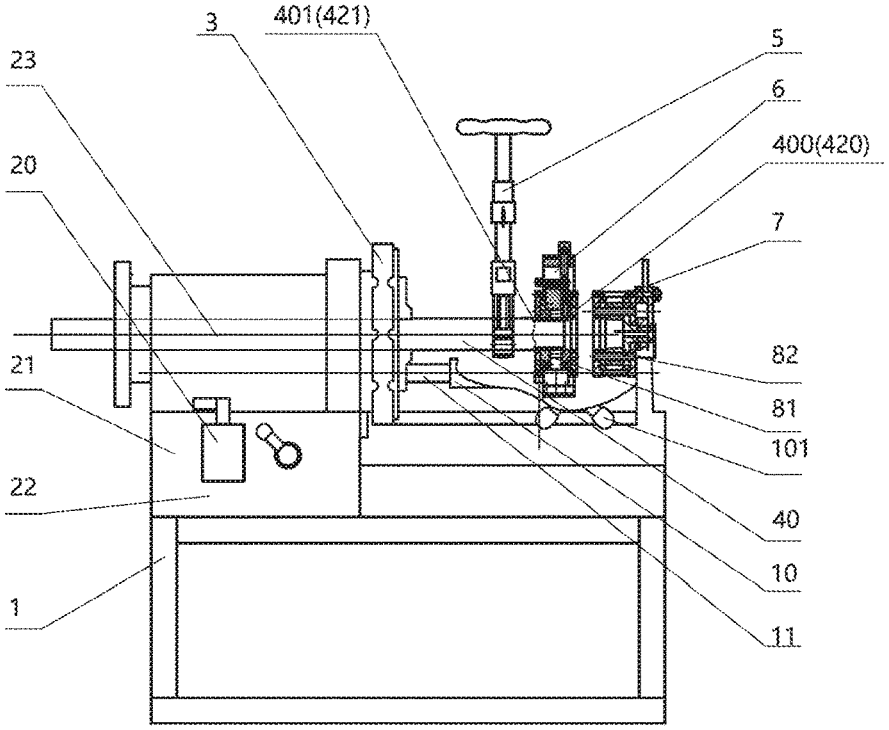
FIG. 21 is an embodiment of a pipe thread rolling machine including the rolling head shown in FIGS. 13 and 18.

FIG. 21 shows a schematic structural view of a single head pre-forming rolling and pipe thread forming rolling apparatus comprising a rolling head shown in FIGS. 13 and 18 with hollow blank rotating. Except for the design of the rolling head, the design of the other components is consistent with the single head pipe thread forming rolling device with the hollow blank rotating as disclosed in the patent WO2014056419A1. The main structure includes a base 1, a power motor 22, a work clamping device 3, a power motor control device 20, and a transmission 21 that couples the power motor to the hollow cylinder blank clamping device or the rolling head. The base 1 is provided with the power motor 22, the power motor control device 20 and the clamping device 3 for clamping the hollow cylindrical blank to be processed. Under the control of the power motor control device 20, the power motor 22 generates a relative rolling and rotational movement of the hollow blank 40 sandwiched by the rolling wheel and the clamping device 3 through the transmission device 21.

Figure 22:
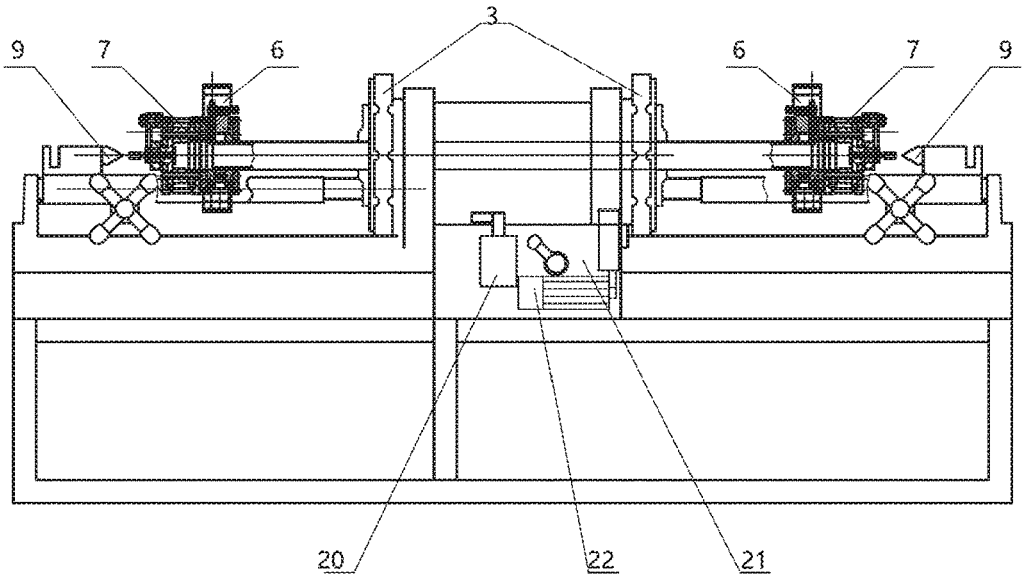
FIG. 22 is another embodiment of a pipe thread rolling machine comprising two groups of rolling processing modules in FIG. 20.

FIG. 22 is a schematic structural view of a double-headed external pipe thread rolling apparatus which includes two groups of integrated rolling process modules of FIG. 20. Left and right sides in the figure are provided hollow blank pre-forming rolling head 6 and the pipe thread forming rolling head 7. The axial and radial mode of operation of the left and right four rolling head, the basic configuration and function of the device is the same as that in FIGS. 20 and 21, which are not repeated here. According to the need, a chamfering device 9 can be provided to complete the chamfer function.

6. Rotary Rolling Processing Module and Rolling Apparatus

FIGS. 23~31 are distribution structures of four embodiments of the rotary rolling process module according to the present invention. The rolling head is driven to rotate by a power (servo) motor, through mechanical transmission such as a reduction gear box, a worm gear and the like. A pre-forming rolling head, a pipe thread forming rolling head, and other processing tools, such as a nozzle face chamfering machining tool, an inner space correction tool, a taper correction tools and thread surface grinding or heat treatment tools etc., are installed in the rolling head through the keyway 67 or 77 in FIG. 10 or FIG. 13. This processing method that a hollow blank is fixed, and the rolling head rotate is suitable for external pipe thread processing of long pipe, especially, it is very meaningful for the oil casing pipe external thread processing. In the casing of the oil pipe threading, the size control of the hole is very important. Thus, we can machine the conic surface by cutting the taper and then roll the pipe outside without rolling the cylinder or conical surface, and then roll the external pipe thread, without processing the cylinder surface or conical surface. The structure of the pre-forming rolling head and the pipe thread rolling head is similar to that shown in FIG. 13, which will not be repeated here.

Figure 23:
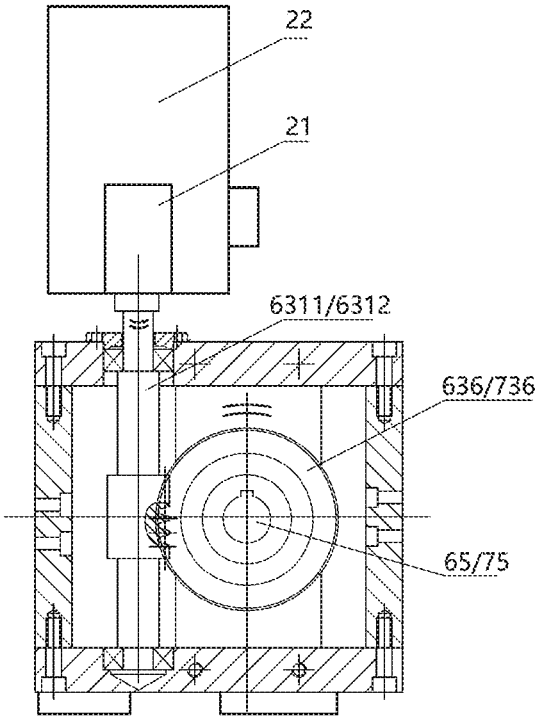
FIG. 23 is a schematic structure view of the rolling processing module including the rotary rolling head seat arranged in the front-to-back direction which is controlled by a single-power or multi-power motor of the rolling tool of FIG. 10 or FIG. 13.
Figure 23:
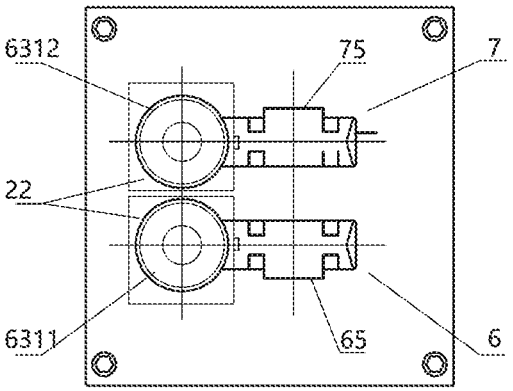

FIG. 23 is a schematic structural view of an embodiment of a rolling process module according to the present invention. The pre-forming rolling head and pipe thread forming rolling head in figure was arranged before and after. Two (servo) power motors 22 are respectively installed above the middle of the pre-forming rolling head and the pipe thread forming rolling head, and the rotational power is respectively transmitted to the front and rear two-side worm wheels 636 and 736 via the transmission device 21 and the worms 6311 and 6312, and the worm wheels 636 and 736 respectively drives the pre-forming rolling heads 6 (not shown in the FIG.) and the pipe forming rolling heads 7 (not shown in the FIG.) to rotate through the rolling head seats 25 and 75. It is also possible to install a (servo) power motor that controls the worm gear 636 and the 736 to transfer correction and the pipe thread forming rolling head via the worm gears 6311 and 6312, respectively.

Figure 24:
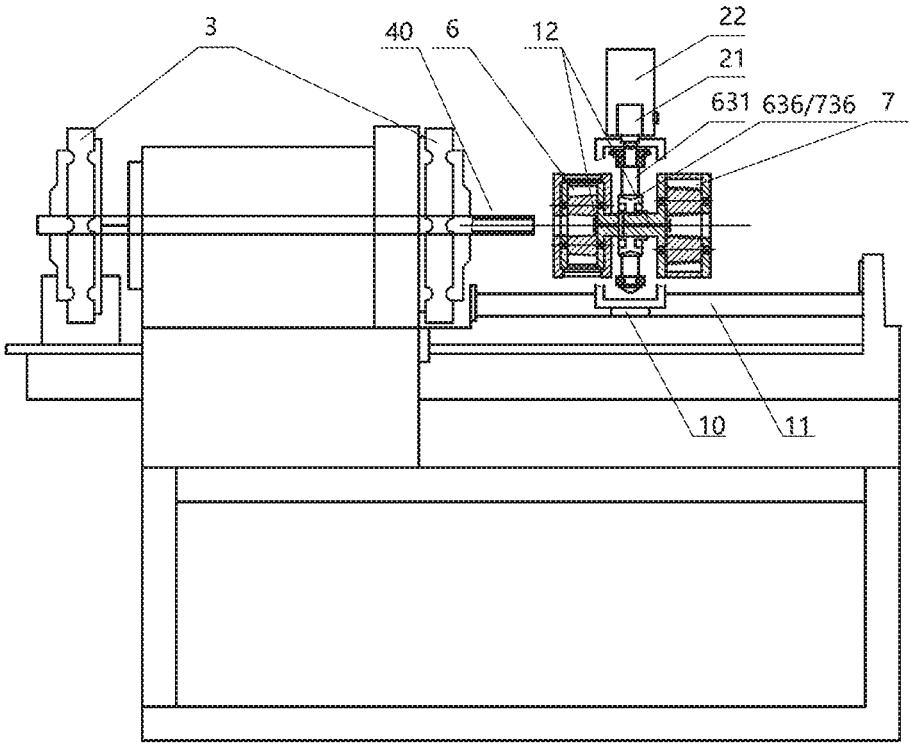
FIG. 24 is a schematic structure view of a rolling apparatus including the rolling processing module of FIG. 23.

FIG. 24 shows a schematic structural view of a pipe thread forming rolling device including the rolling process module of FIG. 23. The pre-forming rolling head and the pipe thread forming rolling head are arranged in a front-to-back arrangement. The power motor rotates the rolling head through the transmission 21 and the worm 631. When the motor 22 starts to work, the pre-forming rolling head 6 and the pipe thread forming rolling head 7 are driven to rotate by the transmission device 21, the worm 631 and the worm wheels 636 and 736, and the workpiece clamping device 3 installed in the sliding seat 10 is gradually axial fed to the left along the horizontal (left and right) parallel guide rails 11 under the action of rolling axial force, and perform rolling so as to complete the pre-forming rolling. The photo sensing device 12 control motor reversal, rolling head 6 exit, the workpiece clamping device 3 to the right axial exit to complete the pre-forming rolling station. Subsequently, manually turn the rolling head group 180 degrees, so that the pipe thread forming rolling head 7 come into the station, and the blank through pre-forming rolling is axially squeezed into the pipe thread forming rolling head 7 to complete the pipe thread axis forming rolling.

Figure 25:
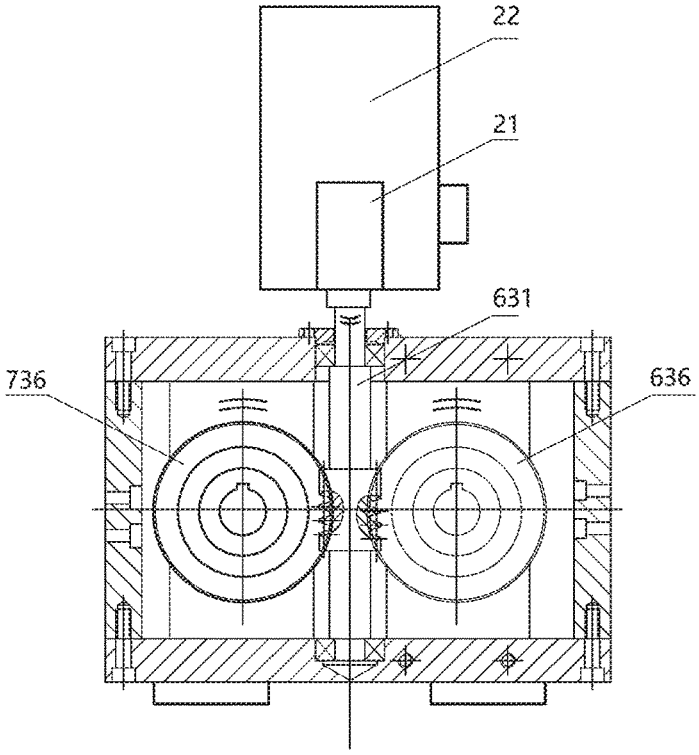
FIG. 25 is a schematic structure view of a processing tool wherein the rolling wheel head of a single motor arranged in parallel according to according to the present invention.
Figure 25:
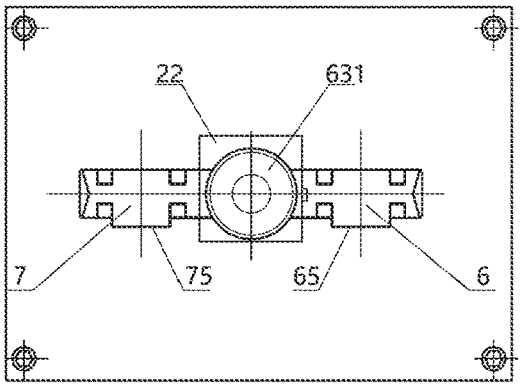

FIG. 25 is a schematic structural view of another embodiment of a rolling process module according to the present invention. Pre-forming rolling head and pipe thread forming rolling head in figure is left and right arranged. The power motor is meshed with gear 21 to decelerate and amplify torque output power. A (servo) power motor 22 is installed above the center of the pre-forming rolling head and the pipe thread forming rolling head, and delivers the rotational power to worm gears 636 and 736 on the left and right sides respectively via a transmission device 21 and a worm 631. The worm wheel 636 and 736, respectively, pass through the rolling head seats 65, 75 therein to rotate the pre-forming rolling head (not shown) and the pipe thread forming rolling head (not shown) mounted on the rolling head seat, respectively.

Figure 26:
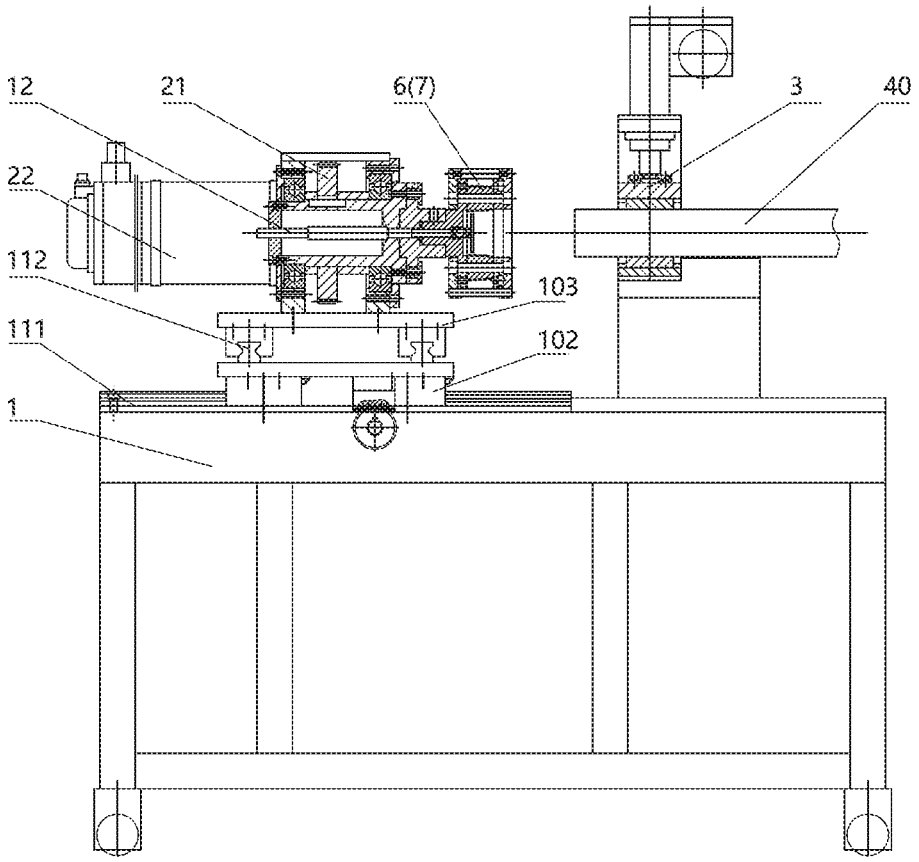
FIG. 26 is a schematic view of an embodiment of a rolling apparatus comprising the rolling head of FIG. 10 or FIG. 13 according to the present invention.
Figure 26:
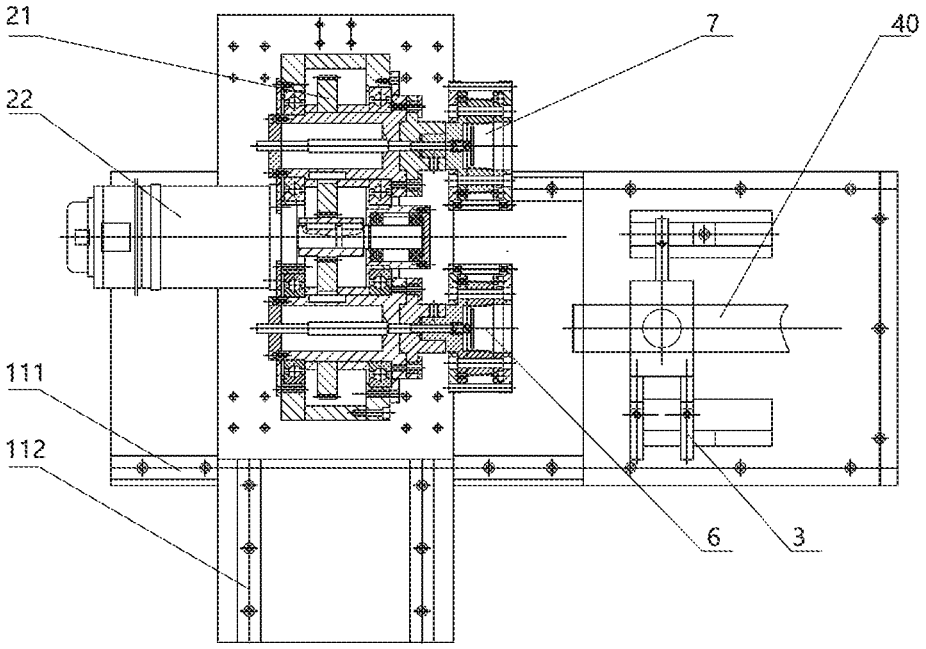

FIG. 26 is a schematic structural view of a pipe thread forming rolling device that includes another rolling process module of the rolling head shown in FIG. 10, FIG. 13, or FIG. 18. The two rolling heads 6 and 7 are arranged horizontally on the left and right. The hollow blank 40 is clamped and fixed by the work clamping device 3, in the first step, as shown in FIG. 26*b*, the pre-forming rolling head 6 on the sliding seat 103 moves forward along the horizontal front and rear plan guiding rails 112 until its axial center is concentric with axial center of the hollow blank, and then the pre-forming rolling head 6 moves axially along the right and left horizontal guide rail 111 to pre-forming station, using axial component to axial pre-forming hollow blank 40 to complete the pre-forming rolling, and the photoelectric sensor 12 control the motor reversal, and the rolling head 6 exit; In the third step, the sliding seat 103 moves along the horizontal front and rear plan guiding rails 112 so that the axial center of the rolling head 7 is concentric with the center axis of the pre-formed hollow blank 40, not shown in the figure. The rolling head 7 moves along the horizontal guide rail 111 to the rolling thread station, and use axial component to perform thread rolling process of the hollow blank, and finish pipe thread rolling, then the photoelectric sensing device 12 controls the motor reversing, and the rolling head 7 exit, the rolling process is completed.

The plane movement (front, rear, left and right) of sliding seats 102 and 103 may be performed numerically or manually. Photoelectric sensing devices can be installed on each process, such as pre-forming and thread rolling. The processing time and speed are controlled by control system and the spirit of the present invention. It should be pointed out that it is preferable to adjust the rolling wheel radial position according to the outer diameter of the steel blank, its non-roundness, wall thickness and material as well as the subsequent pipe thread requirements; Of course, the number of the rolling wheel in before and after process must be odd and even matching and the total number of rolling wheel, preferably, the pre-formed rolling wheel adopts an annular rolling wheel, while the external pipe thread forming rolling wheel is a thread rolling wheel.

Figure 36:
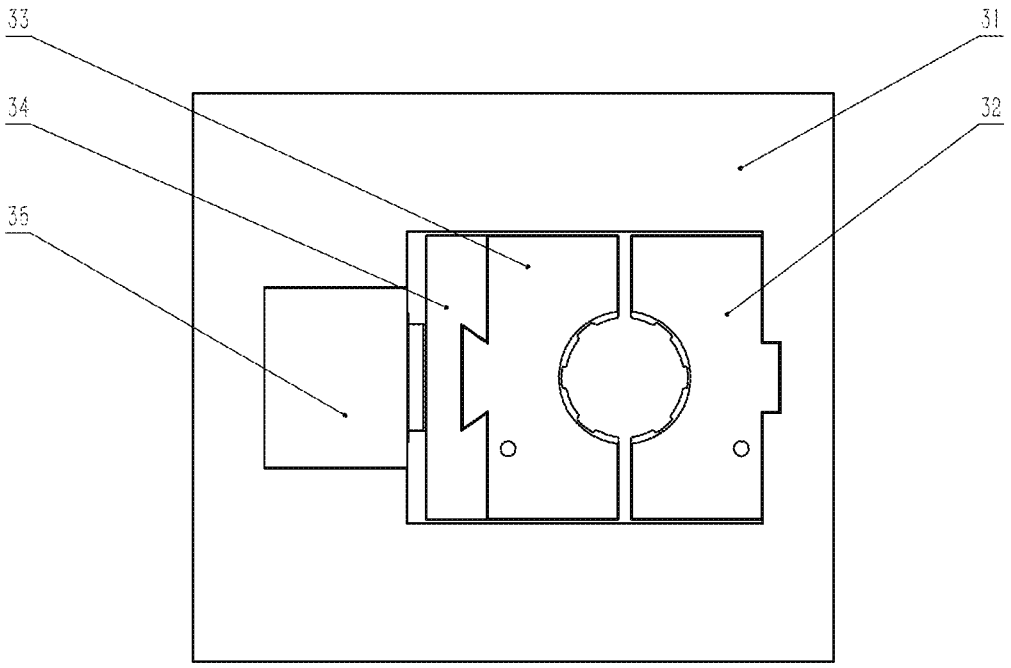
FIG. 36 is a clamping device that may be used in the external pipe thread rolling apparatus shown in FIG. 26 according to the present invention.
Figure 37:
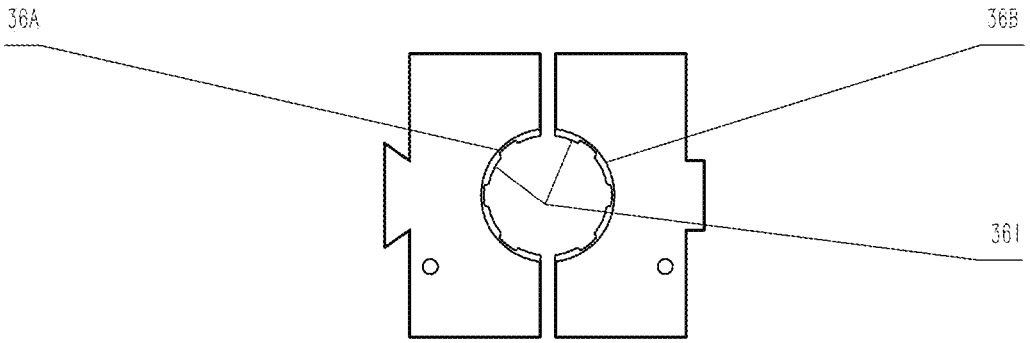
FIG. 37 is a schematic view of a semi-cylindrical inner cavity of a clamping die in the clamping device shown in FIG. 36.

The clamping device 3 shown in FIG. 26 may preferably be constructed as shown in FIG. 36 for threaded rolling of pipes with protective coatings, and is composed of a power device 35, a first clamping die seat 34, a first clamping die 33, a second clamping die 32 and a clamping frame 31;

The power device 35 is mated with the first clamping die seat 34; the first clamping die 33 is mounted and fixed on the first clamping die seat 34; the power device 35, the first The clamping die seat 34 and the first clamping die 33 are mounted on one side of the clamping frame 31; the second clamping die 32 is mounted on the other side of the clamping frame 31;

And the first clamping die 33 and the second clamping die 32 are respectively provided with a first semi-cylindrical inner cavity 36A and a second semi-cylindrical inner cavity 36B at opposite positions, preferably, the first half the inner surfaces of the cylindrical inner cavity 36A and the second semi-cylindrical inner cavity 36B each have at least two convex circular arcuate bodies 361, and the curvature of the circular arcuate body 361 is substantially the same as the curvature of the pipe to be clamped.

Under the action of the power device, the first clamping die seat 34 can move the first clamping die 33 and close it with the second clamping die 32 to clamp the pipe.

The power device is preferably a hydraulic system.

The working principle is: inserting the pipe fitting into the first clamping die and the second clamping die, opening the hydraulic pump, pushing the first clamping die seat to drive the relative clamping pressure of the first clamping die and the second clamping die by the action of the cylinder, the opposite pipe fittings secure the pipe. Since the surface of the clamping die contact pipe is a circular arc surface, and the pipe member is in surface contact, the joint area is maximized, and three convex grooves are formed on the circular arc surface of the mold (four arc-shaped bodies are formed). The force of the clamp die and the pipe area is more uniform, and a small arc at the corner of the groove acts as a protective coating transition. In the process of thread rolling the coated pipe, the rolling work is ensured and the coating is not damaged.

Figure 32:
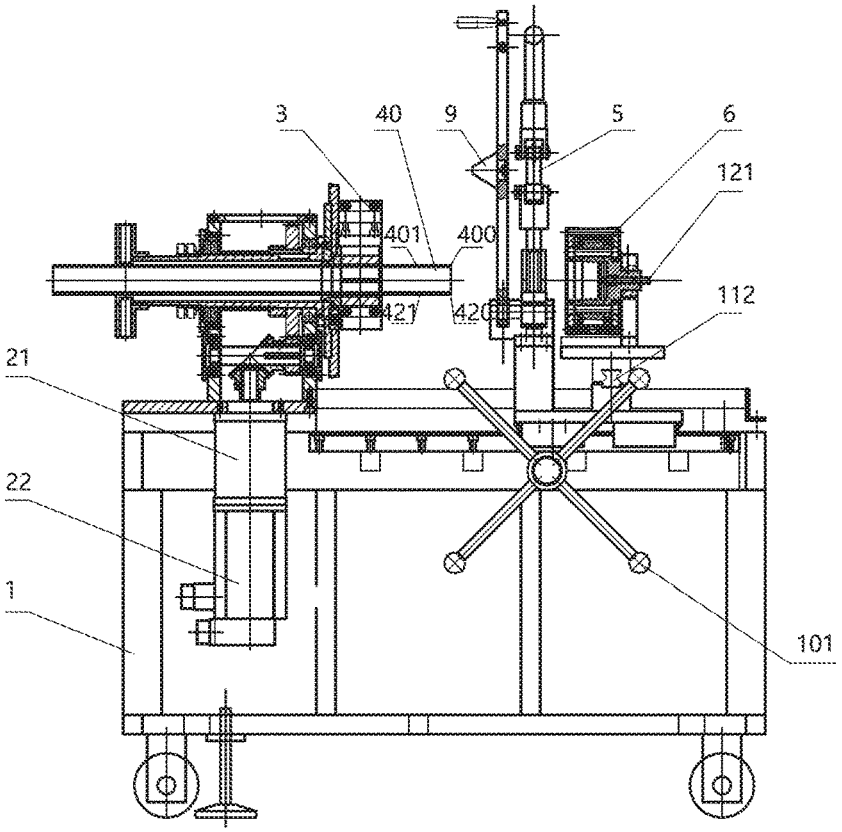
FIG. 32 is a schematic structure view of another rolling processing module with a rolling head seat having an L-shaped arrangement controlled by single power motor according to the present invention including the rolling head of FIG. 10 or FIG. 13.
Figure 32:
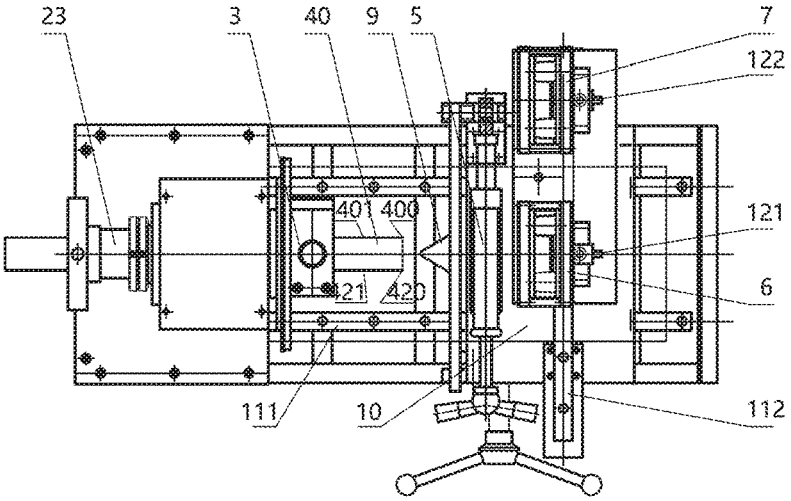

Referring to FIG. 26, FIG. 32 is a schematic view showing the structure of a pipe thread forming rolling apparatus including a rolling processing module of the rolling head shown in FIG. 10 or 13 or 18. FIG. 32*a* is a front view of the device and FIG. 32*b* is a top view of the device. The two rolling heads 6 and 7 are arranged horizontally left and right with the sliding seat 10. The hollow blank 40 is clamped and fixed by the clamping device 3. In a first step, as shown in FIG. 32*b*, the preformed rolling head 6 on the sliding seat 10 is moved forward along the horizontal front-back planar guiding rails 112 to its axis and hollow core axis. Concentric, then the preformed rolling head 6 is axially moved along the horizontal left and right plan guiding rails 111 to the pre-forming station, and the axial blanking force is used to start the axial pre-forming of the hollow blank 40 to complete the preforming rolling, and the photoelectric sensing device 121 controls the motor. Inverting, the rolling head 6 is withdrawn; in the second step, the sliding seat 10 moves along the horizontal front and rear plan guiding rails 112 to align the axis of the rolling head 7 with the axial center of the preformed hollow blank 40, at the end of the figure, the rolling head 7 moves along the horizontal left and right plan guiding rails 111 to the rolling screw station, and uses the axial component force to perform thread rolling processing on the hollow blank to complete the pipe thread rolling, the photoelectric sensing device 122 controls the motor to reverse, and the rolling head 7 exits to complete the whole rolling process.

The planar motion (front, rear, left and right) of the sliding seat 10 can be performed by numerical control or manual. Photoelectric sensing devices can be mounted on each of the processes, preformed and threaded, and the processing time and speed are controlled by the control system and the spirit of the present invention. It should be noted that it is preferred to use a rolling head whose radial position can be adjusted, and adjust the radial position of the rolling wheel according to the outer diameter of the steel tube blank, its nun-roundness, wall thickness and material, and the requirements of the subsequent pipe thread; of course, the number of rolling wheels in the front and rear processes must be evenly matched with the total number of rolling wheels. Preferably, the preformed rolling wheel uses an annular rolling wheel, and the externally thread forming rolling wheel uses a thread rolling wheel.

Figure 27:
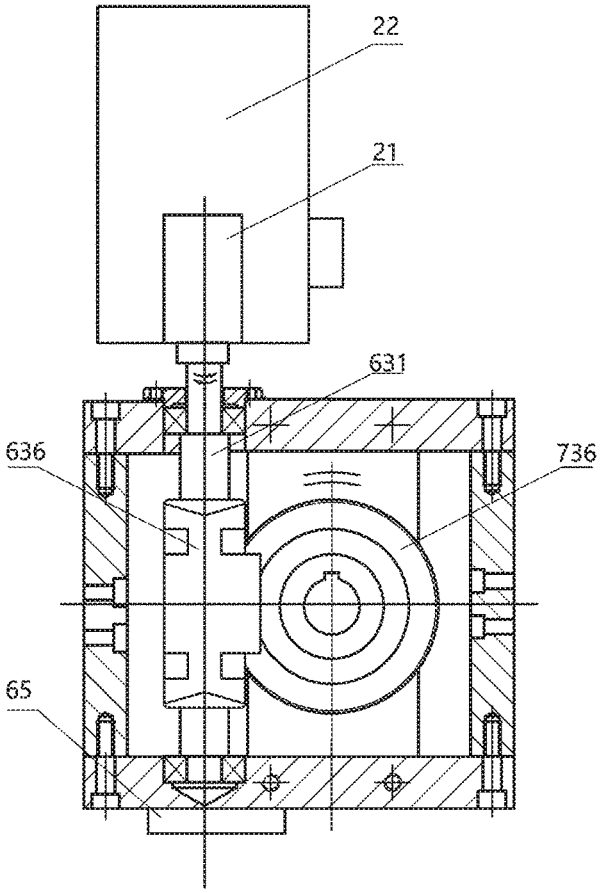
FIG. 27 is a schematic structure view of a rolling processing module with a rolling head seat having an L-shaped arrangement controlled by single power motor according to the present invention including the rolling head of FIG. 10 or FIG. 13.
Figure 27:
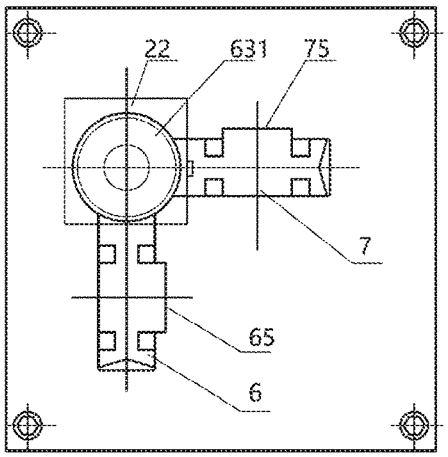

FIG. 27 is a schematic structural view of still another embodiment of a rolling process module according to the present invention. The pre-forming rolling head and pipe thread forming rolling head in figure is L-shaped configuration. A (servo) power motor 22 is mounted above the pre-forming rolling head and the pipe thread forming rolling head and transmits rotational power to two groups of the worm gears 636 and 736, respectively, through the transmission device 21 and the worm 631, and then worm gears 636 and 736 pass through the rolling head seats 65, 75 therein to respectively drive the pre-forming rolling head (not shown) and the pipe thread forming rolling head (not shown) mounted on the rolling head seat to rotate.

Figure 28:
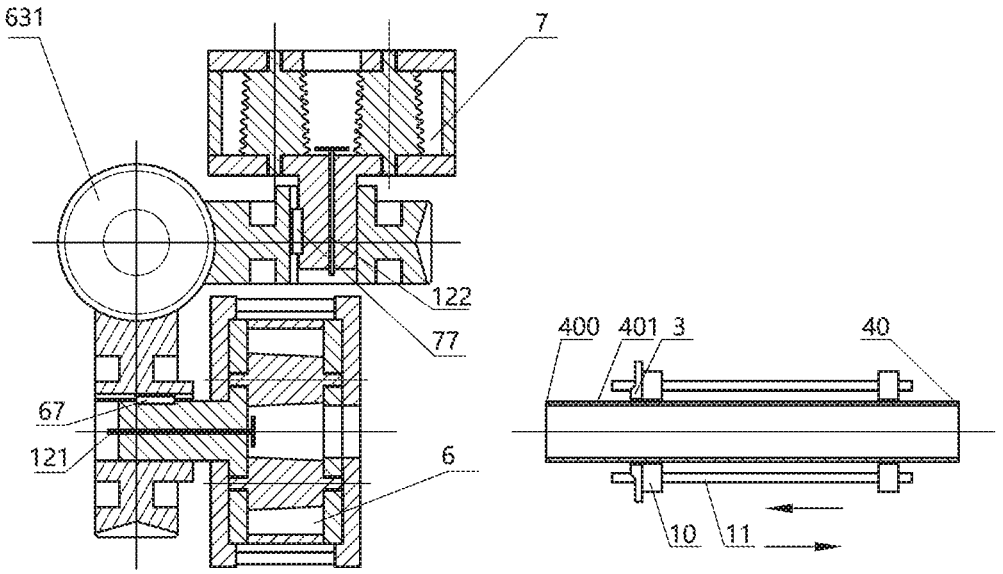
FIG. 28 is an embodiment according to FIG. 27.

FIG. 28 is a further illustration of pre-forming cylindrical blank using the rolling head in L-shaped arrangement of FIG. 27. The movement of the cylindrical blank workpiece and feeding method of rolling head is similar to the foregoing, which will not be repeated here.

Figure 29:
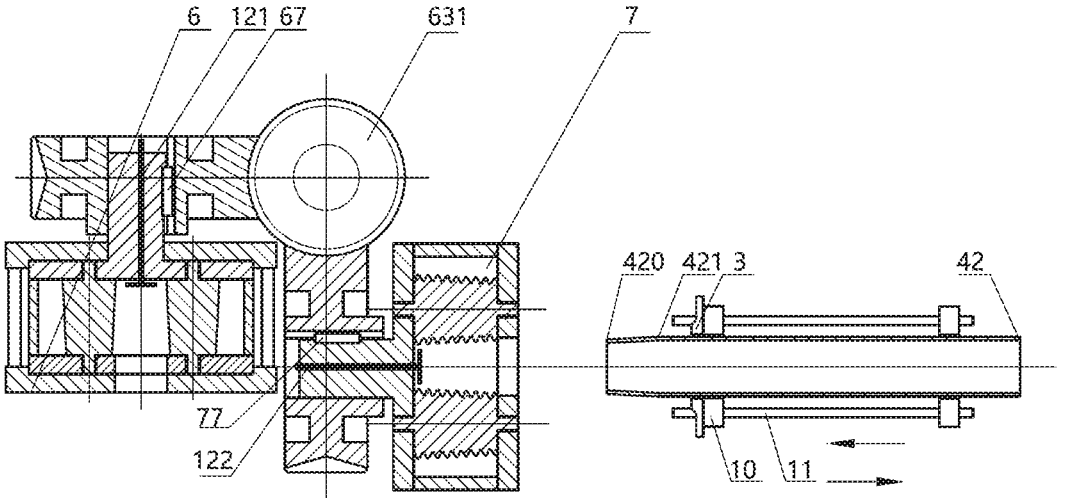
FIG. 29 is a schematic view of the subsequent processing of FIG. 28.

FIG. 29 is an explanatory view of the pipe thread further processed in FIG. 28. When the pre-forming rolling is completed, the rolling head group is rotated by 90 degrees under the action of external force and the pipe external thread processing is continued. The movement of cylindrical blank workpiece and feeding method of rolling head is similar to the foregoing, which are not repeated here.

Figure 30:
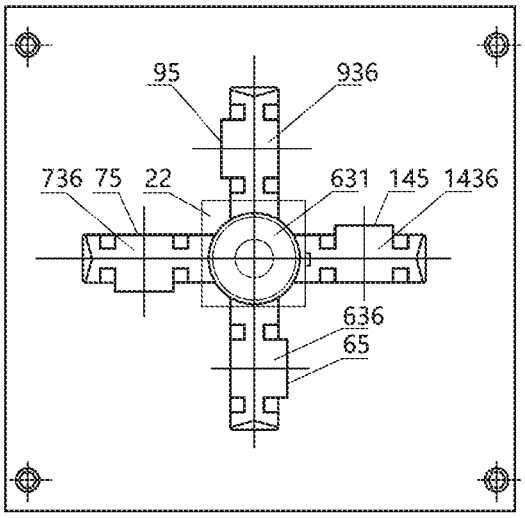
FIG. 30 is a top view of a rolling apparatus having a cross distribution of the rolling head of FIGS. 10 and 13 and other processing apparatus in accordance with the present invention.
Figure 30:
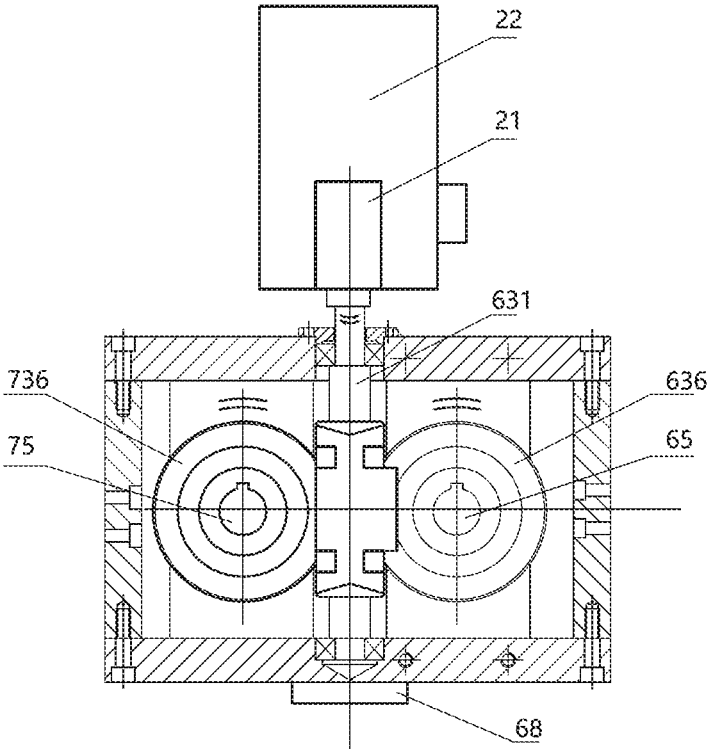

FIG. 30 is a schematic structural view of still another embodiment of a rolling process module according to the present invention. The pre-forming rolling head, pipe thread forming rolling head and other processing group was arranged in a cross shape. A (servo) power motor 22 is mounted above the center of the pre-forming rolling head, pipe-thread forming rolling head and other process groups, transmitting the rotational power to the four-sided worm wheels 636, 736, 936, and 1436 through the transmission 21 and the worm 631, respectively. The worm wheels sequentially drive the pre-forming rolling head (not shown) mounted on the rolling head seat through their respective rolling head seats 65, 75, 95 and 145, respectively (Not shown) and pipe thread rolling head to rotate, and subsequent auxiliary machining tools (not shown in the figures, which can be hole, cylindrical, taper or thread surface machined, etc.) to work. The working principle of the auxiliary machining tools is similar to the existing well-known technology and will not be repeated here. Under action of external force, the rolling head group rotates 90 degrees each time, and perform a variety of processing, such as: bore correction 14, end surface processing 15, thread induction heat treatment, thread grinding and thread coating processing, and so on, and its work method is similar to the prior art, the and the method that the processing tools are installed on the rolling head seat 1436 and 1536 are in the same manner as described above, which will not be repeated here.

7. Pipe Thread Forming Rolling Production Line

Figure 31:
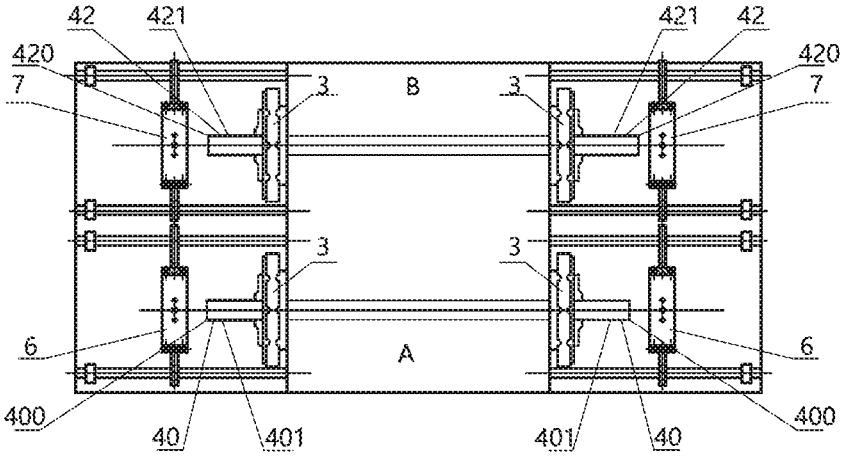
FIG. 31 is a top view of the structure of rolling line for a double-ended conical external pipe thread including the rolling head of FIG. 10, 13, 18, or 20 according to the present invention.

FIG. 31 is a schematic structural view of a double-ended conical pipe thread forming rolling production line according to the present invention.

Left and right sides of the figure are arranged the hollow blank pre-forming rolling head 6 and pipe thread forming rolling head 7 before and after respectively, which separated the pre-forming rolling and pipe thread forming rolling as A station and B station. When the hollow blank 40 is locked and rotated at a set rotational speed by a power motor (not shown), the two left and right first pre-forming rolling head 6 respectively start to pre-forming rolling at 400, i.e. the initial part of the pipe thread to be processed, and then perform thread rolling from the outer to the position 401, i.e. the tail of the pipe thread to be processed, so as to complete the first pre-forming rolling, and the workpiece is released, the pre-forming rolling head 6 to exit outward. The robot arm moves the workpiece from the A station to the B station, and lock them again and rotate it by the power motor (not shown) at the set rotation speed. The pipe thread forming rolling head 7 are respectively start circle correcting rolling at 420, i.e. the initial part of the pipe thread to be processed, and then perform thread rolling from the outer to the position 421, i.e. the tail of the pipe thread to be processed, so as to complete the first pre-forming rolling again, and the workpiece is released, the pipe thread rolling head 7 to exit outward. The robot arm moves the external pipe thread product from the station B to the next station, and rolling process for the double cone external pipe thread product is completed. It can also achieve rolling external pipe thread product when changing the pre-forming rolling process into stamping or extrusion process in station A, but the process and product defects have been described above, which will not be repeated here.

Figure 35:
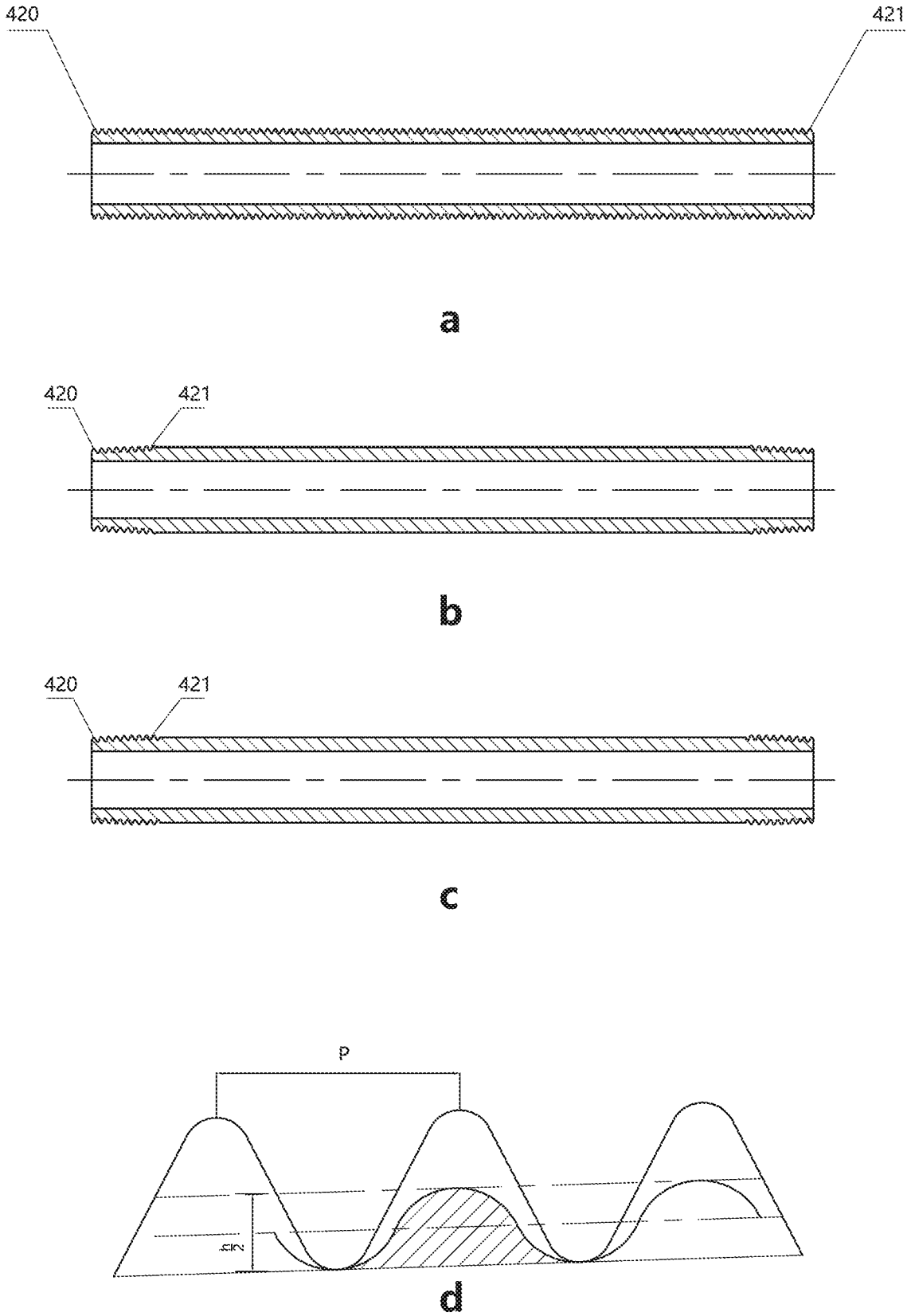
FIG. 35 is a view of the pre-formed product that produced by the method, the rolling head, apparatus, module and production line according to the present invention.

8. Preformed Pipe Thread Product Produced by the Method, Rolling Head, Module, Apparatus and Production Line Thereof of the Present Invention FIG. 35 is a preformed product produced using the method, rolling head, module, apparatus, and production line thereof of the present invention. FIG. 35*a* is a cylindrical preformed pipe thread product, FIG. 35*b* is a conical pre-formed pipe thread product, FIG. 35*c* is a cylindrical conical hybrid preformed pipe thread product, FIG. 35*d* is FIG. 35*a*, FIG. 35*b* and FIG. 35*c* is a partial schematic view of a sinusoidal thread profile. The illustrated outer surface thread has the same pitch as the subsequent external pipe thread forming portion, and the outer surface thread has a higher depth of thread than the outer diameter of the external pipe thread forming portion. Further, the pre-formed thread has a profiled cut. The thread profile (hatching portion) does not exceed the profile cross-sectional area of the external pipe thread forming portion, and further, the preformed thread is illustrated as a sinusoidal thread. The pre-formed rolling thread product has a surface roughness Ra of less than 0.125, a surface hardness of 20% to 100%, and a non-roundness of 10% to 50%. For a galvanized pipe, the surface zinc layer is intact.

9. The External Thread Pipe Processing Embodiment of the Present Invention

The following use the site installation of gas industry commonly used gas-specific galvanized welded pipe with specifications DN32, a length of 6000 mm, a wall thickness of 3.5 mm, non-roundness of 150 um, material Q235 as an example, and reference FIGS. 1, 3, 5, 20 and 32 to compare the existing external thread rolling pipe process, to describe the above-mentioned objects, technical solutions and beneficial effects of the present invention in further detail.

According to the existing national standard "low pressure fluid delivery welded steel pipe" (GB3091~2008) DN32 gas-specific galvanized steel pipe 423 with an outer diameter of 42.4 mm, an ordinary wall thickness of 3.50 mm, and an non-roundness of less than 500 um. According to the existing national standard «55° sealed pipe thread» (GB/T7306.1~2000), the DN32 pipe thread depth of thread is 1.479 mm, the pitch is 2.309 mm.

As shown in FIG. 1*a*, the existing external pipe thread rolling process adopts a large-tonnage axial punching device to first process a 1:16 conical surface 425; as shown in FIG. 1*c*, the pipe thread forming rolling wheel 80 is then used to perform initial rolling from the pipe port 420, i.e. the initial part of the pipe thread to be processed, and then perform axial rolling process toward the position 421, i.e. the tail 461 of the pipe thread to be processed, so as to complete the process of the external pipe thread product 46. This rolling process must have a large tonnage of axial stamping or radial extrusion apparatus, dedicated to the processing of the conical surface 425. At the same time, when the pressing or extrusion pressure is used to form the conical surface, the pipe material, especially the welded pipe weld 461 at the intersection of the original outer diameter 423 of the steel pipe and the conical surface, causes recessive and dominant damage to the rolling external pipe thread products and leave security risks.

Or we use the method of cutting the conical surface shown in FIG. 1*b*, and the conical surface 425 is machined by the cutting blade 91 in the outer chamfering device 9, with the result that the surface galvanized layer is completely cut and the thickness of the hollow blank is thinned and lost many advantages of the rolling pipe thread, while the processing tools demanding is very high and the processing is difficult.

We also test using three rolling wheels to perform diameter reducer and taper roller as a pre-roll process and the results is that the steel pipe blank has a triangular shape, and its irregularity increased from 150 um to 650 um or so, an increase of about 225%, beyond the national standard 500 um about 30%. Then, three pipe thread rolling wheels is used to perform rolling, and the rolling results shows more obvious triangular pipe thread, and non-roundness is further increased, obviously it is waste; or four pipe thread rolling wheel is used to perform rolling, the rolling still shows triangle circular pipe thread, and the non-roundness of the thread outer diameter is greater than 2 mm, and apparently it is waste.

In order to solve the aforesaid problems, as shown in FIGS. 3*b*, 5*b*, 5*d*, 20 and 21, the hollow blank 40 is manufactured by the pre-forming method of the present invention by using a conical pre-formed thread rolling wheel 81, so as to perform conical pre-forming rolling, depth of thread. The material of the hollow blank is Q235, which belongs to medium-low-carbon steel. According to the spirit of the present invention, making the depth of thread 0.5 mm, pre-formed thread with a thread pitch of 2.309 mm in standard, and at the same time partially release the residual stress during the production of steel pipes. The taper of pre-forming conical surface 425 is 6. As shown in FIG. 32, the rolling head 6 is used to start pre-forming rolling at 400, i.e. the initial part of the pipe thread to be processed 420, and then using the axial component force generated by the deflection angle of the rolling wheel 81 on the rolling head 6 and the hollow blank 40 during the rolling process caused to perform axial pre-forming rolling so as to form the conical surface 425 of a special spiral line with a pre-formed thread and a circular arc connected to the arc.; afterwards, the blank formed with the conical surface 425 enters the axial pipe thread forming rolling process. As shown in FIG. 5*b*, the rounding correction and external thread forming process are produced under the action of the rounding correction external pipe forming rolling wheel 82. The hollow blank 40 with standard D32 steel pipe external outer diameter forms an acceptable external pipe thread at 480 and 481. Due to adopting the same apparatus and the same direct method of power motor, the structure of the apparatus is greatly simplified and portable, laying a foundation for the popularization of rolling process for external pipe thread. At the same time, due to the rejection of the stamping process and apparatus, the recessive and dominant failure of the pipe welds on the pipe material, particularly at the intersection of the standard pipe outer diameter and conical surface, is avoided, and greatly reduces the potential safety hazard caused by the existing rolling technology. At the same time, the problem that galvanized coating is damaged and the steel pipe is thinned, and other issues, is avoided, and the rolling failure caused by deformation of hollow blank due to the conical surface of the radial three rolling wheels or diameter reduced into a cylindrical surface is also avoided.

The specific processing steps will be described in further detail below with reference to FIG. 32. Firstly, DN32 of the aforementioned standard steel pipe outer diameter blank 40 is placed in the clamping device 3 and clamped, the power motor control device is opened to rotate the hollow blank 40, and the floating rolling material cutting device 5 is manually fed according to the process in radial direction, roll and cut off the hollow blank 40 from length of 6000 mm to the desired length of 2750 mm, manual rotate in opposite direction and loose the rolling material cutting device 5, and turn off the power motor control device, so as to complete the processing in the cutting station. The pre-forming rolling device 6 is manually fed axially by the crank handle 101 to the machining position 400 which is the position of the initial part 420 of the external pipe thread to be processed. The rolling wheel 81 in the floating pre-forming rolling device 6 is moved by hand to axially contact processing position 400 for the hollow blank 40. The hollow cylindrical blank 40 is guided in and was axial pre-forming rolling fed using the deflection angle between the pre-forming rolling wheel with pre-formed thread conical surface and the hollow blank 40. After the pre-forming rolling, that is, when the rolling wheel reaches the tail portion 401 of the hollow blank, the photoelectric sensing device controls the adjusting contact rod 121 to work and the motor rotates in the reverse direction, and then manually moves the radial position control rod on the pre-forming rolling control panel (not shown), so that the rolling wheel 6 in the pre-forming rolling device is separated from the hollow blank 40, horizontal radial sliding seat 10, and push the forming rolling floating device 7 to the working station, and then manually move the rolling wheel 82 in pipe to axial contact with the processing position 420 of conical blank 40. The conical blank is guided in and axially fed to correct round and pipe thread forming rolling via the deflection angle between the pre-forming rolling wheel with smooth conical surface and the hollow blank 40. After the pipe thread forming rolling is completed, that is, when the rolling wheel reaches the tail portion 421 of the hollow blank, the photoelectric sensing device controls the adjusting contact rod 121 to work and the motor rotates in the reverse direction, and then manually moves the control rod on the pipe thread forming rolling control panel (not shown), so that the rolling device is separated from the pipe thread product, and the rolling process is completed. In the process of pipe external thread rolling, according to the rolling process needs, the floating chamfering device can be used together.

In combination of and comparing FIGS. 1 to 8 and FIG. 32, it is obvious of the difference between the method for manufacturing the external pipe thread product, the rolling head and device thereof of the present invention and the method for manufacturing external pipe thread product, rolling head and device thereof in the prior art, and the beneficial effects is as follows: wider applicability, product qualification rate greater than 99%, and the processing step similar to the current 100% using process of cutting threading in site, the processing device simple and light, comply with people's current habits, and easy to promote a large number of use.

In the following, take the gas-specific galvanized pipe pre-formed pipe thread DN20 of the gas industry as an example, whose length is 1000 mm, the wall thickness is 2.8 mm, the non-roundness is 120 um, and the material is Q195. In combination with FIGS. 3*a*,33,34 and 35, the foregoing objects, technical solutions and advantageous effects of the pre-formed threaded product produced by the method, rolling head, apparatus, rolling module and production line thereof of the present invention are further described in detail.

Figure 33:
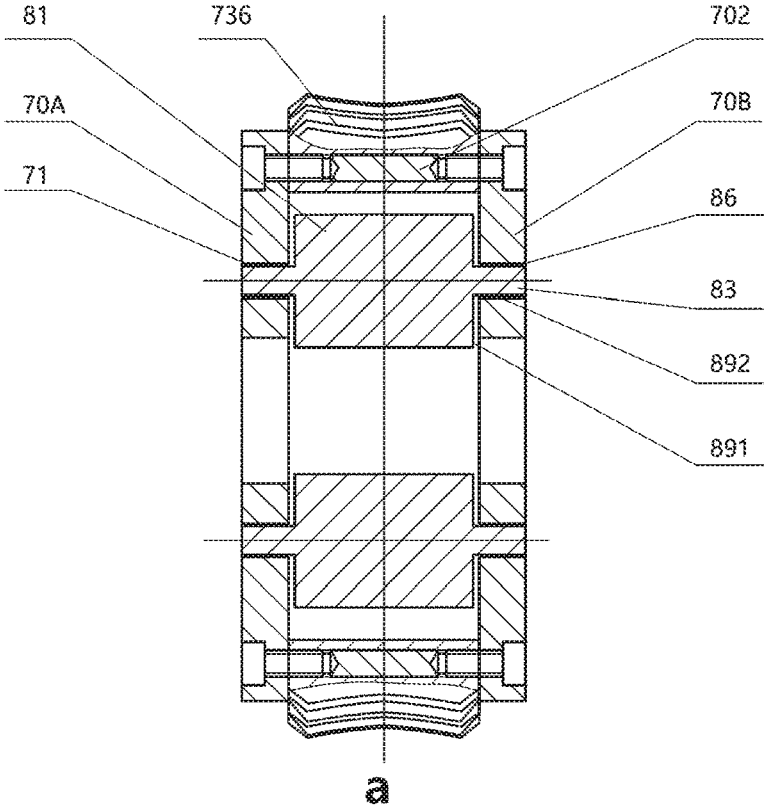
FIG. 33 is a schematic structure view, which shows the structure schematic diagram of the rotated rolling head through the worm gear and the worm to transmitting the rotating power in accordance with the present invention.
Figure 33:
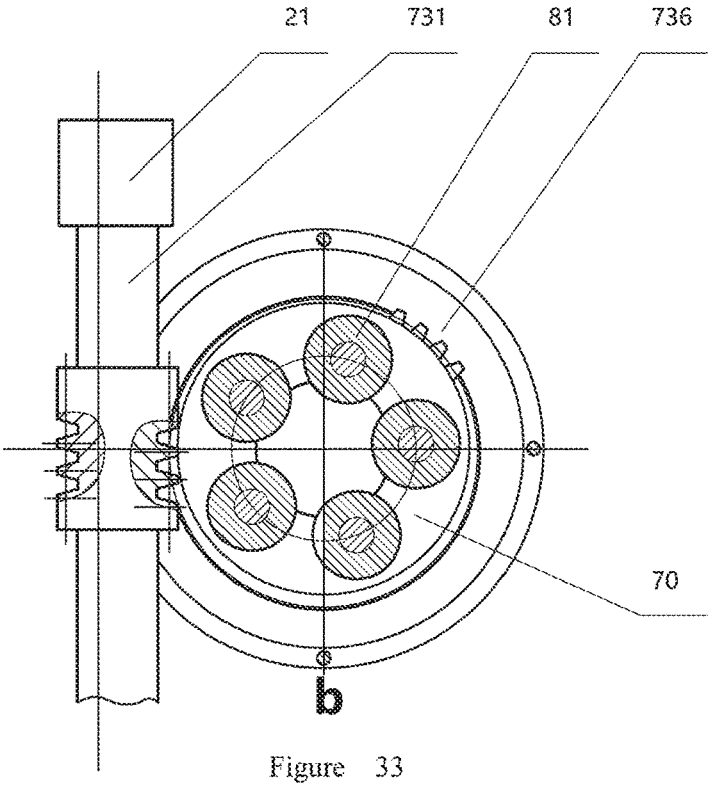
Figure 33:
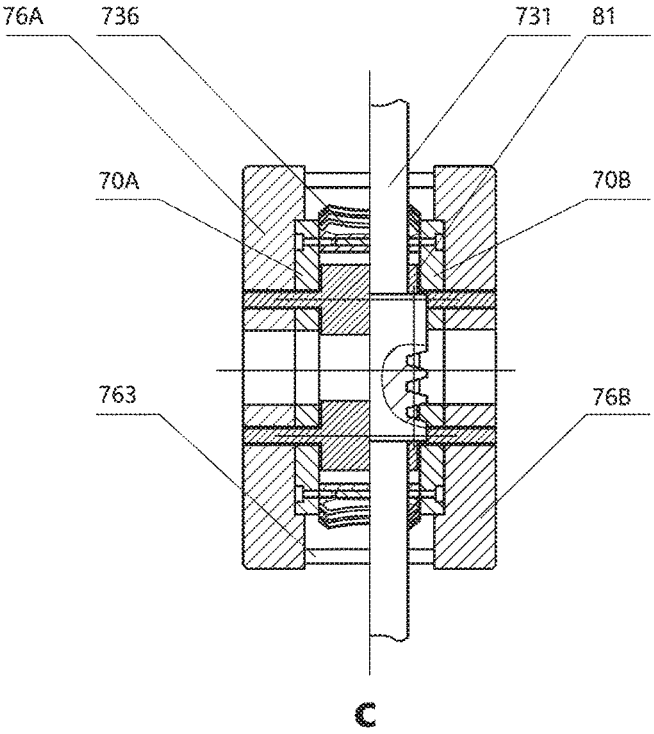

In order to solve the problems of the preformed forming process, reduce the thread processing process at the construction site, and improve the construction efficiency, as shown in FIGS. 3*a*, 33 and 34, the hollow blank 40 is pre-formed by the preforming rolling method of the present invention, using a pre-formed thread cylindrical rolling wheel 81 to cylindrical pre-formed rolling. The material of the hollow blank is Q195, which belongs to medium and low carbon steel. The depth of thread of the external pipe thread of the national standard 55° DN20 is 1.162 mm, according to the spirit of the present invention, the thread depth of thread of the preformed pipe is 0.4 mm, but the pitch is the same, so that the forming depth of thread of the hollow blank is 0.4 mm, and the pitch is the standard pitch. 1.162 mm sinusoidal thread, while partially releasing the residual stress in the production of steel pipes. As shown in FIGS. 34 and 35*a*, the rolling head 7A is pre-formed and rolled from the hollow blank head portion 420 which is also to be processed at 400, and the deflection angle of the rolling wheel 81 and the hollow blank 40 on the rolling head 7 is utilized. The axial component generated during the rolling process is axially rolled at 401, that is, the hollow blank tail portion 421 is rolled to form a cylindrical surface of a special spiral line with an arc of a sinusoidal thread connected to the arc. During the pre-forming rolling process, when the rolling wheel gradually contacts the hollow blank, the original residual curvature range of the (steel pipe) hollow blank is gradually reduced and the residual stress of the hollow blank, so that the cross section of the rolled portion of the hollow blank is irregular. The polygonal roll is formed into a controllable cylindrical body which still has a certain degree of ellipticity, and the regular blank conforms to the subsequent external pipe thread rolling requirements. Using the product as said, a 1 m long preformed pipe thread blank produced in the factory standard, which can be cut at the site according to the construction needs, and the external pipe thread rolling process is directly performed, omitting the two described in FIG. 32. The preformed pipe thread is rolled in the secondary rolling method. Since the preformed thread rolling is directly related to the quality of the subsequent external pipe rolling, it is equivalent to controlling the production quality of the subsequent external pipe thread and achieving quick installation. As shown in FIG. 34, according to actual needs, a 7B rolling head or a 7B rolling head can be used for secondary preforming rolling.

While the invention has been described by the preferred embodiments, it will be apparent to one of the ordinary skills in the art that modifications to the described embodiment may be made without departing from the spirit or scope of the invention. Accordingly, it will be appreciated by those skilled in the art that various changes or replacement in form and details may be made therein without departing from the spirit of the invention, and is not limited by the rolling method and direction, the length of the pre-formed rolling wheel, the number and installation form of the rolling wheel, the number and installation form of the rolling head, the rolling times and rolling methods, the radial and axial movement of the rolling wheel seat, and the like.

For example: the cutting point of pre-forming rolling wheel and pipe thread forming rolling wheel can be start from the thread head of the external pipe thread, and it can be from the tail of the effective thread or full thread or other non-threadable end of the full thread to start rolling cut toward the thread head to complete the thread rolling.

Each rolling head can be arranged horizontally or vertically.

Depending on the outer diameter of the blank, the wall thickness, the material and the non-roundness, and the depth of thread, the pitch of the preformed thread may be less than 30% of the pitch of the external pipe threaded rolling wheel.

When the rolling wheel is not completely radially fed into place and axially rolled, we can equate that the rolling wheel on the rolling head is actually an incomplete thread, or the rolling wheel with a depth of thread which lower than the designed one.

In particular, when the steel pipe blank is finished by using the existing stamping process to complete the perfect non-roundness, or the steel pipe blank itself is a precision steel pipe, the pre-forming rolling process of the present invention can be simplified and omitted and directly enters process of correcting roundness and pipe thread forming rolling, or when party A produces a hollow blank that meets the requirements for subsequent external pipe thread processing through a processing method disclosed by the present invention, and then transports the hollow blank to the place where party B is located for subsequent production of pipe external thread products through the rolling processing of external pipe thread, it is also possible to produce qualified pipe external thread products.

For different types of steel pipe, such as carbon steel pipe, stainless steel pipe, copper pipe, titanium steel pipe and special alloy steel pipe, etc, and for different sizes of steel pipe, such as ⅜ inches and 6 inches above, or other non-standard outer diameter hollow blank, different pipe thickness, steel pipe with seam or without, different pipe thread profile, such as NPT, BSPT, API and metric pipe thread, etc. especially the pipe non-roundness, the structure and the number of the rolling wheel, and the depth of thread of the pre-formed thread, etc. can be determined according to the rolling method disclosed in the present invention.

In addition, through reasonable design, we can also combine other steel pipe straightening devices in the rolling head and equipment of the present invention to complete the pipe thread rolling.

Each of the rolling wheels can also rotate with its own rotating power to rotate around the rolling wheel shaft to generate movement relative to the hollow blank. Finally, it should be noted that the method of the present invention is not only suitable for hollow blank. We can make use of the principle of even and odd numbers different of pre-forming rolling head, and use multiple groups of rolling wheel to roll the blank which needs straightening, shrinking or surface strengthening so that the surface stress distribution of the workpiece is more uniform, thereby improving the roundness, straightness and surface hardness of the blank.

Therefore, the protection scope of the present invention should be considered as defined in the appended claims.

The invention claimed is:

1. A method for rolling an external pipe thread, comprising rolling a hollow blank by a first rolling wheel group and a second rolling wheel group sequentially, wherein the first rolling wheel group comprises at least three circumferentially arranged first rolling wheels, and the second rolling wheel group comprises at least two circumferentially arranged second rolling wheels, the outer surface of the first rolling wheels have pre-formed thread, and the outer surface of the second rolling wheels have external pipe thread forming portion, and the method includes the following steps:

step 1: the first rolling wheel group rolls the outer surface of the hollow blank into a threaded cylindrical surface, a threaded conical surface, or a threaded cylindrical conical mixing surface;

step 2: the second rolling wheel group rolls the outer surface of the hollow blank processed in the step 1 again, so as to form the external pipe thread by rolling; wherein a number of the first rolling wheels in the first rolling wheel group and a number of the second rolling wheels in the second rolling wheel group is odd-even different;

the pitch of the pre-formed thread is equal to the pitch of the thread on the external pipe thread forming portion, and the depth of the pre-formed thread is smaller than the depth of the thread on the external pipe thread forming portion.

2. The method for rolling an external pipe thread of claim 1, the number of the first rolling wheels in the first rolling wheel group is greater than the number of the second rolling wheels in the second rolling wheel group.

3. The method for rolling an external pipe thread of claim 1, wherein the method is used to process a conical external pipe thread, the rolling wheels in the first rolling wheel group are annular rolling wheels, and the rolling wheels in the second rolling wheel group are thread rolling wheels.

4. The method for rolling an external pipe thread of claim 1, wherein the method is used to process a conical external pipe thread, the first rolling wheel is pre-formed thread conical rolling wheel with a threaded outer surface, and there is a deflection angle of not more than 9 degrees in the vertical direction between the axis of the first rolling wheels and the axis of the hollow blank to be processed.

5. The method for rolling an external pipe thread of claim 1, wherein the method is used to process the conical external pipe thread, and the first rolling wheel group rolls the outer surface of the portion of the hollow blank to be provided with a thread into a threaded conical surface, and the taper of the conical surface is 2°-12°.

6. The method for rolling an external pipe thread of claim 1, the axial length of the cylindrical surface or conical surface or the cylindrical conical mixing surface to be processed by step1 is greater than or equal to the axial length of the external pipe thread.

7. A method for rolling an external pipe thread, wherein the method is to perform thread forming rolling process on the outer surface of a hollow blank which have been rolled through a pre-forming rolling, wherein the pre-forming rolling refers to a process of rolling the outer surface of the hollow blank into a threaded cylindrical or a threaded conical surface or a threaded cylindrical conical mixing surface by a first rolling wheel group, and the first rolling wheel group comprises at least three circumferentially arranged first rolling wheels with pre-formed thread outer surfaces, and the external pipe thread forming rolling is performed by a second rolling wheel group including at least two circumferentially arranged second rolling wheels whose outer surface having an external pipe thread forming portion, and wherein a number of the first rolling wheels in the first rolling wheel group and a number of the second rolling wheels in the second rolling wheel group is odd-even different; and the pitch of the pre-formed thread is equal to the pitch of the thread on the external pipe thread forming portion, and the depth of the pre-formed thread is smaller than the depth of the thread on the external thread forming portion.

8. A process module for rolling an external pipe thread, comprising a first rolling head and a second rolling head, wherein the first rolling head comprises at least three circumferentially arranged first rolling wheels; the first rolling wheels are rolling wheels with pre-formed thread outer surfaces; and the second rolling head comprises at least two circumferentially arranged second rolling wheels having an external pipe thread forming portion; the second rolling wheels are rolling wheels with pre-formed thread outer surfaces; and a number of the first rolling wheels in the first rolling wheel group and a number of the second rolling wheels in the second rolling wheel group is odd-even different; and the pitch of the first rolling wheel thread is equal to the pitch of the thread on the second rolling wheel thread, and the depth of the first rolling wheel thread is smaller than the depth of the second rolling wheel thread.

9. The process module for rolling an external pipe thread of module of claim 8, wherein the rolling wheels in the first rolling wheel group are annular rolling wheels, the rolling wheels in the second rolling wheel group are thread rolling wheels.

10. The process module for rolling an external pipe thread of module of claim 8, wherein the first rolling wheels are conical rolling wheels with pre-formed thread outer surfaces, and the taper of the conical rolling wheels is 2°–12°.

11. The process module for rolling an external pipe thread of module of claim 8, wherein the first rolling head and the second rolling head which are combined into one body and the first rolling head and the second rolling head are arranged coaxially with the hollow blank to be processed, wherein the first rolling head is arranged on the side close to the start of the external pipe thread.

12. The process module for rolling an external pipe thread of claim 8, wherein further comprises a first rolling head seat, a second rolling head seat, a transmission device and a power motor, the first rolling head is fixedly mounted on the first rolling head seat, and the second rolling head is fixedly mounted on the second rolling head seat; an input spindle of the transmission device and the output spindle of the power motor are mechanically coupled, and an output main shaft of the transmission device simultaneously forms a mechanical cooperation with the first rolling head seat and the second rolling head seat; the power motor can drive the first rolling head seat through the transmission device and rotate the second rolling head seat to drive the first rolling head and the second rolling head to rotate.

13. A rolling apparatus for forming external pipe thread, wherein the apparatus comprises at least one of the process module of claim 8, wherein the rolling apparatus further comprises a base, a power motor, a clamping device, a power motor control device and a transmission device; the base is provided with the power motor, the power motor control device, the clamping device and said process module, and the power motor is connected to the clamping device through the transmission device; under the control of the power motor control device, the power motor promotes the rotation of the hollow blank clamped by the clamping device through the transmission device, thereby generating a relative rolling rotary motion with the rolling processing module.

14. A rolling apparatus for forming external pipe thread, wherein the apparatus comprises at least one of the process module of claim 8, wherein the rolling apparatus comprises: a base, a power motor, a clamping device, a power motor control device and a transmission device; the base is provided with the power motor, the power motor control device, the clamping device and said process module; and the power motor is connected to the clamping device through the transmission device; under the control of the power motor control device, the power motor promotes the rotation of the first rolling wheel and the second rolling wheel in the rolling processing module through the transmission device, thereby clamping the clamping device on the hollow blank to produce a relative rolling rotational motion.

15. The rolling apparatus for forming external pipe thread of claim 13, wherein the clamping device comprises a power device, a first clamping die seat, a first clamping die, a second clamping die and a clamping frame;

the power device is coupled to the first clamping die seat; the first clamping die is mounted and fixed on the first clamping die seat; the power device, the first clamping die seat and the first clamping die are mounted on one side of the clamping frame; the second clamping die is mounted on the other side of the clamping frame within the clamping frame; and the first clamping die and the second clamping die are respectively provided with a first semi-cylindrical inner cavity and a second semi-cylindrical inner cavity at opposite positions;

under the action of the power device, the first clamping die seat is configured to move the first clamping die and to make to cooperate with the second clamping die to clamp the hollow blank.

16. The method for rolling an external pipe thread of claim 1, the axial length of the cylindrical surface or conical surface or the cylindrical conical mixing surface to be processed by step 1 is greater than the axial length of the external pipe thread by 1 to 3 pitches.

17. The process module for rolling an external pipe thread of claim 8, the number of the first rolling wheels in the first rolling head is greater than the number of the second rolling wheels in the second rolling head.

18. The rolling apparatus for forming external pipe thread of claim 15, wherein the first semi-cylindrical inner cavity and the inner surface of the second semi-cylindrical inner cavity have at least two convex arc-shaped bodies, and the arc of the arc-shaped body substantially coincides with the curvature of the hollow blank to be clamped.

* * * * *